US005166042A

United States Patent [19]

Nozawa

[11] Patent Number: 5,166,042

[45] Date of Patent: Nov. 24, 1992

[54] SILVER HALIDE PHOTOGRAPHIC MATERIAL SUITABLE FOR USE UNDER VARYING LIGHT CONDITIONS

[75] Inventor: Yasushi Nozawa, Kanagawa, Japan

[73] Assignee: Fuji Photo Film Co., Ltd., Kanagawa, Japan

[21] Appl. No.: 454,010

[22] Filed: Dec. 20, 1989

[30] Foreign Application Priority Data

Dec. 26, 1988 [JP] Japan ..... 63-328665

[51] Int. Cl.[5] ..... G03C 1/46; G03C 7/305

[52] U.S. Cl. ..... 430/504; 430/505; 430/551; 430/359; 430/362

[58] Field of Search ..... 430/504, 505, 506, 359, 430/362, 551

[56] References Cited

U.S. PATENT DOCUMENTS

| | | | |
|---|---|---|---|
| 3,672,898 | 6/1972 | Schwan et al. | 430/504 |
| 4,184,876 | 1/1980 | Eeles et al. . | |
| 4,705,744 | 11/1987 | Sasaki et al. | 430/505 |
| 4,707,436 | 11/1987 | Sasaki | 430/504 |
| 4,948,716 | 8/1990 | Mihayashi et al. | 430/504 |

FOREIGN PATENT DOCUMENTS

| | | |
|---|---|---|
| 0167173 | 7/1985 | European Pat. Off. . |
| 1914292 | 10/1969 | Fed. Rep. of Germany . |
| 2459927 | 10/1975 | Fed. Rep. of Germany . |
| 3700419A1 | 7/1987 | Fed. Rep. of Germany . |
| 62-160448 | 7/1987 | Japan . |
| 62-160449 | 7/1987 | Japan . |
| 1252066 | 11/1971 | United Kingdom . |

OTHER PUBLICATIONS

Patent Abstracts of Japan, vol. 11, No. 395 Dec. 24, 1987 p. 650.

Patent Abstracts of Japan, vol. 12, No. 327, p. 753 Sep. 6, 1988.

British Journal of Photography, vol. 130 (1983) Feb. 4; pp. 122, 123, 131.

British Journal of Photography, vol. 91 (1982), Oct., No. 10; pp. 919–921.

British Journal of Photography, vol. 131 (1984) Jun., No. 26, pp. 663–665.

British Journal of Photography, vol. 131 (1984) Dec. No. 52, pp. 1389–1393.

R. E. Jacobson: "The Manual of Photography" No. 155790, 1988, Focal Press, GB London pp. 251–257.

*Primary Examiner*—Lee C. Wright

*Attorney, Agent, or Firm*—Burns, Doane, Swecker & Mathis

[57] ABSTRACT

Disclosed is a silver halide color photographic photosensitive materials comprising, on a support, at least one red-sensitive silver halide emulsion layer, at least one green-sensitive silver halide emulsion layer, and at least one blue-sensitive silver halide emulsion layer. The ISO speed of the photosensitive material is S. The difference ($S_G^{560} - S_R^{560}$) is in the range of from −0.2 to 1.0. Here, $S_G^{560}$ and $S_R^{560}$ are, respectively, the speed of the green-sensitive silver halide emulsion layer and the speed of the red-sensitive silver halide emulsion layer with respect to monochromatic light of a wavelength of 560 nm, measured after subjecting the photosensitive material to a uniform exposure of 2/S lux.sec with white light.

9 Claims, 2 Drawing Sheets

SILVER HALIDE PHOTOGRAPHIC MATERIAL SUITABLE FOR USE UNDER VARYING LIGHT CONDITIONS

FIELD OF THE INVENTION

This invention concerns color photographic photosensitive materials. More precisely the invention concerns color photographic photosensitive materials used for taking photographs in daylight which also have excellent color reproduction characteristics when photographs are taken under fluorescent lighting.

BACKGROUND OF THE INVENTION

In the past, much effort has been directed to improving the color reproduction characteristics of color photographic photosensitive materials. For example, colored couplers which remove unwanted absorptions of colored dyes formed by the couplers have been developed for use in color negative films. Also, the interlayer inhibiting effect has been increased by introducing couplers which react with the oxidation products of the developing agents in the p-phenylenediamine based color development baths disclosed in JP-A-50-2537 (corresponding to U.S. Pat. No. 3,990,899) and release development inhibitors. Color saturation has also been improved in this way. The term "JP-A" as used herein signifies an "unexamined published Japanese patent application". However, there are significant disadvantages in the color reproduction characteristics of the currently used color photographic photosensitive materials. One of these disadvantages involves the production of a green cast when photographs are taken under fluorescent lights. Moreover, another drawback related to currently used photographic photosensitive materials is their inability to accurately reproduce colors which differ only slightly such as crimson and scarlet, red and orange, and yellow and yellowish greens.

A method in which the spectral sensitivity distributions of the blue-, green- and red-sensitive silver halide emulsion layers are limited to certain ranges in order to provide color reproduction fidelity and to provide photographic photosensitive materials used for taking photographs in which there is a reduced shift in color reproduction characteristics under various lighting conditions, has been disclosed in U.S. Pat. No. 3,672,898.

The present inventor has found, unfortunately, that the aforementioned techniques, even when combined, do not provide photosensitive materials having satisfactory color saturation and hue fidelity. This result is believed to be due to a number of factors:

(1) Color saturation is reduced when the spectral sensitivities are set within the ranges disclosed in U.S. Pat. No. 3,672,898.

(2) When the DIR compounds disclosed in JP-A-50-2537 are used to correct the reduced color saturation described above in (1), or masking is reinforced by means of colored couplers to increase color saturation, overlapping portions of the spectral sensitivity distributions of the blue-, green- and red-sensitive silver halide emulsion layers are mutually restrained and strain arises in the spectral sensitivity distribution. The result is that some shift in hue is inevitably produced.

A means of overcoming these problems has been suggested in JP-A-62-160448. This technique involves increasing saturation and achieving true reproduction of hues by means of a silver halide color photographic photo-sensitive material comprising, on a support, at least one blue-sensitive silver halide emulsion layer containing a yellow dye-forming color coupler, at least one green-sensitive silver halide emulsion layer containing a magenta dye-forming color coupler and at least one red-sensitive silver halide emulsion layer containing a cyan dye-forming color coupler, the weight-averaged wavelength ($\overline{\lambda}_G$) of spectral sensitivity distribution of the green-sensitive silver halide emulsion layer being in the range of from 520 nm to 580 nm, the weight-averaged wavelength ($\overline{\lambda}_{-R}$) of the wavelength distribution of the interlayer effect received by the at least one cyan dye-forming red-sensitive silver halide emulsion layer due to the other layers in the range of from 500 nm to 600 nm being in the range of more than 500 nm to 560 nm and the difference ($\overline{\lambda}_G - \overline{\lambda}_{-R}$) being 5 nm or more, characterized in that the wavelength distribution of the interlayer effect ($S_{-R}(\lambda)$) satisfies the following conditions:

(a) The wavelength $\lambda_{-R}^{max}$ at which $S_{-R}(\lambda)$ is the maximum is in the range of from 490 nm to 560 nm;

(b) The wavelength $\lambda_{-R}^{80}$ at which $S_{-R}(\lambda)$ is equal to 80% of $S_{-R}(\lambda_{-R}^{max})$ is in the range of from 450 nm to 534 nm and from 512 nm to 566 nm; and (c) The wavelength $\lambda_{-R}^{40}$ at which $S_{-R}(\lambda)$ is equal to 40% of $S_{-R}(\lambda_{-R}^{max})$ is in the range of from 400 nm to 512 nm and from 523 nm to 578 nm.

With the above-described technique, it was possible to greatly improve the color reproduction properties of color photosensitive materials, but these materials were still unsatisfactory. When photographs were taken under various light sources, especially under fluorescent lighting, there were slight shifts in coloration when compared to the colors obtained on taking pictures in daylight.

SUMMARY OF THE INVENTION

One object of the present invention, therefore, is to provide a color photographic photosensitive material which exhibits little change in color when photographs are taken in daylight and under fluorescent lighting conditions. More precisely, this object of the invention is to provide a color photographic photosensitive material which has a high color saturation, and which provides true color reproduction properties, while also providing little or no change in the color reproduction properties when pictures are taken under different light sources.

The above mentioned object of the present invention can be obtained by means of a silver halide color photographic photosensitive material comprising, on a support, at least one red-sensitive silver halide emulsion layer, at least one green-sensitive silver halide emulsion layer and at least one blue-sensitive silver halide emulsion layer, and of which the ISO speed is S, wherein the difference ($S_G^{560} - S_R^{560}$) is in the range of from −0.2 to 1.0, where $S_G^{560}$ and $S_R^{560}$ are, respectively, the speed of the green-sensitive silver halide emulsion layer and the speed of the red-sensitive silver halide emulsion layer with respect to monochromatic light of a wavelength of 560 nm, measured after subjecting the photosensitive material to a uniform exposure of 2/S lux.sec with white light.

DETAILED DESCRIPTION OF THE INVENTION

The values, $S_G^{560}$ and $S_R^{560}$, can be obtained according to the following method. The ISO speed of the color photographic photosensitive material is obtained by measurement in accordance with the method described in ISO 5800-1979 (E). A sample of color photographic photosensitive material having an ISO speed of S is then subjected to a uniform exposure of $2\times 1/S$ lux.sec with a light source of the same relative spectral energy distribution as that used for obtaining the ISO speed and with the same exposure time as used when obtaining the ISO speed. The test should be carried out in a room at a temperature of 20° C.±5° C. and relative humidity 60 ±10%, and the photosensitive material which is being tested is used after being left to stand under these conditions for a period of at least 1 hour. Within 1 hour of the uniform exposure the sample is subjected to an exposure of variable brightness using monochromatic light having a wavelength 560 nm. An exposing device of the non-intermittent exposure still illumination-type is used in the same way as when measuring the ISO speed, and the variable brightness is achieved by means of a light modulator such as an optical wedge. The exposure time is set to one tenth of a second. The monochromatic light having a wavelength 560 nm has a peak wavelength of its relative spectral energy at 560 nm±2 nm and a half value width of not more than 20 nm. Combinations of a light source normally used for exposing purposes (e.g., a tungsten lamp) and a commercial interference filter can be used to obtain such monochromatic light.

Figure 1:
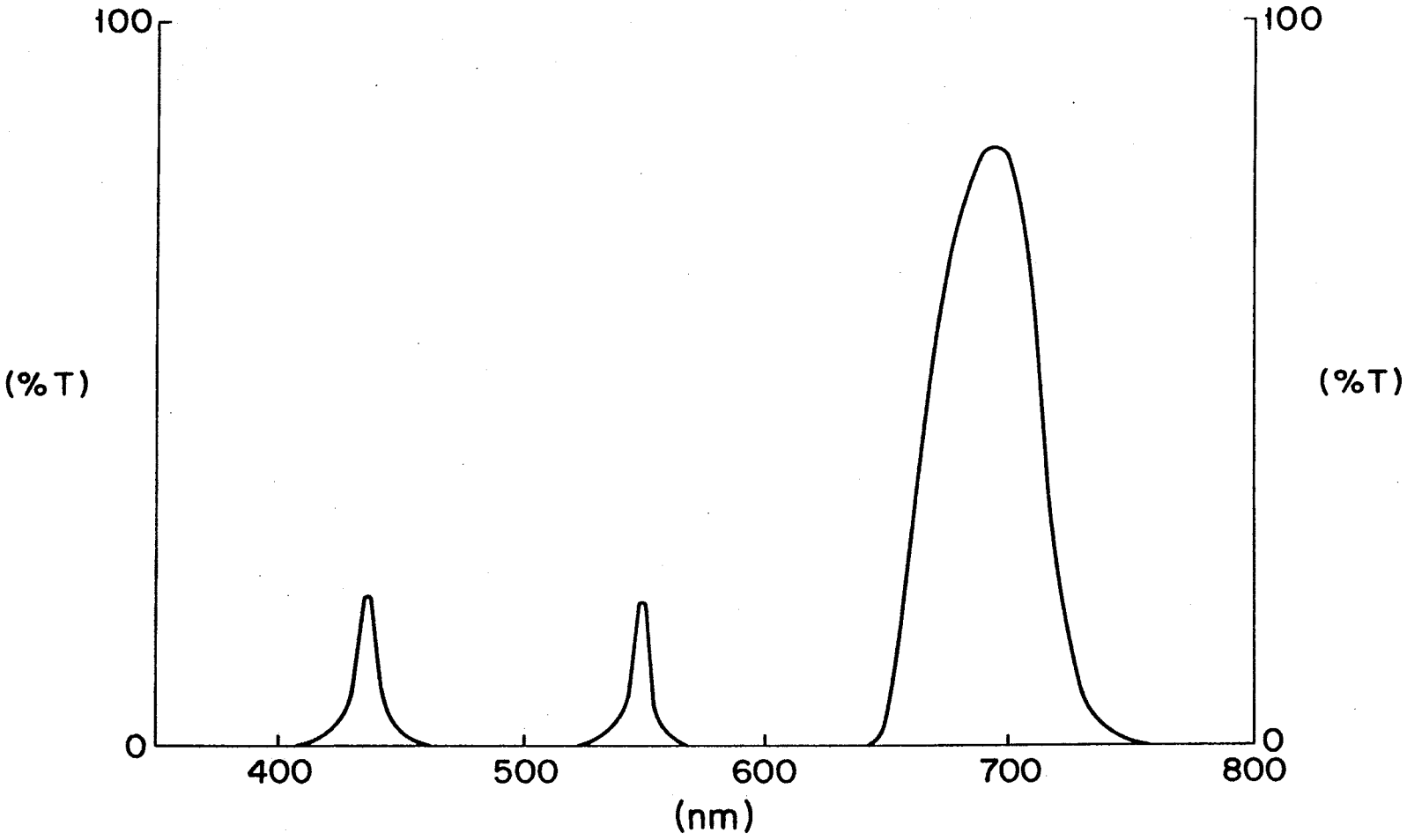
FIG. 1 shows the absorption spectra of the blue, green and red optical filters used for density measurements.

The photosensitive material which is being tested is maintained under conditions of a temperature of 20° C.±5° C., and relative humidity of 60±10% during the interval after the exposure to monochromatic light prior to development processing, and development processing is completed at least 30 minutes after exposure but within 6 hours. The method of processing recommended by the film manufacturers is used. The densities are then each measured using blue, green and red filters which have spectral characteristics as shown in FIG. 1. The detailed conditions for measurement are described in the ISO method.

The photographic speeds $S_G^{560}$ and $S_R^{560}$ are calculated using the equations shown below using the exposures $H_G^{560}$ lux.sec, $H_R^{560}$ lux.sec, at the points which have a density of minimum density (the density after uniform exposure) +0.6.

$$S_G^{560} = \log_{10}\frac{1}{H_G^{560}}$$

$$S_R^{560} = \log_{10}\frac{1}{H_R^{560}}$$

The inventor has investigated the technique disclosed in JP-A-62-160448 hoping to obtain a design policy for color photographic photosensitive materials which exhibit little shift in color relative to that obtained when photographs are taken in daylight, even when photographs are taken under fluorescent lights. This goal, however, proved to be unattainable while also maintaining color saturation and color fidelity. That is, the inventor has carried out various investigations while concentrating on spectral sensitivity distribution of the green-sensitive layer since the materials inevitably show a green cast when photographs are taken under fluorescent lights. But, when the materials were satisfactory with respect to fidelity and color shift when photographs were taken under fluorescent lighting, it was impossible to maintain color saturation. When the materials were satisfactory with respect to color saturation and color shift when photographs were taken under fluorescent lighting, on the other hand, it was impossible to obtain true color reproduction characteristics.

As a result of thorough research, it was found that with monochromatic sensitometry at various wavelengths, and especially at 560 nm, a value of $S_G^{560}-S_R^{560}$ at 560 nm measured after subjecting the material to a uniform exposure as described above within a specified range was of importance. The reason for this is not clear. However, it is theorized that since reflecting bodies having rather dull colors are often the subject of photographs, it is likely that photosensitive materials can be designed in such a way that the color shift in pictures taken under fluorescent light is slight by making color photosensitive materials used for taking photographs with a fixed white light-mixed monochromatic light sensitometry as a result of some correlation with the energy distribution of fluorescent lights in general.

Surprisingly, it has been possible to obtain photosensitive materials which have excellent red saturation and intermediate color reproduction with such a design, without using the known techniques disclosed in JP-A-61-34541 and JP-A-62-160448 wherein $\overline{\lambda}_G-\overline{\lambda}_{-R}\geqq 5$ nm.

In this respect, the weight-averaged wavelength ($\overline{\lambda}_{-R}$) of the wavelength distribution of the interlayer effect received by the red-sensitive silver halide emulsion layer due, to the other layers in the range of between 500 nm and 600 nm can be obtained as follows:

(1) The cyan dye-forming red-sensitive layer which is sensitive to radiation having a wavelength longer than 600 nm is uniformly exposed through a red filter (which transmits only radiation to which the red-sensitive layer is sensitive and to which the other layers are insensitive) or an interference filter (which transmits only radiation having a specific wavelength) to uniformly fog the cyan dye-forming red-sensitive layer to an appropriate optical density.

Figure 2:
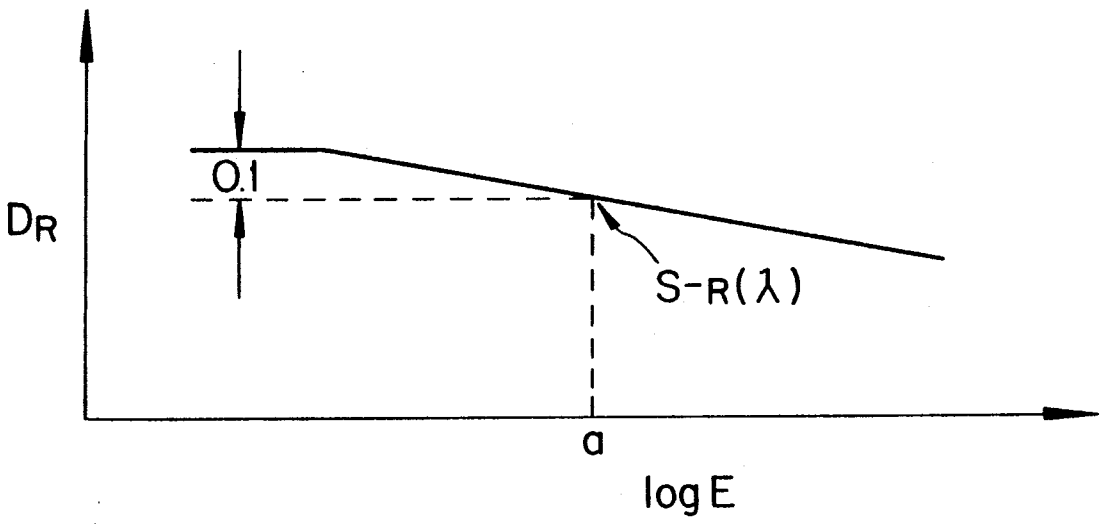
FIG. 2 shows the characteristic curve of the reversal image obtained with an interlayer effect from the green-sensitive layer on the red-sensitive layer at wavelength λ.

(2) The spectrum exposure is made to cause the interlayer development inhibiting effect on the fogged emulsion layer from the blue-sensitive and the green-sensitive layers. As a result, a reversal image is obtained (see FIG. 2).

(3) From this reversal image, the spectral sensitivity distribution $S_{-R}(\lambda)$ as a reversal light-sensitive material is found. The relative value of $S_{-R}(\overline{\lambda})$ at a specific wavelength (λ) can be found at the point (a) in FIG. 2.

(4) The weight-averaged wavelength ($\overline{\lambda}_{-R}$) of the interlayer effect is calculated according to the following equation:

$$\overline{\lambda}_{-R} = \frac{\int_{500\,nm}^{600\,nm} \lambda \cdot S_{-R}(\lambda)d\lambda}{\int_{500\,nm}^{600\,nm} S_{-R}(\lambda)d\lambda}$$

While the weight-averaged wavelength ($\overline{\lambda}_G$) is defined by the following equation.

$$\overline{\lambda}_G = \frac{\int_{500\,nm}^{600\,nm} \lambda \cdot S_G(\lambda)d\lambda}{\int_{500\,nm}^{600\,nm} S_G(\lambda)d\lambda}$$

Known techniques such as the selection of appropriate sensitizing dyes and the incorporation of filter layers in which various dyes are used, can be employed to achieve the $S_G^{560}-S_R^{560}$ value of the present invention.

In this present invention, $S_G^{560}-S_R^{560}$ must be such that $-0.2 \leqq S_G^{560}-S_R^{560} \leqq 1.0$. Preferably, $0.1 \leqq S_G^{560}-S_R^{560} \leqq 1.0$, and most desirably $0.2 \leqq S_G^{560}-S_R^{560} \leqq 0.9$.

By using color photosensitive materials obtained according to the present invention, it is possible to reduce the color shift under fluorescent lighting while maintaining a high color saturation and true color reproduction characteristics. Moreover, it is possible to discriminate between scarlet and crimson by color photosensitive materials according to the present invention wherein the weight-averaged wavelength ($\overline{\lambda}_R$) of the spectral sensitivity distribution of the red-sensitive layer is in the range of from 590 nm to 660 nm, the weight-averaged wavelength ($\overline{\lambda}_R$) of the wavelength distribution of the interlayer effect received by the green-sensitive silver halide emulsion layer due to the other layers in the range from 570 nm to 680 nm is in the range of from 600 nm to 680 nm, and the difference ($\overline{\lambda}_{-G}-\overline{\lambda}_R$) is in the range of 5 nm or more. Here, $\overline{\lambda}_{-G}$ and $\overline{\lambda}_R$ are given by the following equations.

$$\overline{\lambda}_{-G} = \frac{\int_{570\,nm}^{680\,nm} \lambda \cdot S_{-G}(\lambda)d\lambda}{\int_{570\,nm}^{680\,nm} S_{-G}(\lambda)d\lambda}$$

$$\overline{\lambda}_R = \frac{\int_{570\,nm}^{680\,nm} \lambda \cdot S_R(\lambda)d\lambda}{\int_{570\,nm}^{680\,nm} S_R(\lambda)d\lambda}$$

$\overline{\lambda}_{-G}-\overline{\lambda}_R$ is preferably at least 10 nm.

Furthermore, it is possible to improve the distinction between orange and red hues by color photosensitive materials according to the present invention wherein the weight-averaged wavelength ($\overline{\lambda}_G$) of the spectral sensitivity distribution of the green-sensitive layer in the range of from 520 nm to 580 nm, the weight-averaged wavelength ($\overline{\lambda}_{-B}$) of the wavelength distribution of the interlayer effect received by the blue-sensitive silver halide emulsion layer due to the other layers in the range from 500 nm to 600 nm is in the range of from 530 nm to 600 nm, and the difference ($\overline{\lambda}_{-B}-\overline{\lambda}_G$) is in the range of 5 nm or more. Here, $\overline{\lambda}_{-B}$ and $\overline{\lambda}_G$ are given by the following equations.

$$\overline{\lambda}_{-B} = \frac{\int_{500\,nm}^{600\,nm} \lambda \cdot S_{-B}(\lambda)d\lambda}{\int_{500\,nm}^{600\,nm} S_{-B}(\lambda)d\lambda}$$

$$\overline{\lambda}_G = \frac{\int_{500\,nm}^{600\,nm} \lambda \cdot S_G(\lambda)d\lambda}{\int_{500\,nm}^{600\,nm} S_G(\lambda)d\lambda}$$

$\overline{\lambda}_{-B}-\overline{\lambda}_G$ is preferably at least 10 nm.

In this present invention, the spectral sensitivity distributions of the blue-sensitive, green-sensitive and red-sensitive layers are obtained, for example, by using appropriate combinations of spectrally sensitizing dyes which have structural formulae as indicated below.

Blue-Sensitive Silver Halide Emulsion Layers

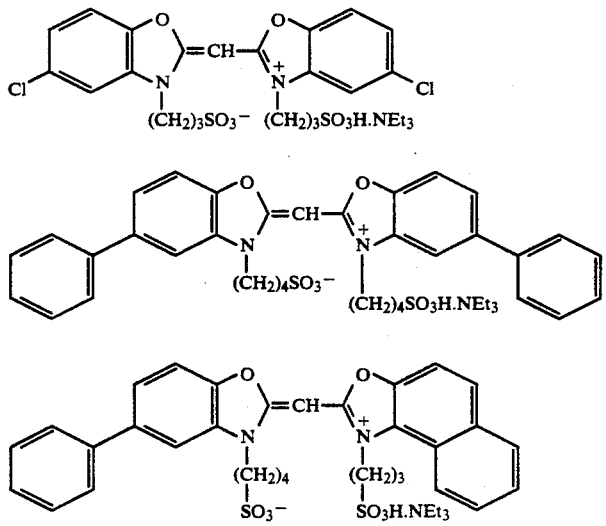

-continued
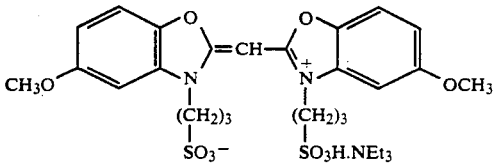
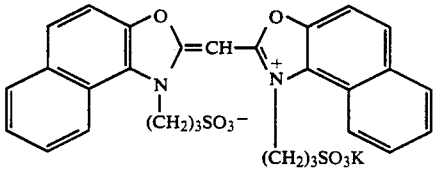
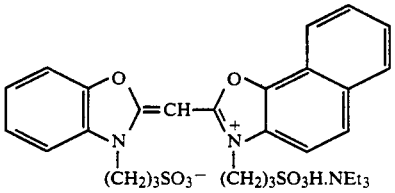
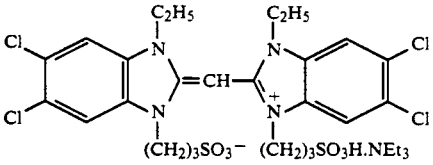
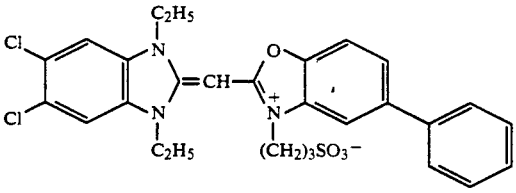
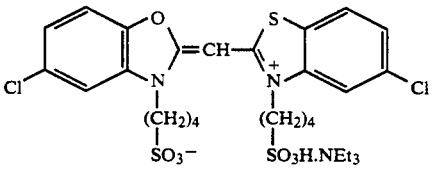
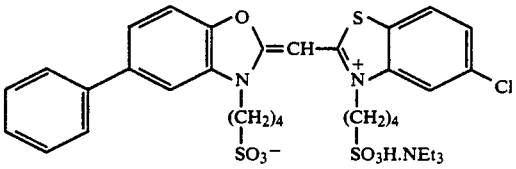
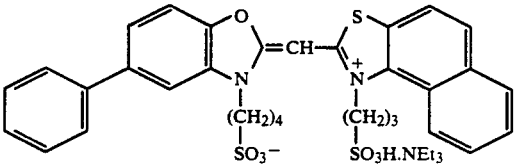

-continued
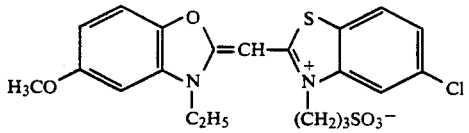
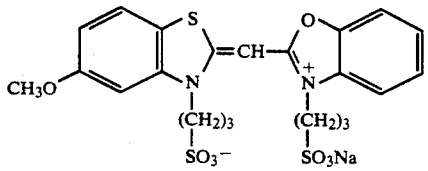
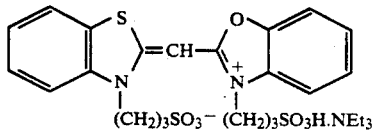
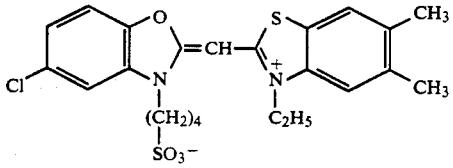
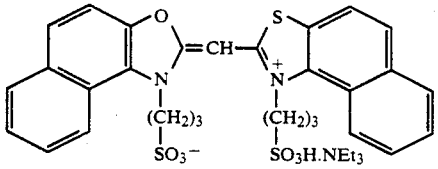
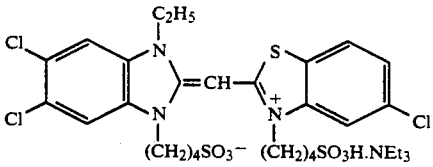
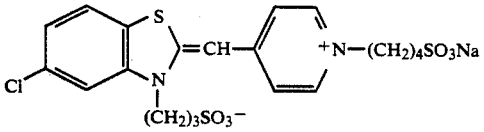
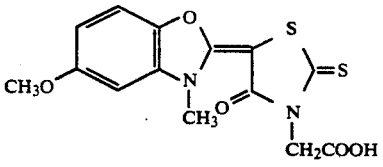
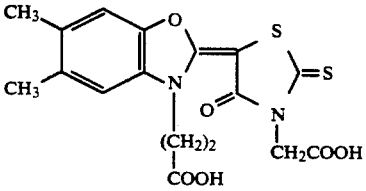

-continued
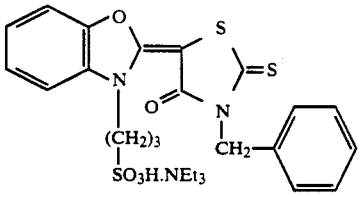
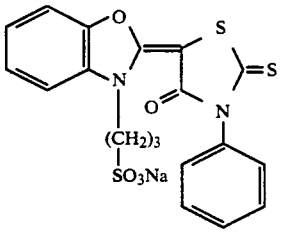
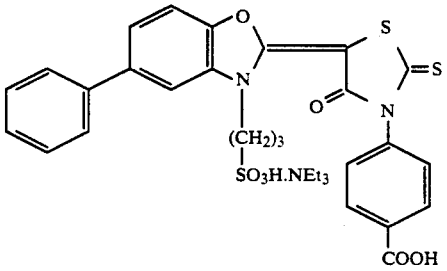
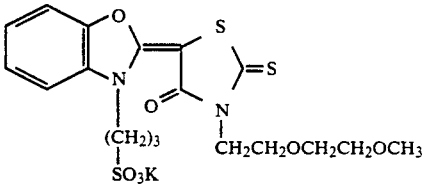
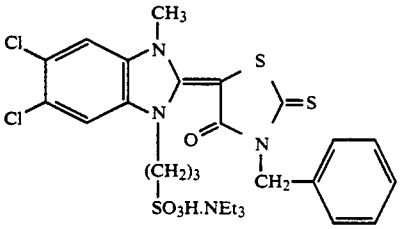
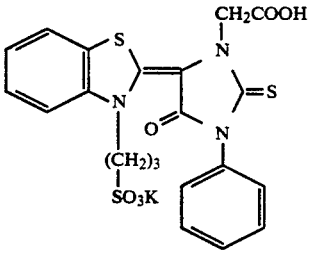
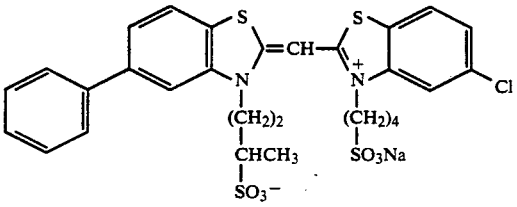

-continued
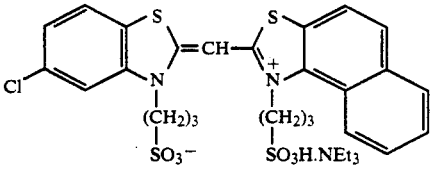
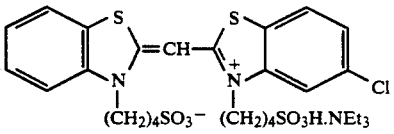
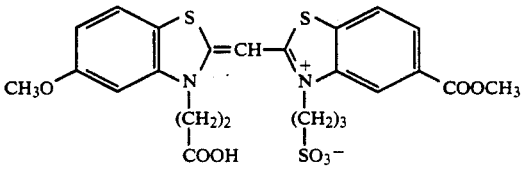
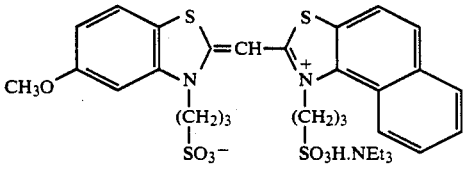
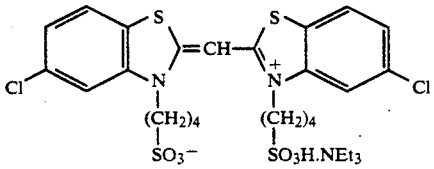
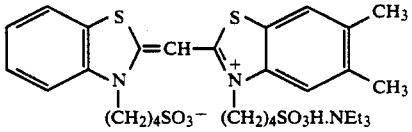
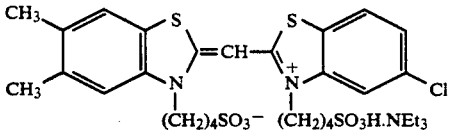
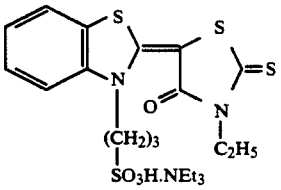
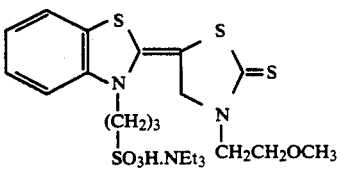

-continued
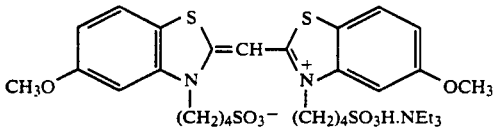
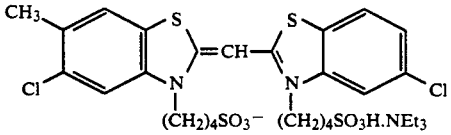
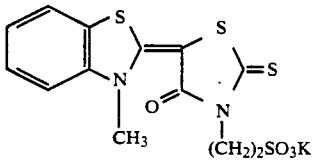
Green-Sensitive Silver Halide Emulsion Layers
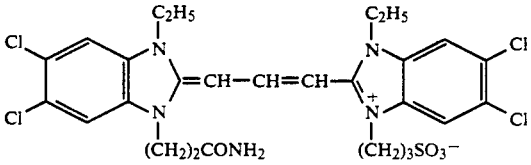
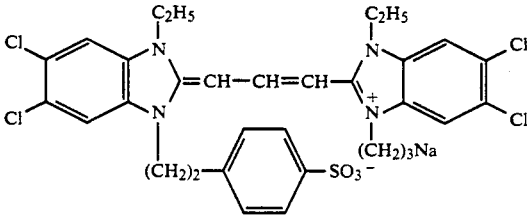
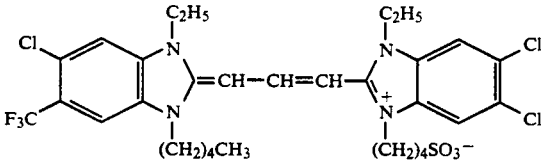
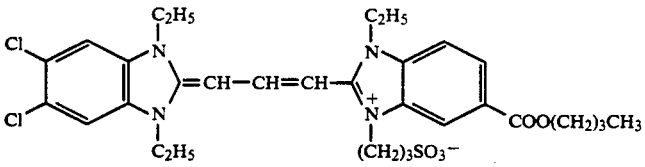
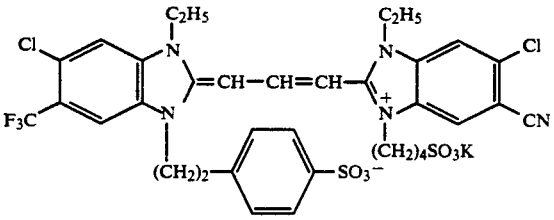

-continued
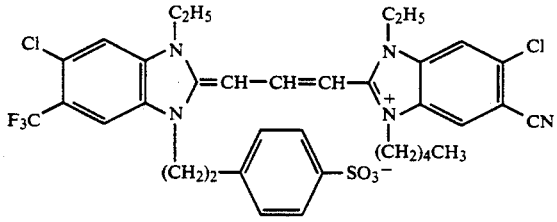
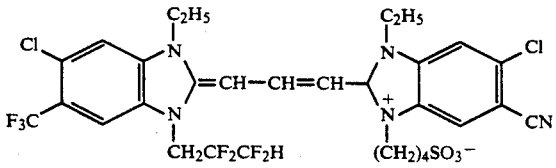
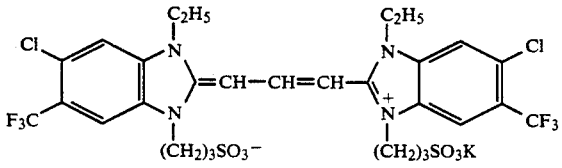
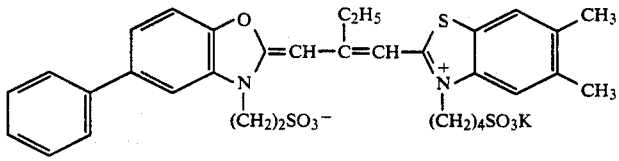
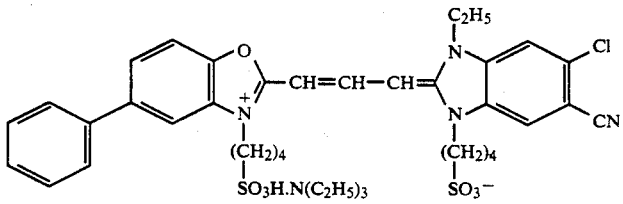
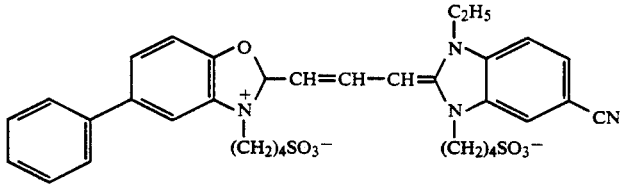
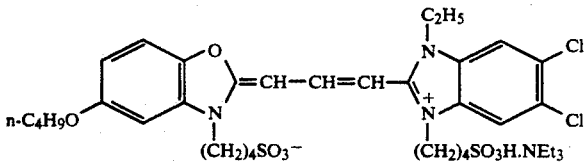
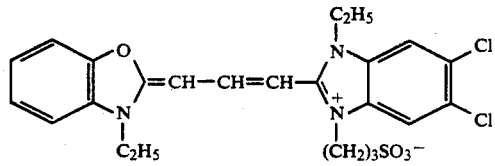

-continued
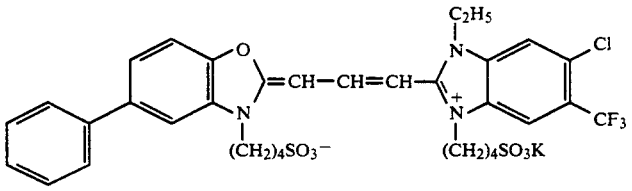
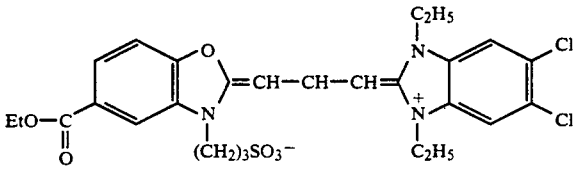
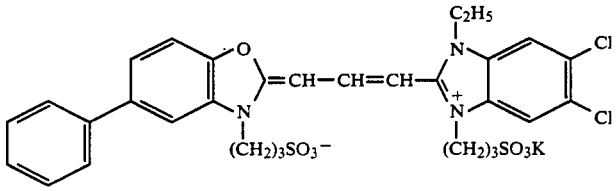
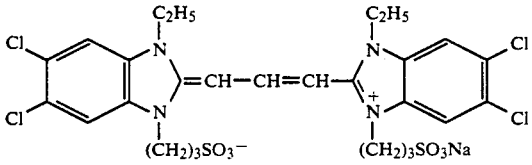
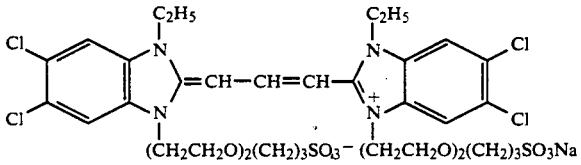
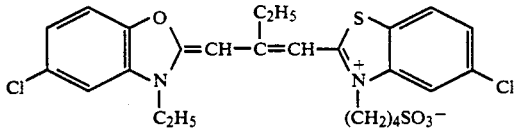
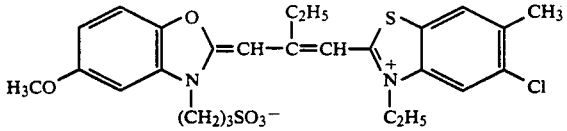
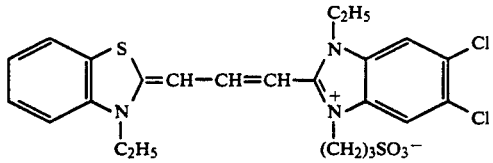
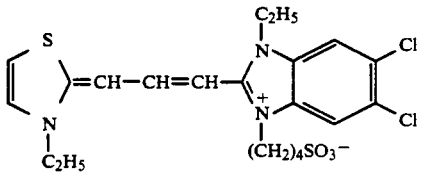

-continued
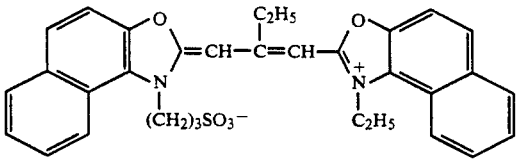
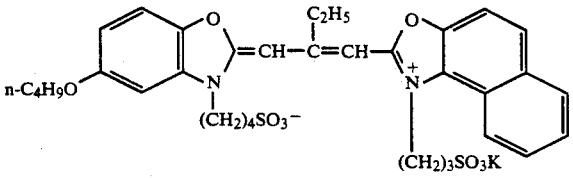
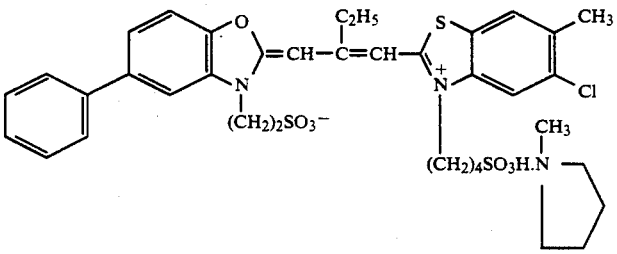
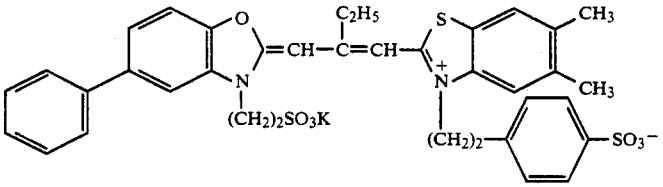
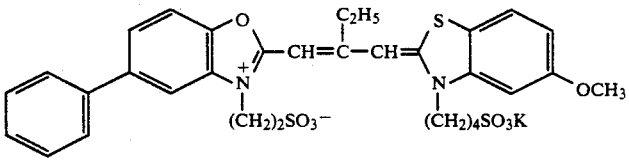
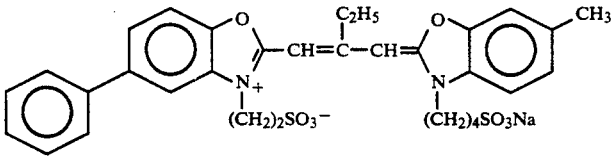
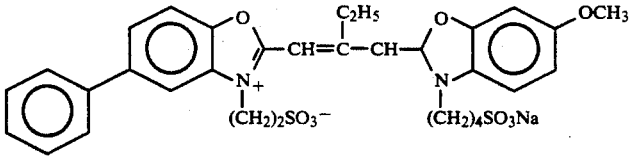
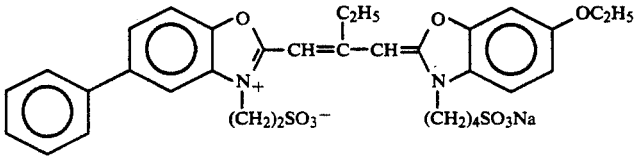

-continued
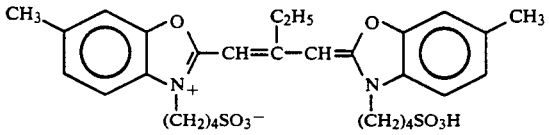
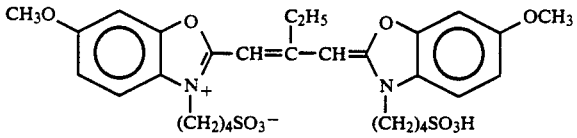
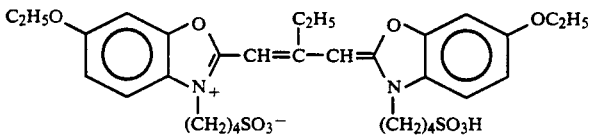
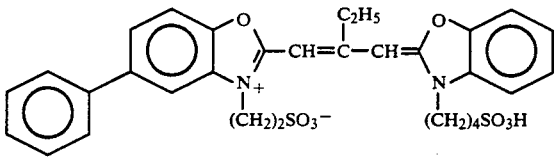
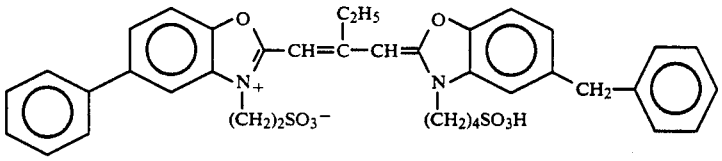
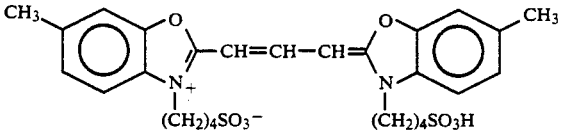
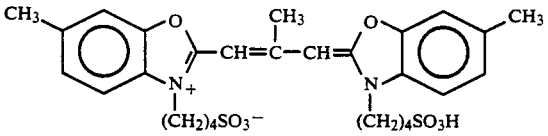
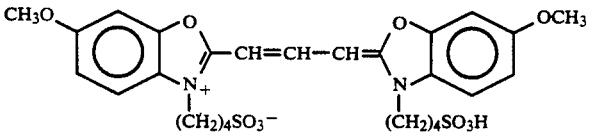
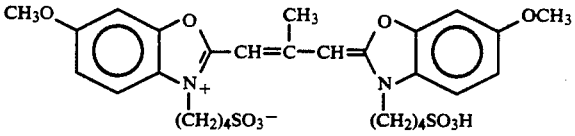
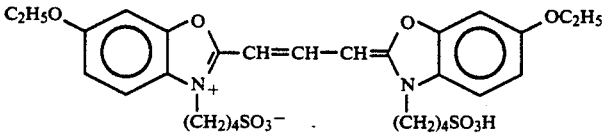

-continued
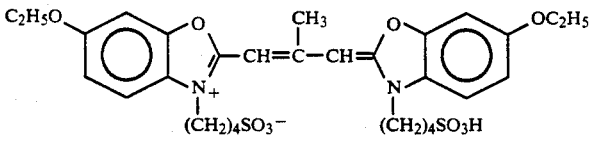
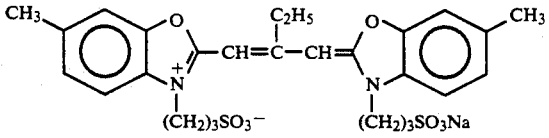
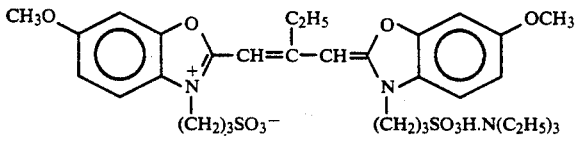
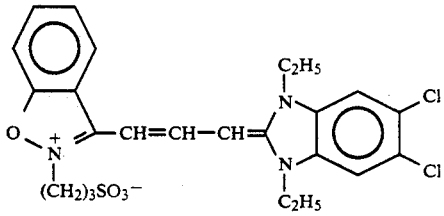
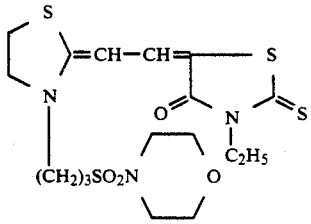
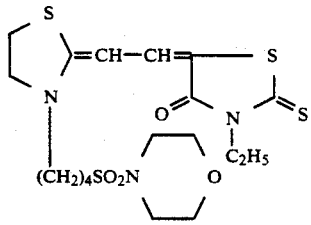
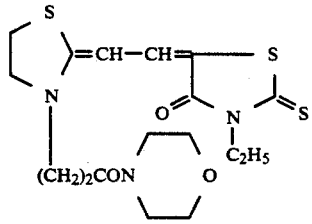
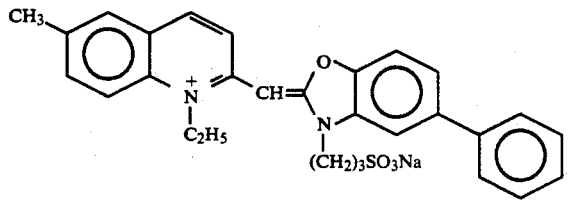

-continued
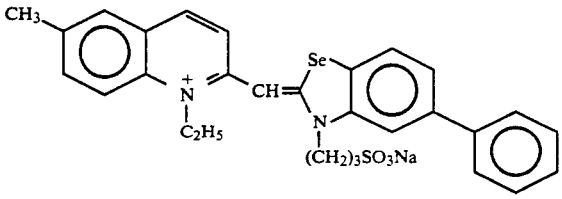
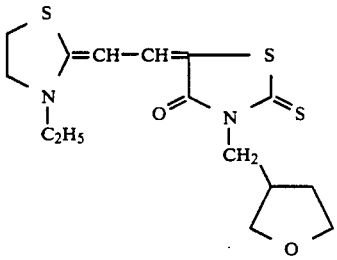
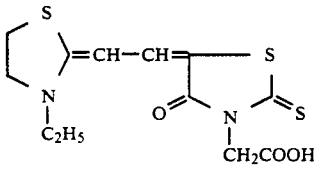
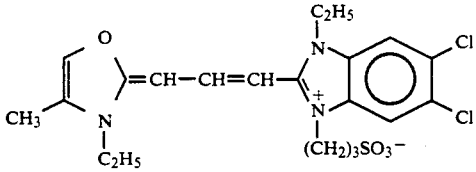
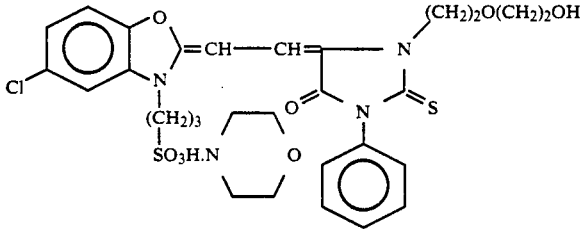
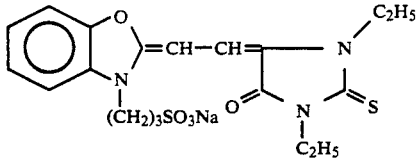
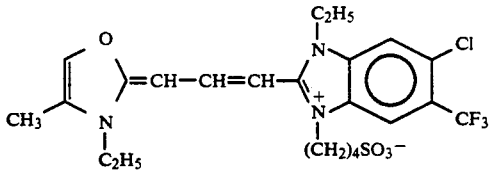
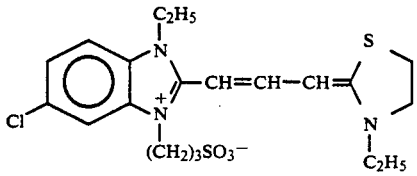

-continued
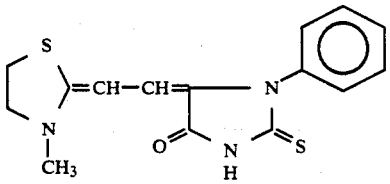
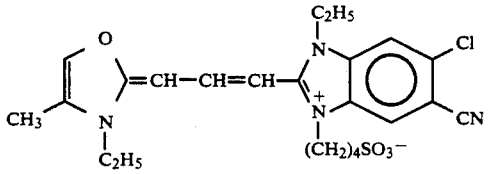
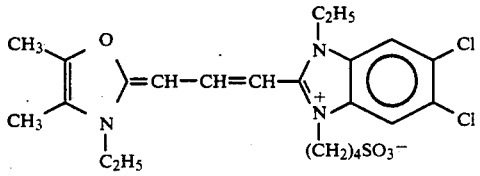
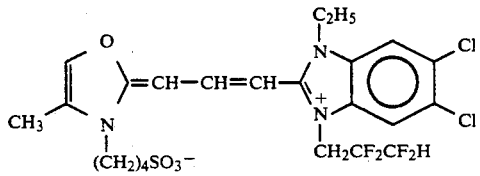
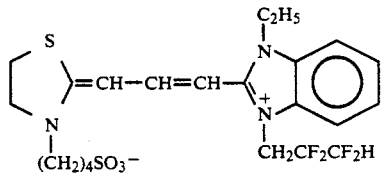
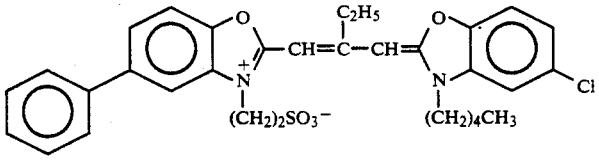
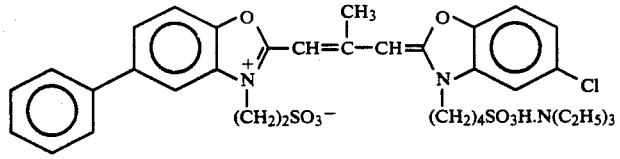
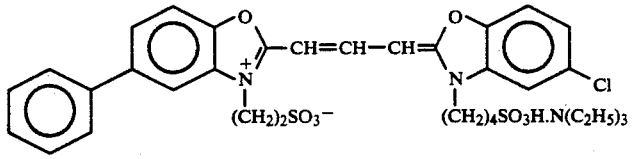
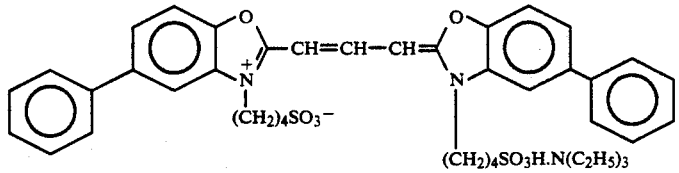

-continued

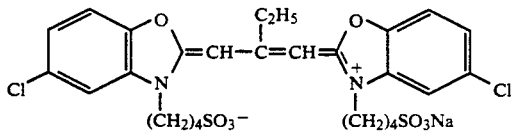

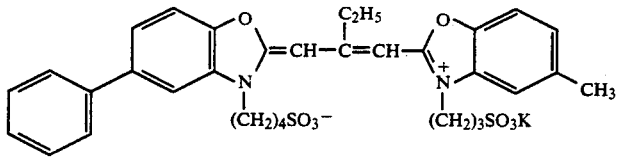

Furthermore, it is especially desirable that sensitizing dyes represented by the general formulae [S-I] to [S-VI] indicated below are used individually or in combination with the aforementioned sensitizing dyes in the green-sensitive silver halide emulsion layers of the present invention.

[S-I]

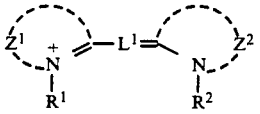

In the above formula, $Z^1$ and $Z^2$ represent groups of atoms which are required to form a nuclei derived from a tellurazole, benzotellurazole, naphthotellurazole, quinoline, benzoxazole, naphthoxazole, benzothiazole, naphthothiazole, benzoselenazole or naphthoselenazole nucleus. $R^1$ and $R^2$ represent alkyl groups, and it is desirable that at least one of these groups be substituted with a sulfo group or a carboxyl group. $L^1$ represents a methine group. $X^1$ represents an anion. Moreover, $n^1$ represents 0 or 1, and is 0 when an intramolecular salt is formed.

[S-II]

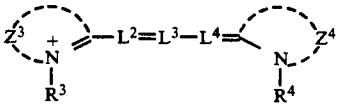

In the above formula, $Z^3$ and $Z^4$ represent groups of atoms which are required to form nuclei derived from a tellurazole, benzotellurazole, naphthotellurazole, benzoxazole, naphthoxazole, benzimidazole, naphthimidazole, oxazolidine, oxazole, thiazolidine or selenazolidine nucleus. $R^3$ and $R^4$ are the same as $R^1$ and $R^2$. $L^2$, $L^3$ and $L^4$ are the same as $L^1$. $X^2$ is the same as $X^1$. Moreover, $n^2$ is the same as $n^1$.

[S-III]

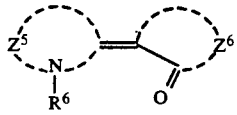

In the above formula, $Z^5$ represents a group of atoms which is required to form a nucleus derived from a tellurazole, benzotellurazole, naphthotellurazole, benzothiazole, naphthothiazole, benzoselenazole, naphthoselenazole, benzoxazole, naphthoxazole, quinoline, pyridine, thiazole or pyrrolidine nucleus. $Z^6$ represents a group of atoms which is required to form a nucleus derived from a rhodanine, 2-thioxooxazolidine, or thiohydantoin nucleus. $R^6$ represents an alkyl group.

[S-IV]

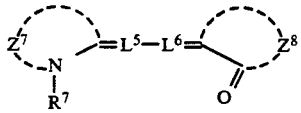

In the above formula, $Z^7$ represents a group of atoms which is required to form a nucleus derived from a tellurazole, benzotellurazole, naphthotellurazole, oxazole, oxazolidine, iso-oxazole, benzoxazole, naphthoxazole, thiazolidine, selenazolidine, benzothiazole, naphthothiazole, benzimidazole, naphthimidazole, pyrrolidine or tetrazole nucleus. $Z^8$ represents a group of atoms which is required to form a nucleus derived from a rhodanine, thiohydantoin, pyrazolone, thiobarbituryl, 2-thioxooxazolidinone or barbituryl nucleus. $L^5$ and $L^6$ are the same as $L^1$. $R^7$ is the same as $R^6$.

[S-V]

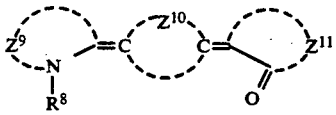

In the above formula, $Z^9$ represents a group of atoms which is required to form a nucleus derived from a tellurazole, benzotellurazole, naphthotellurazole, thiazolidine, or selenazolidine nucleus. $Z^{10}$ and $Z^{11}$ represent groups of atoms which are required to form nuclei derived from a rhodanine nucleus, and $R^8$ is the same as $R^6$.

[S-VI]

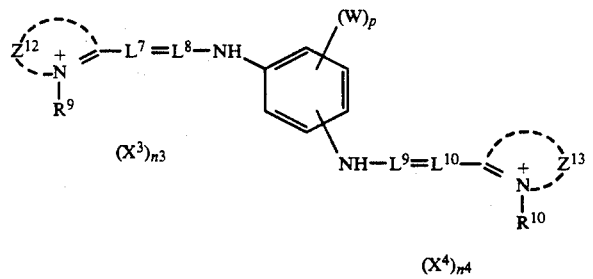

In the above formula, $Z^{12}$ and $Z^{13}$ represent groups of atoms which are required to form nuclei derived from an oxazolidine, oxazole, benzoxazole, naphthoxazole, thiazolidine, thiazole, benzothiazole, naphthothiazole, selenazolidine, selenazole, benzoselenazole, naphthoselenazole, tellurazole, benzotellurazole or naphthotellurazole nucleus. $R^9$ and $R^{10}$ are the same as $R^1$ and $R^2$. $L^7$, $L^8$, $L^9$ and $L^{10}$ are the same as $L^1$. $X^3$ and $X^4$ are the same as XI Moreover, $n^3$ and $n^4$ are the same as $n^1$. W represents a hydrogen atom, a carboxyl group or a sulfo group. And, p represents an integer of value from 1 to 4.

In formulae [S-I] to [S VI], $R^1$, $R^2$, $R^3$, $R^4$, $R^5$, $R^6$, $R^7$, $R^8$, $R^9$ and $R^{10}$ are preferably hydrogen atoms; unsubstituted alkyl groups which have not more than 18 carbon atoms such as methyl, ethyl, propyl, butyl, pentyl, octyl, decyl, dodecyl, octadecyl; or substituted alkyl groups such as alkyl groups which have not more than 18 carbon atoms which have been substituted with, as substituent groups, carboxyl groups, sulfo groups, cyano groups, halogen atoms such as fluorine, chlorine, and bromine, hydroxyl groups, alkoxycarbonyl groups which have not more than 8 carbon atoms such as methoxycarbonyl, ethoxycarbonyl, phenoxycarbonyl, and benzyloxycarbonyl, alkoxy groups which have not more than 8 carbon atoms such as methoxy, ethoxy, benzyloxy, and phenethyloxy, single ring aryloxy groups which have not more than 10 carbon atoms such as phenoxy and p-tolyloxy, acyloxy groups which have not more than 3 carbon atoms such as acetyloxy and propionyloxy, acyl groups which have not more than 8 carbon atoms such as acetyl, propionyl, benzoyl, and mesyl, carbamoyl groups such as carbamoyl, N,N-dimethylcarbamoyl, morpholinocarbonyl, and piperidinocarbonyl, sulfamoyl groups such as sulfamoyl, N,N-dimethylsulfamoyl, morpholinosulfonyl, and piperidinosulfonyl or aryl groups which have not more than 10 carbon atoms such as phenyl, 4-chlorophenyl, 4-methylphenyl, and α-naphthyl; aryl groups such as phenyl and 2-naphthyl; substituted aryl groups such as 4-carboxyphenyl, 4-sulfophenyl, 3-chlorophenyl, and 3-methylphenyl; or heterocyclic groups such as 2-pyridyl and 2-thiazolyl. Of these, unsubstituted alkyl groups such as methyl and ethyl and sulfoalkyl groups such as 2-sulfoethyl, 3-sulfopropyl, and 4-sulfobutyl, are especially desirable.

Furthermore, alkali metal atoms are preferred as the metal atoms which can form salts with $R^1$, $R^2$, $R^3$, $R^4$, $R^5$, $R^6$, $R^7$, $R^8$, $R^9$ and $R^{10}$. Pyridines and amines are preferred as salt forming organic compounds.

The nuclei formed by $Z^1$, $Z^2$, $Z^3$, $Z^4$, $Z^5$, $Z^7$, $Z^9$, $Z^{12}$ and $Z^{13}$ can be selected from among thiazole nuclei including the thiazole nuclei (such as thiazole, 4-methylthiazole, 4-phenylthiazole, 4,5-dimethylthiazole, and 4,5-diphenylthiazole), benzothiazole nuclei (such as benzothiazole, 4-chlorobenzothiazole, 5-chlorobenzothiazole, 6-chlorobenzothiazole, 5-nitrobenzothiazole, 4-chlorobenzothiamethylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5 ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, and 4-phenylbenzothiazole), and naphthothiazoles (such as naphtho[2,1-d]thiazole, naphtho1,2-d]thiazole, naphtho[2,3-d]thiazole, 5-methoxynaphtho[1,2-d]thiazole, 6-methoxynaphtho[1,2-d]thiazole, 7-ethoxynaphtho[2,1-d]-thiazole, 8-methoxynaphtho[2,1-d]thiazole, and 5-methoxynaphtho[2,3-d]thiazole); thiazoline nuclei such as thiazoline, 4-methylthiazoline, and 4-nitrothiazoline; oxazole nuclei including the oxazole nuclei (e.g., oxazole, 4-methyloxazole, 4-nitrooxazole, 5-methyloxazole, 4-phenyloxazole, 4,5-diphenyloxazole, and 4-ethyloxazole), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), and naphthoxazole nuclei (e.g., naphtho[2,1-d]oxazole, naphtho[1,2-d]-oxazole, naphtho[2,3-d]oxazole, and 5-nitronaphtho[2,1-d]-oxazole); oxazoline nuclei such as 4,4-dimethyloxazoline; selenazole nuclei including the selenazole nuclei (e.g., 4-methylselenazole, 4-nitroselenazole, and 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and naphthoselenazole nuclei (e.g., naphtho[2,1-d]selenazole, and naphtho[1,2-d]selenazole); selenazoline nuclei such as selenazoline and 4-methylselenazoline; tellurazole nuclei including the tellurazole nuclei (e.g., tellurazole, 4-methyltellurazole, and 4-phenyltellurazole), benzotellurazole nuclei (e.g.,. benzotellurazole, 5-chlorobenzotellurazole, 5-methylbenzotellurazole, 5,6-dimethylbenzotellurazole, and 6-methoxybenzotellurazole), and naphthotellurazole nuclei (e.g., naphtho[2,1-d]tellurazole and naphtho[1,2-d]tellurazole); tellurazoline nuclei such as tellurazoline and 4-methyltellurazoline; 3,3-dialkylindolenine nuclei such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3,5 dimethyl-5-chloroindolenine; imidazole nuclei including the imidazol nuclei (e.g., 1-alkylimidazole and 1-alkyl-4-phenylimidazole), benzimidazole nuclei (e.g., 1-alkylbenzimidazole, 1 alkyl 5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, and 1-aryl-5-cyanobenzimidazole), and naphthimidazole nuclei (e.g., 2-alkylnaphtho[1,2-d]imidazole, 1-arylnaphtho[1,2-d]imidazole), wherein the aforementioned alkyl groups are preferably groups which have from 1 to 8 carbon atoms such as unsubstituted alkyl groups such as methyl, ethyl, propyl, iso-propyl, butyl, or hydroxyalkyl groups (e.g., 2-hydroxyethyl and 3-hydroxypropyl) and of these groups the methyl and ethyl groups are especially desirable and, wherein the aforementioned aryl groups are phenyl groups, halogen (e.g., chloro) substituted phenyl groups, alkyl (e.g., methyl) substituted phenyl groups or alkoxy (e.g., methoxy) substituted phenyl groups; pyridine nuclei such as 2-pyridine, 4-pyridine, 5-methyl-2-pyridine, and 3-methyl-4-pyridine; quinoline nuclei including the quinoline nuclei (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and isoquinoline nuclei (e.g., 6-nitro-1-isoquinoline, 4-dihydro-1-isoquinoline, and 6-nitro-3-isoquinoline); tetrazole nuclei; and pyrrolidine nuclei.

The nuclei formed by $Z^6$, $Z^8$, $Z^{10}$ and $Z^{11}$ can be selected from among, for example, 2-pyrazolin-5-one, pyrazolidin-3,5-dione, imidazolin-5-one, hydantoin, 2-, or 4-thiohydantoin, 2-imino-oxazolidin-4-one, 2-oxazolin-5-one, 2-thioxooxazolin-2,4-dione, isooxazolin-5-one, 2 thiazolin-4-one, thiazolidin-4-one, thiazolidin-2,4-dione, rhodanine, thiazolidin-2,4-dione, iso-rhodanine, indan-1,3-dione, barbituric acid and 2-thiobarbituric acid nuclei.

Substituent groups which are bonded to the nitrogen atoms included in these nuclei are preferably hydrogen atoms; alkyl groups which have from 1 to 18, preferably from 1 to 7, and most desirably from 1 to 4, carbon atoms (e.g., methyl, ethyl, propyl, iso-propyl, butyl, iso-butyl, hexyl, octyl, dodecyl, and octadecyl); substituted alkyl groups such as aralkyl groups (e.g., benzyl and 2-phenylethyl), hydroxyalkyl groups (e.g., 2-hydroxyethyl and 3-hydroxypropyl, carboxyalkyl groups (e.g., 2-carboxyethyl, 3-carboxypropyl, 4-carboxybutyl and carboxymethyl), alkoxyalkyl groups (e.g., 2-methoxyethyl and 2 (2-methoxyethoxy)ethyl), sulfoalkyl groups (e.g., 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), sulfatoalkyl groups (e.g., 3-sulfatopropyl and 4-sulfatobutyl), heterocyclic substituted alkyl groups (e.g., 2-(pyrrolidin-2-one-1-yl)ethyl, tetrahydrofurfuryl, and 2-morpholinoethyl), 2-acetoxyethyl, carbomethoxymethyl, 2-methanesulfonylaminoethyl; allyl group; aryl groups (such as phenyl and 2-naphthyl); substituted aryl groups such as 4-carboxyphenyl, 4-sulfophenyl, 3-chlorophenyl, and 4-methylphenyl; or heterocyclic groups such as 2-pyridyl and 2-thiazolyl.

$L^1$, $L^2$, $L^3$, $L^4$, $L^5$, $L^6$, $L^7$, $L^8$, $L^9$ and $L^{10}$ represent methine groups which may be substituted with substituted or unsubstituted alkyl groups such as methyl and ethyl, substituted or unsubstituted aryl groups such as phenyl or halogen atoms such as chlorine and bromine. They may form rings with other methine groups, or they may form rings with auxochromes.

The anions represented by $X^1$, $X^2$, $X^3$ and $X^4$ may in practice be any inorganic anions or organic anions such as halogen anions (e.g., fluoride, chloride, bromide, and iodide), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion, and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion or trifluoromethanesulfonate ion.

Actual examples of especially desirable dyes are indicated below.

S-1

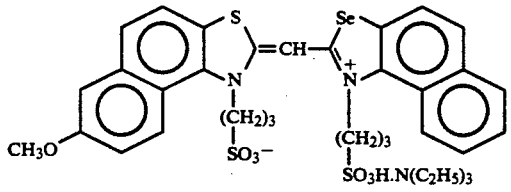

S-2

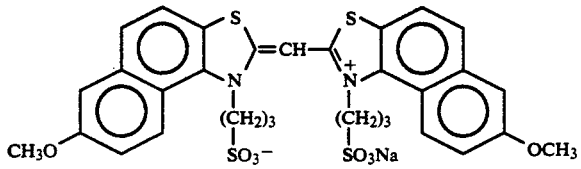

-continued
S-3
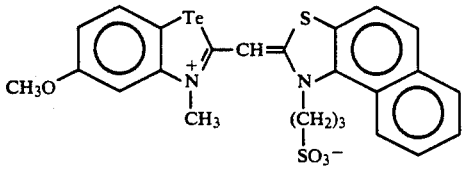
S-4
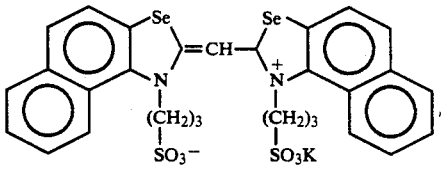
S-5
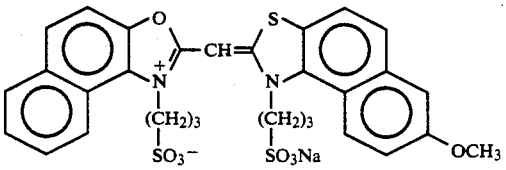
S-6
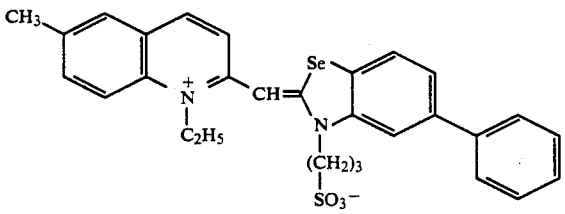
S-7
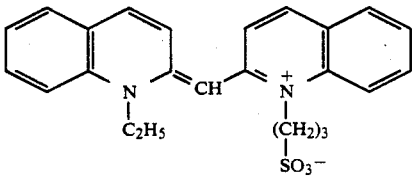
S-8
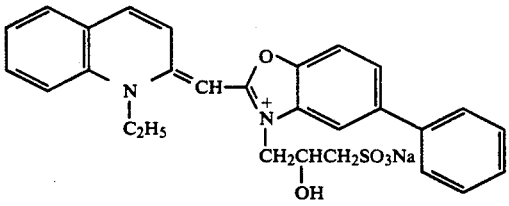
S-9
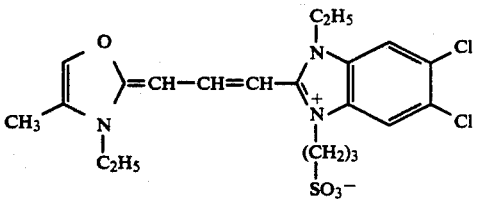
S-10
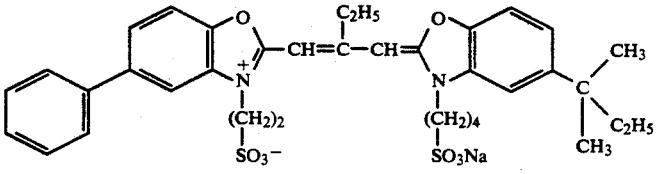

-continued
S-11
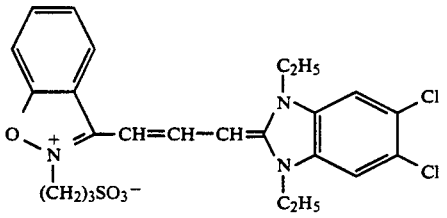
S-12
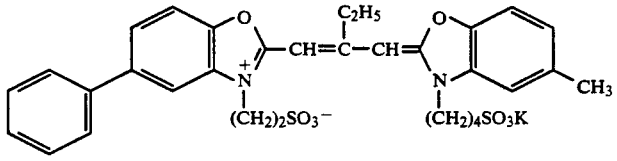
S-13
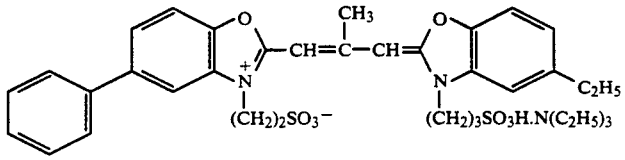
S-14
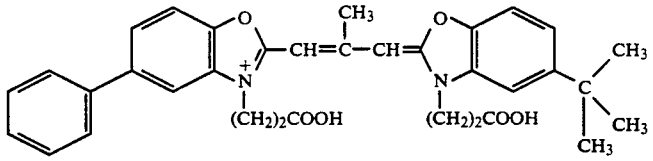
S-15
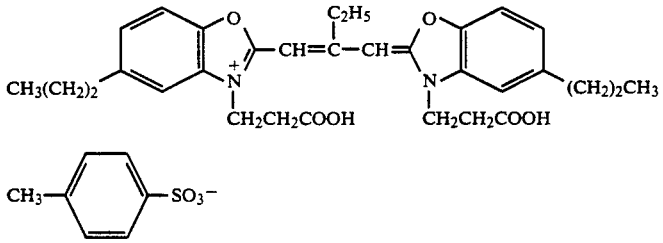
S-16
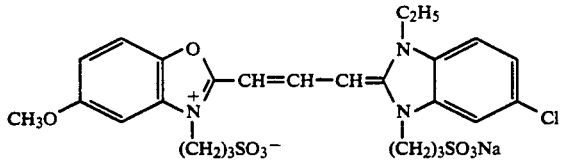
S-17
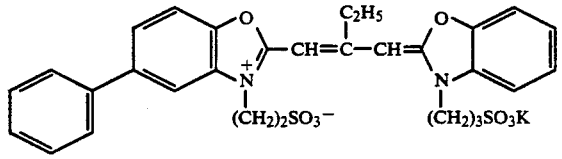
S-18
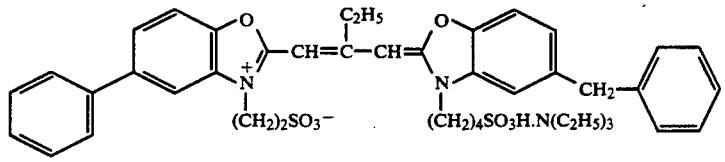

-continued
S-19
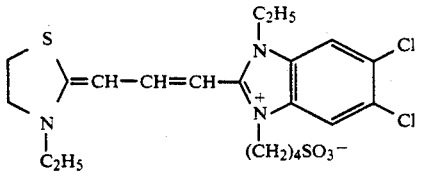
S-20
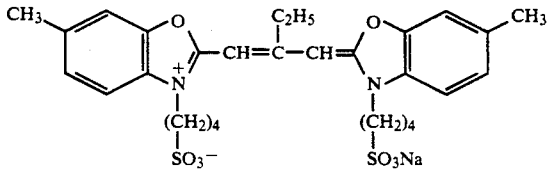
S-21
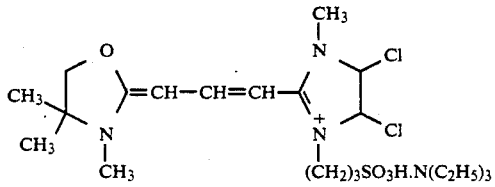
S-22
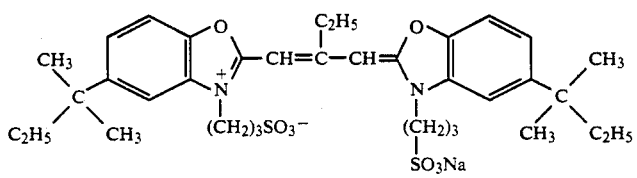
S-23
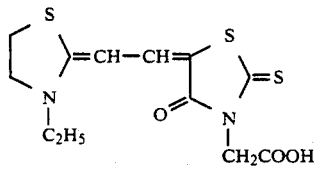
S-24
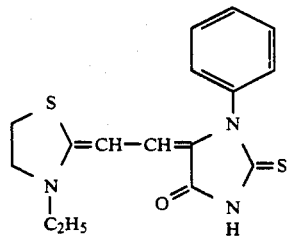
S-25
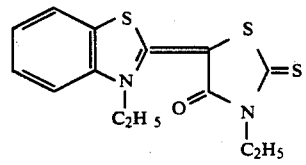
S-26
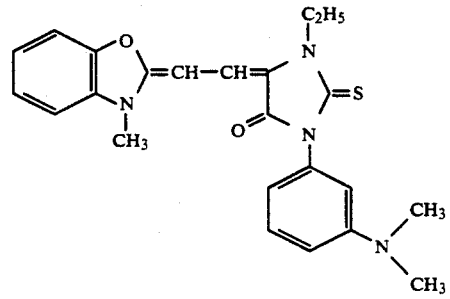

-continued
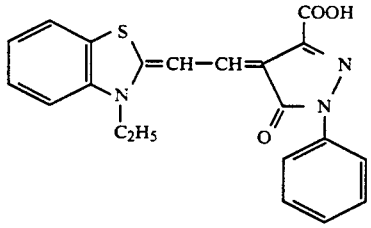
S-27
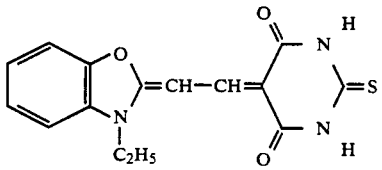
S-28
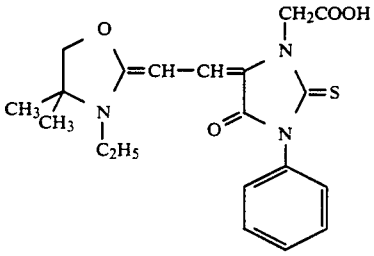
S-29
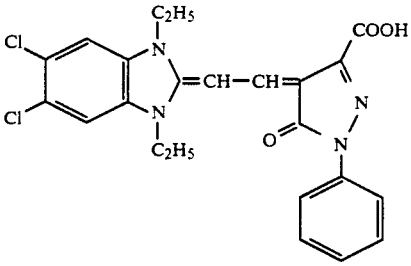
S-30
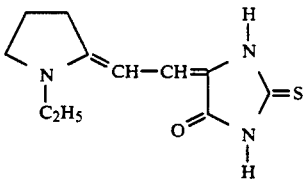
S-31
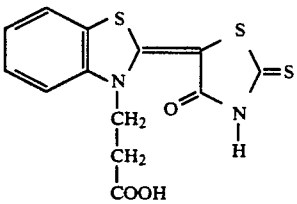
S-32
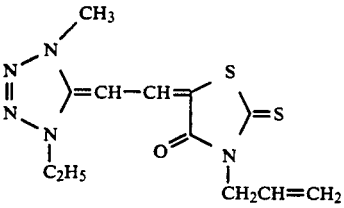
S-33

-continued
S-34
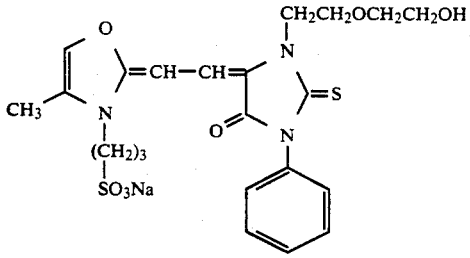
S-35
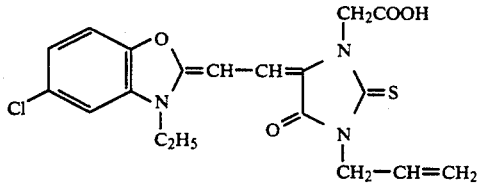
S-36
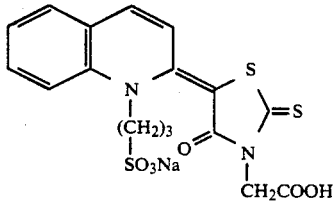
S-37
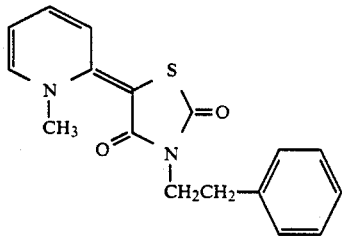
S-38
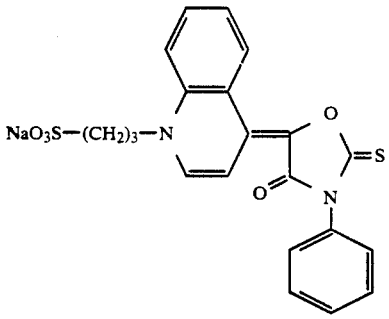
S-39
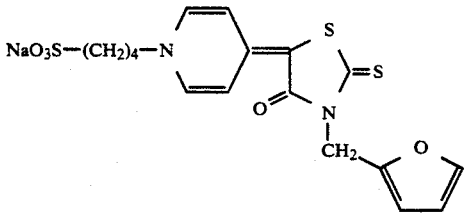
S-40
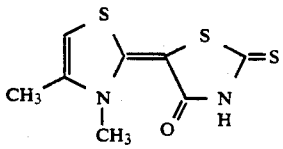

-continued
S-41
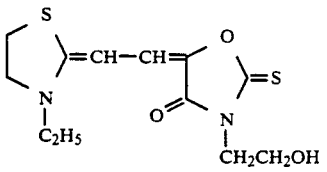
S-42
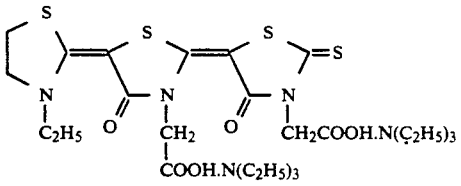
S-43
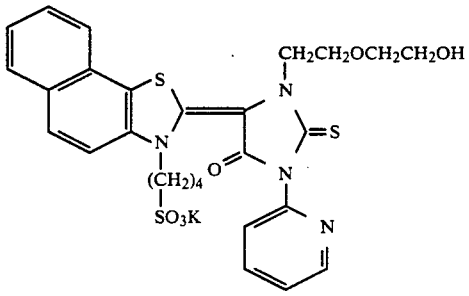
S-44
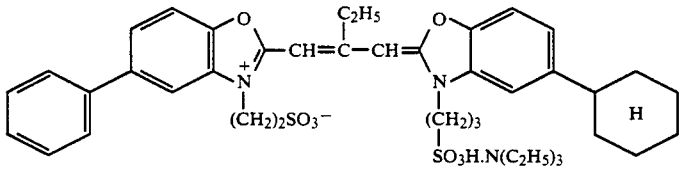
S-45
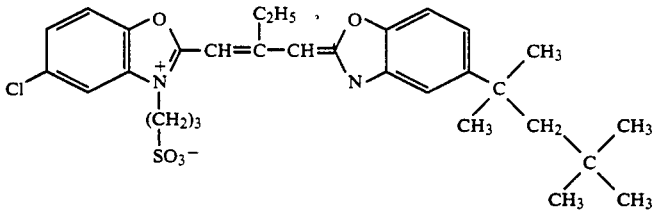
S-46
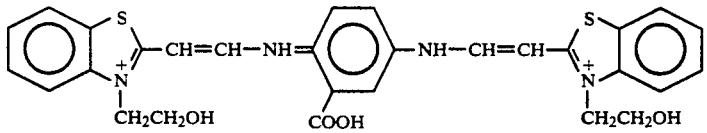
S-47
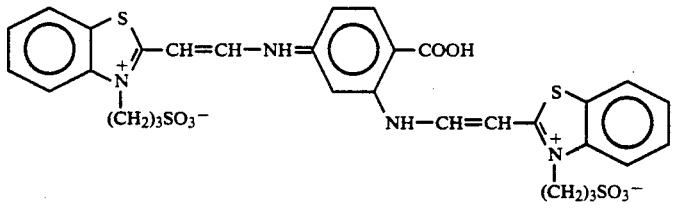
S-48
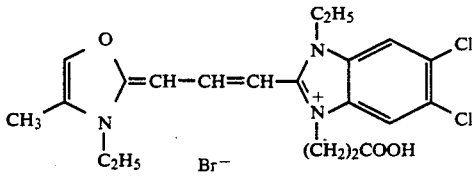

-continued
Red-Sensitive Silver Halide Emulsion Layers
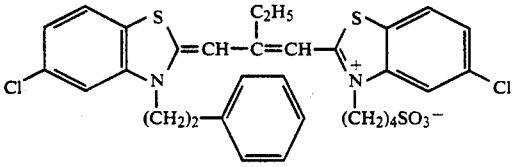
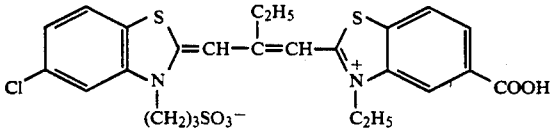
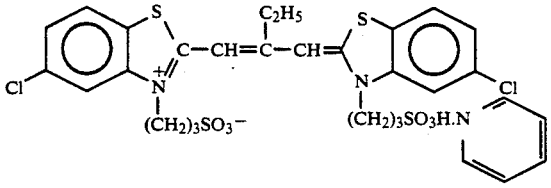
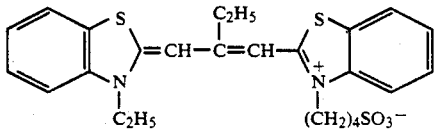
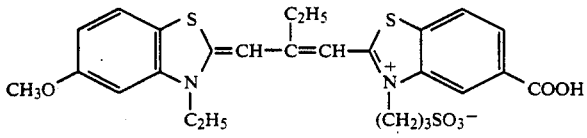
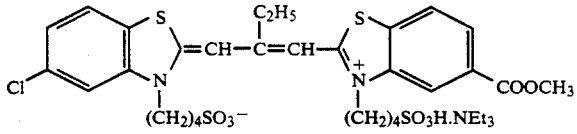
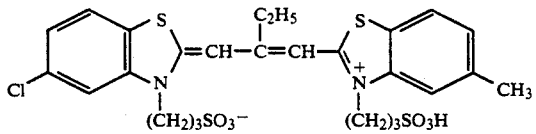
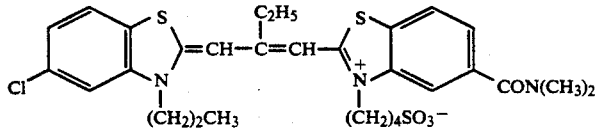
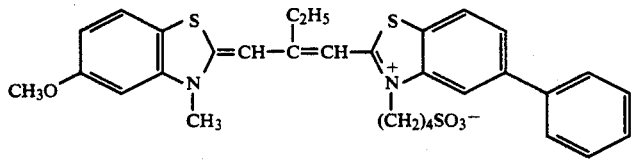
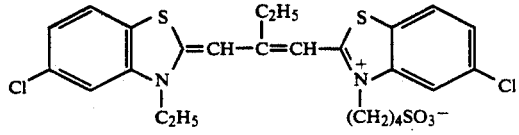

-continued
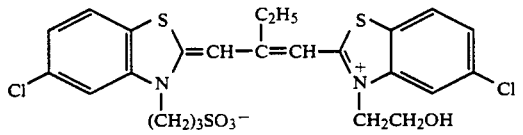
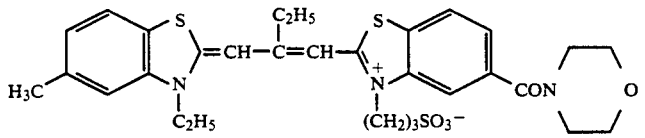
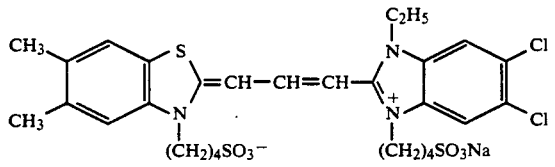
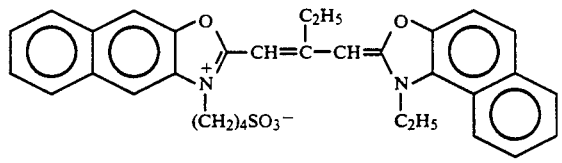
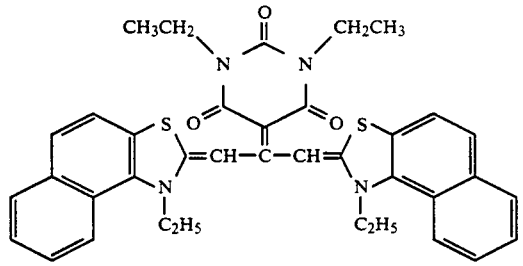
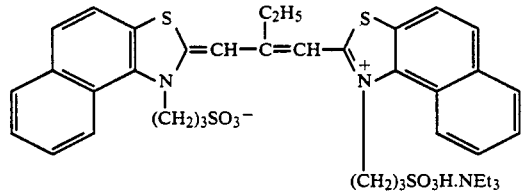
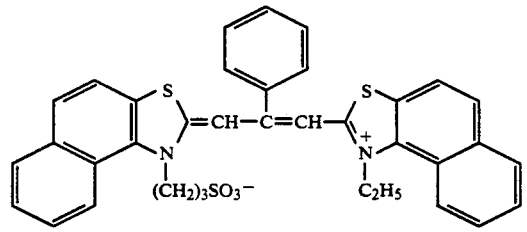
Furthermore, it is especially desirable that the sensitizing dyes represented by the general formula [P-1] to [P-5] set forth below are used individually or in combination with the aforementioned dyes in the red-sensitive silver halide emulsion layers of the present invention.

[P-I]

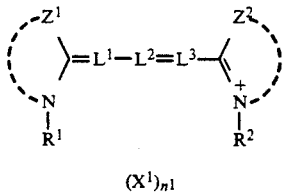

$(X^1)_{n1}$

In the above formula, $Z^1$ and $Z^2$ represent groups of atoms which are required to form nuclei derived from an oxazole, benzoxazole, naphthoxazole, imidazole, benzimidazole, naphthimidazole, thiazole, benzothiazole, naphthothiazole, selenazole, benzoselenazole or naphthoselenazole nucleus. $L^1$, $L^2$ and $L^3$ represent methine groups. $R^1$ and $R^2$ represent alkyl groups, and at least one of these groups is preferably an alkyl group which is substituted with a sulfo group or a carboxyl group. $X^1$ represents an anion, and $n^1$ represents the number of anions required to neutralize the electrical charge.

[P-II]

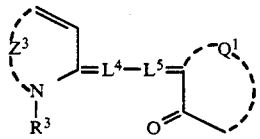

In the above formula, $Z^3$ represents a group of atoms which is required to form a nucleus derived from a pyridine or quinoline nucleus. $Q^1$ represents a group of atoms which is required to form a five or six membered ring which has an oxo group. $L^4$ and $L^5$ are the same as $L^1$, $L^2$ and $L^3$. At least one of the substituent groups included in $R^3$ and $Q^1$ preferably has a sulfo group or carboxyl group.

[P-III]

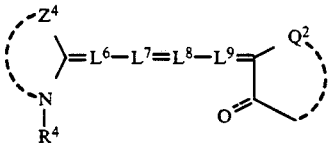

In the above formula, $Z^4$ represents a group of atoms which is required to form a nucleus derived from an oxazole, benzoxazole, thiazoline of selenazoline nucleus. $Q^2$ is the same as $Q^1$. $L^6$, $L^7$, $L^8$ and $L^9$ are the same as $L^1$, $L^2$ and $L^3$. $R^4$ is the same as $R^1$ or $R^2$. Moreover, at least one of the substituent groups included in $R^4$ and $Q^2$ preferably has a sulfo group or a carboxyl group.

[P-IV]

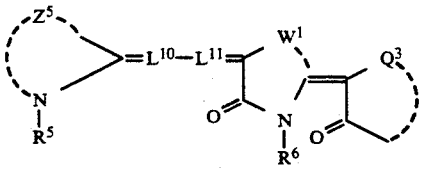

In the above formula, $Z^5$ represents a group of atoms which is required to form a nucleus derived from an oxazole or a benzoxazole nucleus. $W^1$ represents a group of atoms which is required to form a five or six membered ring. $Q^3$ is the same as $Q^1$. $L^{10}$ and $L^{11}$ are the same as $L^1$, $L^2$ and $L^3$. $R^5$ is the same as $R^1$ or $R^2$. $R^6$ represents a hydrogen atom, an alkyl group, an aryl group or a heterocyclic group. Moreover, at least one of the substituent groups included in $R^5$, $R^6$ and $Q^3$ preferably has a sulfo group or a carboxyl group.

From among these dyes, the cyanine dyes which can form so-called J-aggregates are preferred. Of those dyes, those which can be represented by the general formula [P-V] indicated below are preferred.

[P-V]

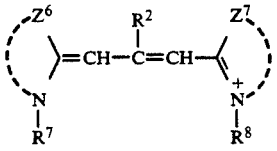

$(X^2)_{n2}$

In the above formula, $Z^6$ represents a group of atoms which is required to form a nucleus derived from a benzoxazole, naphthoxazole, benzimidazole or naphthimidazole nucleus, and $Z^7$ represents a group of atoms which is required to form a nucleus derived from a benzothiazole, naphthothiazole, benzoselenazole or naphthoselenazole nucleus. $R^7$ and $R^8$ are the same as $R^1$ and $R^2$, and at least one of these preferably has a sulfo group or a carboxyl group. $R^9$ represents a hydrogen atom, an ethyl group or a phenyl group. $X^2$ is the same as $X^1$, and $n^2$ is the same as $n^1$.

The above mentioned heterocyclic nuclei may be thiazole nuclei including thiazole nuclei such as thiazole, 4-methylthiazole, 4-phenylthiazole, 4,5 dimethylthiazole, and 4,5-diphenylthiazole, benzothiazole nuclei such as benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, and 4-phenylbenzothiazole, and naphthothiazole nuclei such as naphtho[2,1-d]thiazole, naphtho[1,2-d]thiazole, naphtho[2,3-d]thiazole, 5-methoxynaphtho[1,2-d]thiazole, 6-methoxynaphtho[1,2-d]thiazole, 7-ethoxynaphtho[2,1-d]thiazole, 8-methoxynaphtho[2,1-d]thiazole, and 5 methoxynaphtho[2,3-d]thiazole; thiazoline nuclei such as thiazoline, 4-methylthiazoline, and 4-nitrothiazoline; oxazole nuclei including oxazole nuclei such as oxazole, 4-methyloxazole, 4-nitrooxazole, 5-methyloxazole, 4-phenyloxazole, 4,5-diphenyloxazole, and 4-ethyloxazole, benzoxazole nuclei such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole, and naphthoxazole nuclei such as naphtho[2,1-d]oxazole, naphtho[1,2-d]oxazole, 5-methoxynaphtho[1,2-d]oxazole, naphtho[2,3-d]oxazole, and 5-nitronaphtho[2,1-d]oxazole; selenazole nuclei including selenazole nuclei such as 4-methylselenazole, 4-nitroselenazole, and 4-phenylselenazole, benzoselenazole nuclei such as benzoselenazole, 5-chlorobenzoselenazole, 5-nitrobenzoselenazole, 5-methylbenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and naphthoselenazole nuclei such as naphtho[2,1-d]selenazole and naphtho[1,2-d]selenazole; selenazoline nuclei such as selenazoline and 4 methylselenazoline; and imidazole nuclei including imidazol nuclei such as 1-alkylimidazole and 1-alkyl-4-phenylimidazole, benzimidazole nuclei such as 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1 l-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1 aryl-5,6-dichlorobenzimidazole, 1-aryl-5-methoxybenzimidazole, and 1-aryl-5-cyanobenzimidazole, and naphthimidazole nuclei such as 2-alkylnaphtho[1,2-d]imidazole, and 1-arylnaphtho[1,2-d]imidazole.

The alkyl groups represented by $R^1$, $R^2$, $R^3$, $R^4$, $R^5$, $R^6$, $R^7$ and $R^8$ can be unsubstituted alkyl groups which have not more than 18 carbon atoms such as methyl, ethyl, propyl, butyl, pentyl, octyl, decyl, dodecyl, and octadecyl; or substituted alkyl groups such as alkyl groups which have not more than 18 carbon atoms which have, as substituent groups, carboxyl groups, sulfo groups, cyano groups, halogen atoms (e.g., fluorine, chlorine, and bromine), hydroxyl groups, alkoxycarbonyl groups which have not more than 8 carbon atoms, (e.g., methoxycarbonyl, ethoxycarbonyl, phenoxycarbonyl, and benzyloxycarbonyl), alkoxy groups which have not more than 8 carbon atoms (e.g., methoxy, ethoxy, benzyloxy, and phenethyloxy), single ring aryloxy groups which have not more than 10 carbon atoms (e.g., phenoxy, p-tolyloxy), acyloxy groups which have not more than 3 carbon atoms (e.g., acetyloxy and propionyloxy), acyl groups which have not more than 8 carbon atoms (e.g., acetyl and propionyl, benzoyl, and mesyl), carbamoyl groups (e.g., carbamoyl, N,N-dimethylcarbamoyl, morpholinocarbonyl, and piperidinocarbonyl), sulfamoyl groups (e.g., sulfamoyl, N,N-dimethylsulfamoyl, morpholinosulfonyl, and piperidinosulfonyl) or aryl groups which have not more than 10 carbon atoms (e.g., phenyl, 4-chlorophenyl, 4-methylphenyl, and $\alpha$-naphthyl).

Examples of the rings formed by $Q^1$, $Q^2$ and $Q^3$ include 2-pyrazolin-5-one, pyrazolidin-3,5-dione, imidazolin-5-one, hydantoin, 2-, or 4-thiahydantoin, 2-imino-oxazolidin-4-one, 2-oxazolin-5-one, 2-thiooxazolin-2,4-dione, iso-oxazolin-5-one, 2-thiazolin-4-one, thiazolidin-4-one, thiazolidin-2,4-dione, rhodanine, thiazolidin-2,4-dione, iso-rhodanine, indan-1,3-dione, thiophen-3-one, thiophen-3-one-1,1-dioxide, indolin-2-one, indolin-3-one, indazolin-3-one, 2-oxoindazolium, 3-oxoindazolium, 5,7-dioxo-6,7-dihydrothiazolo[3,2-a]pyrimidine, cyclohexan-1,3-dione, 3,4-dihydroisoquinolin-4-one, 1,3-dioxan-4,6-dione, barbituric acid, 2-thiobarbituric acid, chroman-2,4-dione, indazolin-2-one and pyrido[1,2 a]pyrimidin-1,3-dione nuclei.

The heterocyclic rings formed by $W^1$ are rings in which oxo groups or thioxo groups in appropriate positions have been removed from rings among those described above of which the heterocyclic structure conforms.

The substituent groups which are bonded to the nitrogen atoms included in $Q^1$, $Q^2$ and $Q^3$, and $R^6$, are preferably hydrogen atoms, alkyl groups which have from 1 to 18, preferably from 1 to 7, and most desirably from 1 to 4, carbon atoms such as methyl, ethyl, propyl, isopropyl, butyl, iso-butyl, hexyl, octyl, dodecyl, and octadecyl; substituted alkyl groups such as aralkyl groups (e.g., benzyl and 2-phenylethyl), hydroxyalkyl groups (e.g., 2-hydroxyethyl and 3-hydroxypropyl), carboxyalkyl groups (e.g., 2-carboxyethyl, 3-carboxypropyl, 4-carboxybutyl, and carboxymethyl), alkoxyalkyl groups (e.g., 2-methoxyethyl and 2-(2-methoxyethoxy)ethyl), sulfoalkyl groups (e.g., 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), sulfatoalkyl groups (e.g., 3-sulfatopropyl, 4-sulfatobutyl), heterocyclic substituted alkyl groups (e.g., 2-(pyrrolidin-2-one-1-yl)ethyl, tetrahydrofurfuryl, and 2-morpholinoethyl), 2-acetoxyethyl, carbomethoxymethyl, and 2-methanesulfonylaminoethyl; allyl groups; aryl groups such as phenyl and 2-naphthyl; substituted aryl groups such as 4-carboxyphenyl, 4-sulfophenyl, 3-chlorophenyl, and 3-methylphenyl; or heterocyclic groups such as 2-pyridyl, 2-thiazolyl.

$L^1$, $L^2$, $L^3$, $L^4$, $L^5$, $L^6$, $L^7$, $L^8$, $L^9$, $L^{10}$ and $L^{11}$ represent methine groups which may be substituted with substituted or unsubstituted alkyl groups such as methyl and ethyl, substituted or unsubstituted aryl groups such as phenyl or halogen atoms such as chlorine and bromine. They may also form rings with other methine groups, or they may form rings with auxochromes.

Examples of the anions represented by $X^1$ and $X^2$ are shown below. For example, they may be halogen anions such as fluoride, chloride, bromide, and iodide, substituted arylsulfonate ions such as p-toluenesulfonate ion and p-chlorobenzenesulfonate ion, aryldisulfonate ions such as 1,3-benzenedisulfonate ione, 1,5-naphtahlenedisulfonate ion, and 2,6-naphthalenedisulfonate ion, alkylsulfate ions such as methylsulfate ion, sulfate ion, thiocyanate ion, perchlorate ion, tetrafluoroborate ion, picrate ion, acetate ion or trifluoromethanesulfonate ion. The iodide ion is preferred.

Actual examples of especially desirable dyes are indicated below.

P-1

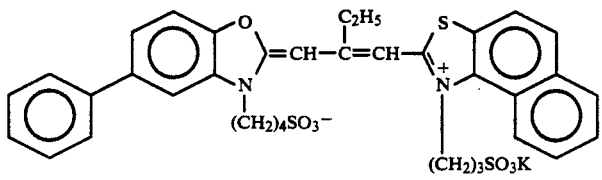

-continued
P-2
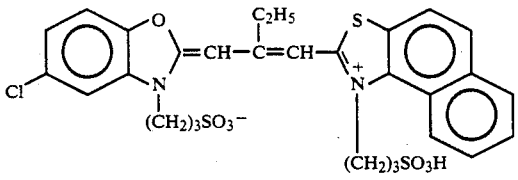
P-3
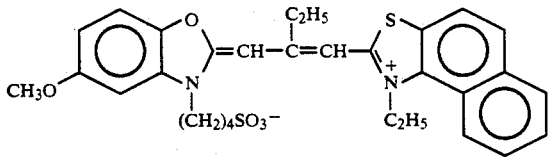
P-4
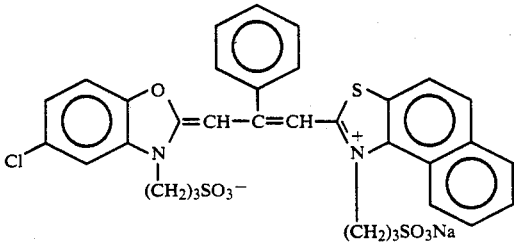
P-5
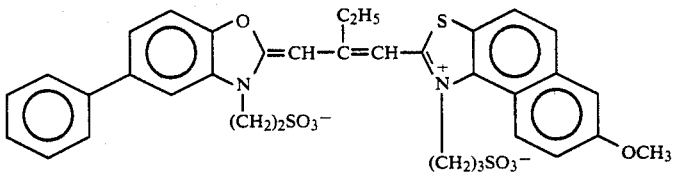
P-6
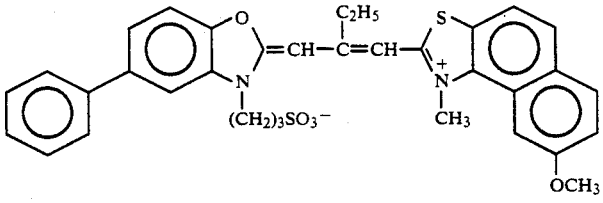
P-7
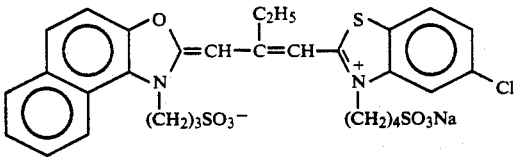
P-8
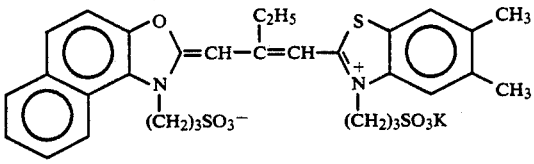
P-9
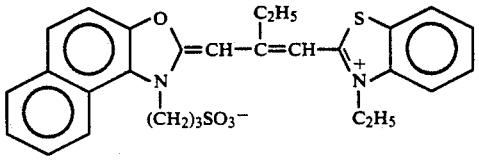

-continued
P-10
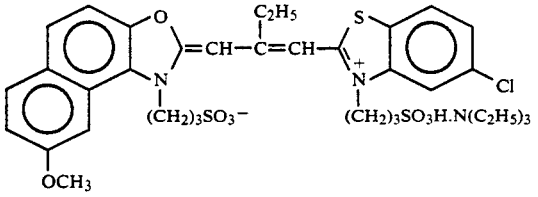
P-11
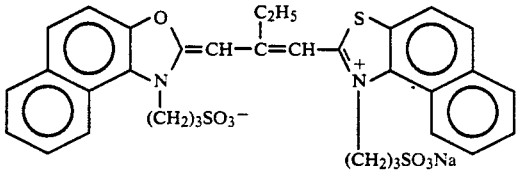
P-12
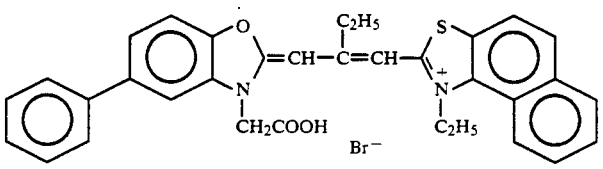
P-13
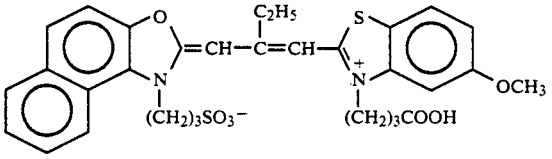
P-14
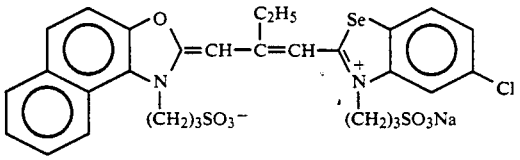
P-15
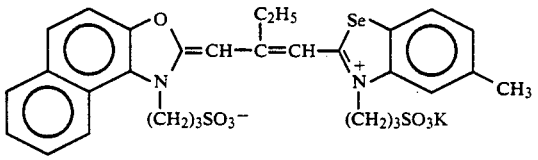
P-16
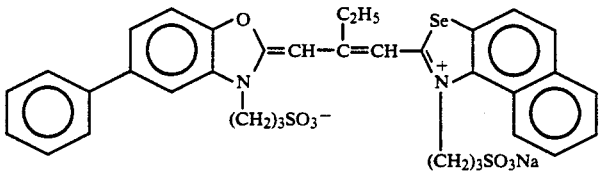
P-17
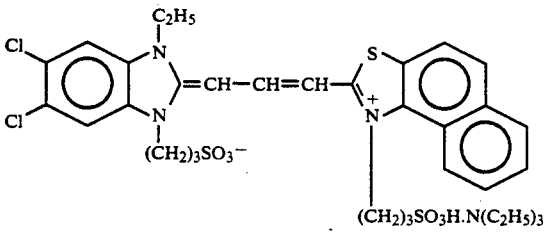

-continued

P-18

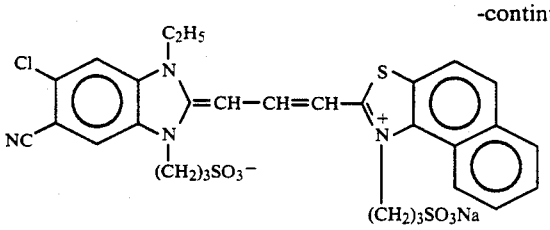

P-19

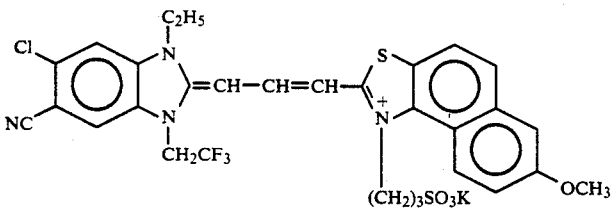

P-20

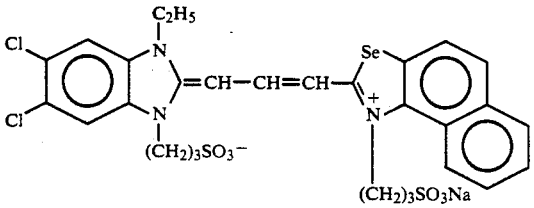

P-21

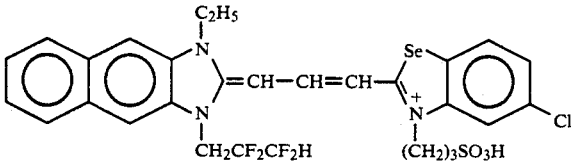

P-22

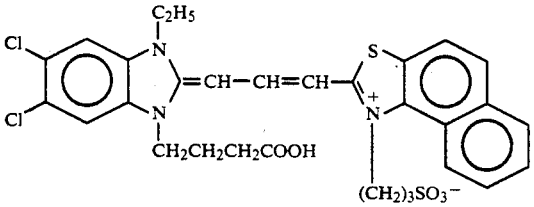

The emulsions used in the present invention can have a wide particle size distribution, but emulsions which have a narrow particle size distribution are preferred. In the case of regular crystalline grains in particular, monodisperse emulsions in which the size of the grains which account for 90% of the whole of the emulsion in terms of the weight of the silver halide grains or the number of grains is within the average grain size ±40%, and preferably ±30% can also be used.

The use of twinned crystal grains is also desirable. Emulsions in which tabular grains which have at least two parallel twinned planes account for at least 30%, preferably at least 50%, and most desirably at least 70%, of the projected area, are preferred.

Emulsions with a definite layer-like structure, which can be used in the present invention, can be prepared by selecting and combining the various methods known in the field.

For example, acidic methods, neutral methods and ammonia methods, can be used to prepare the core grains. The method used for the reaction between the soluble silver salt and the soluble halides can be selected, for example, from among single jet methods and double jet methods, and combinations of these methods.

The controlled double jet method, a method in which the pAg value in the liquid phase in which the silver halide is being formed is held constant, can be used as one type of double jet methods. The triple jet method in which soluble halides of different composition are added independently (for example with the addition of a soluble silver salt, a soluble bromide and a soluble iodide) can also be used as a type of double jet methods. Silver halide solvents, such as ammonia, thiocyanates, thioureas, thioethers and amines can be selected and used during core preparation. The grain size distribution of the core grains in the emulsion is preferably narrow. Monodisperse core grain emulsions are especially desirable. Emulsions in which the halogen composition, and especially the iodide content, of the individual grains is uniform, are preferred.

Whether or not the halogen composition of the individual grains is uniform can be determined using X-ray diffraction procedures and the EPMA method. The diffraction width in X-ray diffraction becomes narrower and a peak is obtained as the halogen composition of the core grains becomes more uniform.

After the seed crystals of silver iodobromide which have a high silver iodide concentration have been formed, uniform silver iodobromide grains can be grown using the method in which the rates of addition are accelerated with the passage of time. This method is disclosed by Irie and Suzuki in JP-B-48-36890. Alternatively, the method in which the concentration of the solutions being added is increased can be used. This method is disclosed by Saito in U.S. Pat. No. 4,242,445. (The term "JP-B" as used herein signifies an "examined Japanese patent publication"). These methods give particularly preferable results. The method of Irie et al. is such that, in a method in which poorly soluble inorganic crystals for photographic purposes are prepared by means of a double decomposition reaction which is carried out by adding at least two aqueous solutions of inorganic salts simultaneously in essentially equal aliquots in the presence of a protective colloid, the aqueous inorganic salt solutions which are to be reacted are added at a rate of addition Q which is above a fixed rate of addition and below a rate of addition which is proportional to the total surface area of the poorly soluble inorganic salt crystals during growth, which is to say that the addition is made at a rate above $Q=\gamma$ and below $Q=\alpha t^2+\beta t+\gamma$.

On the other hand, the Saito method is such that, in a method of preparing silver halide crystals in which at least two aqueous inorganic salt solutions are added simultaneously in the presence of a protective colloid, the concentrations of the aqueous inorganic salt solutions which are being reacted are increased during crystal growth to an extent such that virtually no new crystal nuclei are formed. In the preparation of silver halide grains which have a distinct layer like structure of this invention, the shells may be attached to the core grains in the state in which they have been formed, but the shells are preferably attached after washing the core emulsion with water for desalting purposes.

Shell attachment can also be carried out using the various methods known in the field, but the double jet methods are preferred. The aforementioned methods of Irie et al. and Saito are especially desirable for the preparation of emulsions which have a distinct layer-like structure.

In the case of a fine grain emulsion, known means can be employed to prepare grains which have a distinct layer-like structure, but these means are inadequate for achieving a high degree of layer-like structure perfection. First of all, the halogen composition of the high iodide layer must be determined very carefully. Silver iodide and silver bromide have different thermodynamically stable crystal structures and it is known that mixed crystals cannot be made with all composition ratios. The mixed crystal composition ratio is dependent on the temperature during grain preparation, and it must be selected optimally within the range from 15 to 45 mol %. The stable mixed crystal composition ratio depends on the surroundings, but it is believed to fall within the range of 30 to 45 mol %. The selection of conditions such as temperature, pH, pAg and agitation is, of course, of importance when growing a low iodide layer on the outside of a high iodide layer, but selection of the amount of protective colloid when growing the low iodide layer and the use of some means for growing the low iodide phase in the presence of compounds which are adsorbed on the surface of the silver halide grains (e.g., spectrally sensitizing dyes, antifoggants and stabilizers), are also desirable. Furthermore, methods in which fine grained silver halides are added rather than water soluble silver salts and water soluble alkali metal halides are also effective when growing a layer which has a low iodide content.

As mentioned earlier, in those cases in which the silver halide grains preferably used in the present invention have a distinct layer structure, there are essentially at least two regions which have different halogen compositions present in the grains. The inside part of the grain is described as the core and the surface is described as the shell.

Having essentially two regions infers that a third region may be present as well as the core and the shell. For example, there may be layer between the central core part and the outermost layer of the shell.

However, when the X-ray diffraction pattern is obtained in the way described above when such a third region is present, the third region may exist in such a range that it has essentially no effect on the form of the two peaks, i.e., the two peaks corresponding to the high iodide part and the low iodide part.

Therefore, the silver halide grains are grains which have essentially a double distinct layer-like structure even in those cases where a high iodide core part, an intermediate part and a low iodide shell part are present where there are two peaks in the X-ray diffraction pattern with a single minimum part between the two peaks, where the diffraction intensity corresponding to the high iodide part is from 1/10 to 3/1, preferably from 1/5 to 3/1, and most desirably from ⅓ to 3/1 with respect to the intensity of the low iodide parts, and where the minimum part is not more than 90%, preferably not more than 80%, and most desirably not more than 70% of the smaller of the two peaks.

The same is true in those cases where a third region is present within the core part.

Silver halides can be joined with silver halides which have different compositions with an epitaxial junction in the emulsions which are preferably used in this present invention, and they can be joined with compounds other than silver halides, such as silver thiocyanate or lead oxide.

Mixtures of grains of various crystalline forms can also be used.

The silver halide emulsions which can be used will normally be subjected to physical ripening, chemical ripening and spectral sensitization. Additives which can be used in such processes have been disclosed in *Research Disclosure* No. 17643 and ibid No. 18716, and the general locations in these documents are summarized in the table below.

Known photographically useful additives which can be used in this present invention are also disclosed in the two *Research Disclosures* referred to above, and the general locations in these documents are also indicated in the table below.

| Type of Additives | RD 17643 | RD 18716 |
|---|---|---|
| 1. Chemical Sensitizer | Page 23 | Page 648, right column |
| 2. Sensitivity Increaser | | Page 648, right column |
| 3. Spectral Sensitizing Agent, Supersensitizing Agent | Pages 23 to 24 | Page 648, right column to page 649, right column |
| 4. Brightener | Page 24 | |
| 5. Antifogging Agent and Stabilizer | Pages 24 to 25 | Page 649, right column |
| 6. Light-Absorber, Filter Dye and UV Light Absorber | Pages 25 to 26 | Page 649, right column to page 650, left column |
| 7. Antistaining Agent | Page 25, right column | Page 650, left column to right column |

-continued

| Type of Additives | RD 17643 | RD 18716 |
|---|---|---|
| 8. Dye Image Stabilizer | Page 25 | |
| 9. Hardening Agent | Page 26 | Page 651, left column |
| 10. Binder | Page 26 | Page 651, left column |
| 11. Plasticizer, Lubricant | Page 27 | Page 650, right column |
| 12. Coating Aid, Surfactant | Pages 26 to 27 | Page 650, right column |
| 13. Antistatic Agent | Page 27 | Page 650, right column |

The inclusion of so-called two-equivalent couplers in the emulsion containing layers is preferred in the present invention.

The use of compounds which release diffusible development inhibitors or precursors thereof by means of a coupling reaction with the oxidation product of a developing agent is especially desirable.

The above mentioned compounds can be represented by the general formula [I] indicated below.

$$A—(LINK)_n—B \quad [I]$$

In the above formula, A represents a coupler residual group from which $(LINK)_n$—B is eliminated by means of a coupling reaction with the oxidation product of a primary aromatic amine developing agent; LINK represents a group which is bound to the coupling active position of A and which can eliminate B after elimination from A by the coupling reaction; B represents a group represented by general formula [IIa], [IIb], [IIc], [IId], [IIe], [IIf], [IIg], [IIh], [IIi], [IIj], [IIk], [IIl], [IIm], [IIn], [IIo] or [IIp] indicated below; and n is 0 or an integer of value 1. Moreover, B is bonded directly to A when n is 0.

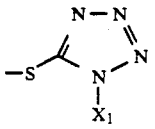
Formula (IIa)

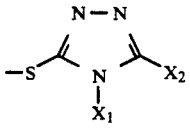
Formula (IIb)

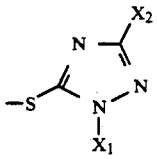
Formula (IIc)

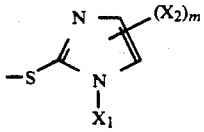
Formula (IId)

-continued

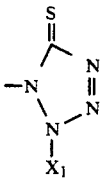
Formula (IIe)

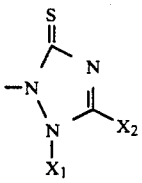
Formula (IIf)

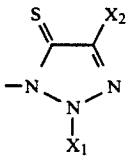
Formula (IIg)

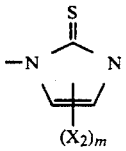
Formula (IIh)

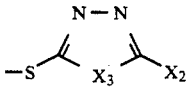
Formula (IIi)

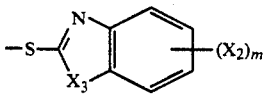
Formula (IIj)

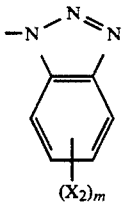
Formula (IIk)

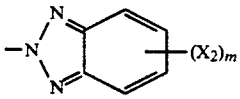
Formula (IIl)

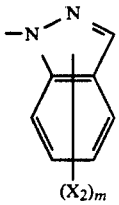
Formula (IIm)

-continued

Formula (IIn)

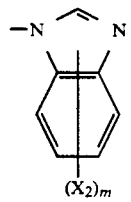

Formula (IIo)

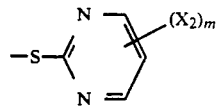

Formula (IIp)

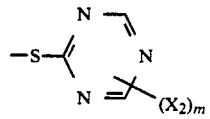

In the above formulae, $X_1$ represents a substituted or unsubstituted aliphatic group which has from 1 to 4 carbon atoms wherein the substituent groups can be selected from among the alkoxy groups, alkoxycarbonyl groups, hydroxyl group, acylamino groups, carbamoyl groups, sulfonyl groups, sulfonamido groups, sulfamoyl groups, amino groups, acyloxy groups, cyano group, ureido groups, acyl groups, halogen atoms and alkylthio groups and the number of carbon atoms included in these substituent groups is not more than 3; or $X_1$ can be a substituted phenyl groups wherein the substituent groups can be selected from among hydroxyl group, the alkoxycarbonyl groups, acylamino groups, carbamoyl groups, sulfonyl groups, sulfonamido groups, sulfamoyl groups, acyloxy groups, ureido groups, carboxyl group, cyano group, nitro group, amino group and acyl groups, and the number of carbon atoms in these substituent groups is not more than 3. $X_2$ represents a hydrogen atom, an aliphatic group, a halogen atom, a hydroxyl group, an alkoxy group, an alkylthio group, an alkoxycarbonyl group, an acylamino group, a carbamoyl group, a sulfonyl group, a sulfonamido group, a sulfamoyl group, an acyloxy group, a ureido group, a cyano group, a nitro group, an amino group, an alkoxycarbonylamino group, an aryloxycarbonyl group or an acyl group. $X_3$ represents an oxygen atom, a sulfur atom or an imino group which has not more than 4 carbon atoms, and m represents an integer of value 1 or 2. However, the total number of carbon atoms included in the m individual $X_2$ groups is not more than 8 and, when m is 2, the two $X_2$ groups may be the same or different.

In the compounds which can be represented by general formula [I], the coupler residual groups represented by A include coupler residual groups which form dyes (e.g., yellow, magenta, and cyan dyes) on undergoing a coupling reaction with the oxidation product of a primary aromatic amine developing agent, and coupler residual groups which provide coupling reaction products having essentially no absorbance in the visible region of the spectrum.

Yellow image forming coupler residual groups represented by A include pivaloylacetanilide, benzoylacetanilide, malonic diester, malonic diamide, dibenzoylmethane, benzothiazolylacetamide, malonic ester monoamide, benzothiazolyl acetate, benzoxazolylacetamide, benzoxazolyl acetate, benzimidazolylacetamide and benzimidazolyl acetate based coupler residual groups; the coupler residual groups derived from heterocyclic substituted acetamides or heterocyclic substituted acetates such as those disclosed in U.S. Pat. No. 3,841,880; the coupler residual groups derived from acylacetamides such as those disclosed in U.S. Pat. No. 3,770,446, British Patent 1,459,171, West German Patent Application (OLS) No. 2,503,099, JP-B-50-139738 and *Research Disclosure* 15737; and the heterocyclic couplers residual groups such as those disclosed in U.S. Pat. No. 4,046,574.

Coupler residual groups which have a .5-oxo-2-pyrazoline nucleus, a pyrazolo[1,5 a]benzimidazole nucleus, a pyrazoloimidazole nucleus, a pyrazolotriazole nucleus, or a pyrazolotetrazole nucleus, or cyanoacetophenone based coupler residual groups, are preferred as magenta image forming coupler residual groups represented by A.

Coupler residual groups which have a phenol nucleus or an $\alpha$-naphthol nucleus are preferred as cyan image forming coupler residual groups represented by A.

Moreover, couplers which essentially do not form a dye after coupling with the oxidation product of the developing agent and release a development inhibitor are effective as DIR couplers. Coupler residual groups of this type which can be represented by A include those disclosed in U.S. Pat. Nos. 4,052,213, 4,088,491, 3,632,345, 3,958,993 and 3,961,959. Moreover, A may also be the coupler residual groups of a polymerized coupler such as those disclosed in U.S. Pat. Nos. 3,451,820, 4,080,211 and 4,367,282, and British Patent 2,102,173.

Preferred examples for the group LINK in general formula [I] include:

(1) Groups in which use is made of a hemiacetal cleavage reaction. Examples include the groups represented by the general formula indicated below, disclosed in U.S. Pat. No. 4,146,396 and Japanese Patent Application Nos. 59-106223, 59-106224 and 59-75475 (corresponding to JP-A-60-249148, JP-A-60-249149 and JP-A-60-218645, respectively).

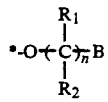

In the above formula, * indicates the position at which the group is bonded to the coupling position of A, $R_1$ and $R_2$ represent hydrogen atoms or substituent groups, n represents 1 or 2, and when n is 2 the two $R_1$, $R_2$ groups may each be the same or different, and any two of the groups $R_1$, $R_2$, may form a ring structure. B represents a group as defined in connection with general formula [I].

(2) Groups in which a cleavage reaction can occur by an intramolecular nucleophilic substitution reaction. Examples include the timing groups disclosed in U.S. Pat. No. 4,248,962.

(3) Groups in which a cleavage reaction occurs on the basis of an electron transfer reaction along a conjugated system. Examples include the groups disclosed in U.S. Pat. No. 4,409,232 and groups which can be represented by the general formula indicated below (i.e., the groups disclosed in British Patent 2,096,783A).

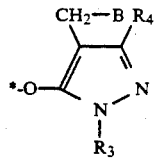

In the above formula, * indicates the position at which the group is bonded to the coupling position of A, $R_3$ and $R_4$ represent hydrogen atoms or substituent groups, and B represents a group as defined in connection with general formula [I]. Examples of $R_3$ include alkyl groups which have from 1 to 24 carbon atoms (e.g., methyl, ethyl, benzyl, and dodecyl), and aryl groups which have from 6 to 24 carbon atoms (e.g., phenyl, 4-tetradecyloxyphenyl, 4-methoxyphenyl, 2,4,6-trichlorophenyl, 4-nitrophenyl, 4-chlorophenyl, 2,5-dichlorophenyl, 4-carboxyphenyl, and p-tolyl). Examples of $R_4$ include hydrogen atom, alkyl groups which have from 1 to 24 carbon atoms (e.g., methyl, ethyl, undecyl, and pentadeyl), aryl groups which have from 6 to 36 carbon atoms (e.g., phenyl and 4-methoxyphenyl), cyano group, alkoxy groups which have from 1 to 24 carbon atoms (e.g., methoxy, ethoxy, and dodecyloxy), amino groups which have from 0 to 36 carbon atoms (e.g., amino, dimethylimino, piperidino, dihexylamino, and anilino), carbonamido groups which have from 1 to 24 carbon atoms (e.g., acetamido, benzamido, and tetradecanamido), sulfonamido groups which have from 1 to 24 carbon atoms (e.g., methylsulfonamido and phenylsulfonamido), carboxyl group, alkoxycarbonyl groups which have from 2 to 24 carbon atoms (e.g., methoxycarbonyl, ethoxycarbonyl, and dodecyloxycarbonyl), and carbamoyl groups which have from 1 to 24 carbon atoms (e.g., carbamoyl, dimethylcarbamoyl, and pyrrolidinocarbonyl).

Examples of the substituent groups $X_1$, $X_2$ and $X_3$ on the groups represented by the general formula [IIa] to [IIp] are indicated below.

Examples of $X_1$ include the methyl, ethyl, propyl, butyl, methoxyethyl, ethoxyethyl, isobutyl, allyl, dimethylaminoethyl, propargyl, chloroethyl, methoxycarbonylmethyl, ethylthioethyl, 4-hydroxyphenyl, 3-hydroxyphenyl, 4-sulfamoylphenyl, 3-sulfamoylphenyl, 4-carbamoylphenyl, 3-carbamoylphenyl, 4-dimethylaminophenyl, 3-acetamidophenyl, 4-propanamido, 4-methoxyphenyl, 2-hydroxyphenyl, 2,5-dihydroxyphenyl, 3-methoxycarbonylaminophenyl, 3-(3-methylureido)phenyl, 3-(3-ethylureido)phenyl, 4-hydroxyethoxyphenyl and 3-acetamido-4-methoxyphenyl groups. Examples of $X_2$ include the hydrogen atom, methyl, ethyl, benzyl, n-propyl, i- propyl, n-butyl, i butyl and cyclohexyl groups, fluorine, chlorine, bromine and iodine atoms, and hydroxymethyl, hydroxyethyl, hydroxyl, methoxy, ethoxy, butoxy, allyloxy, benzyloxy, methylthio, ethylthio, methoxycarbonyl, ethoxycarbonyl, acetamido, propanamido, butanamido, octanamido, benzamido, dimethylcarbamoyl, methylsulfonyl, methylsulfonamido, phenylsulfonamido, dimethylsulfamoyl, acetoxy, ureido, 3-methylureido, cyano, nitro, amino, 1 methyl-2-benzthiazolylideneamino, dimethylamino, methoxycarbonylamino, ethoxycarbonylamino, phenoxycarbonyl, methoxyethyl and acetyl groups. Examples of $X_3$ include the oxygen and sulfur atoms, and imino, methylimino, ethylimino, propylimino and allylimino groups.

Of those groups represented by general formulae [IIa] to [IIp], the groups represented by the general formulae [IIa], [IIb], [IIi], [IIj], [IIk] or [IIl] are preferred, and the groups represented by the general formulae [IIa], [IIi], [IIj] and [IIk] are especially desirable.

Actual examples of groups which can be represented by B in general formula [I] are indicated below.

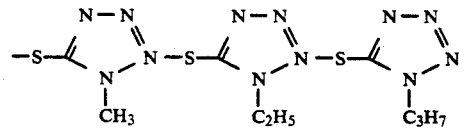

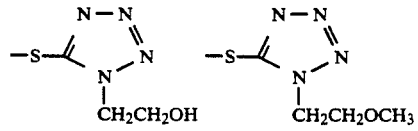

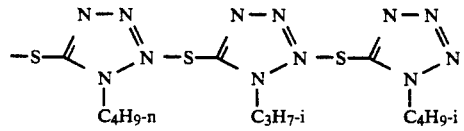

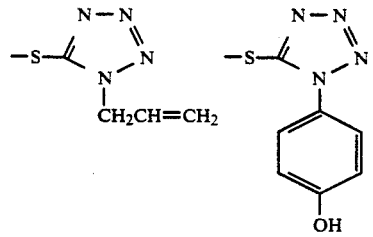

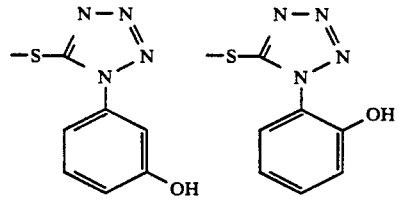

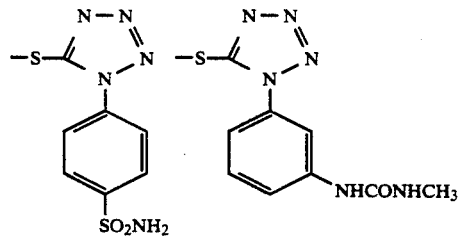

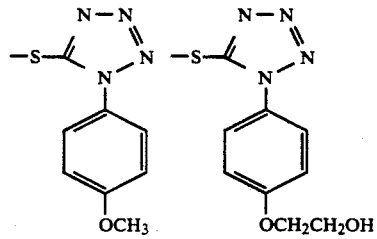

-continued
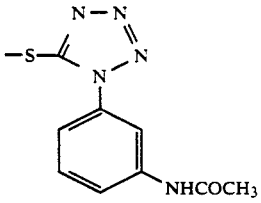
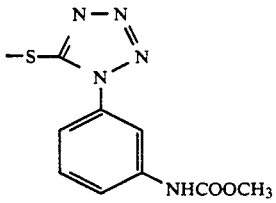
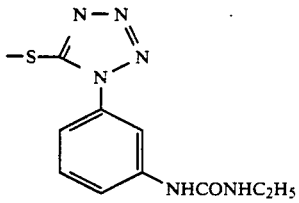
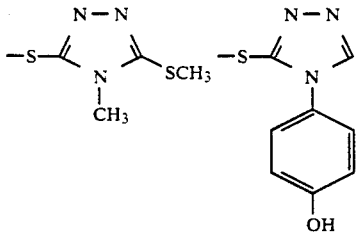
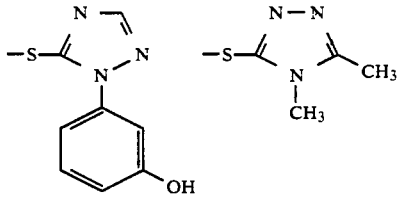
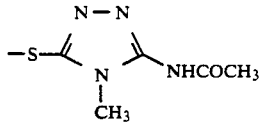
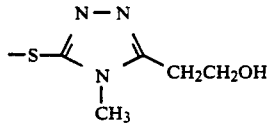
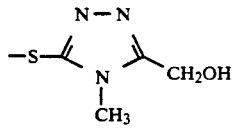
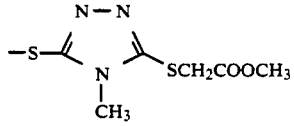
-continued
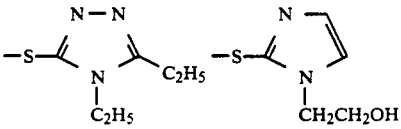
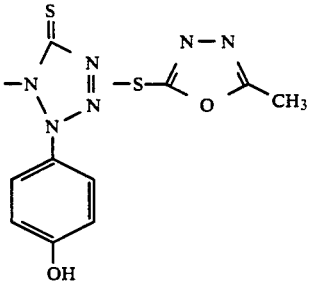
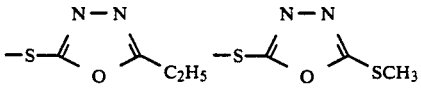
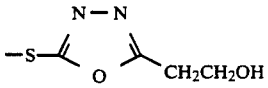
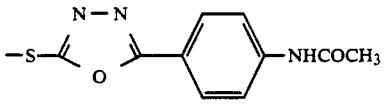
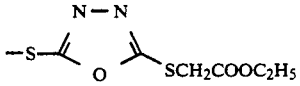
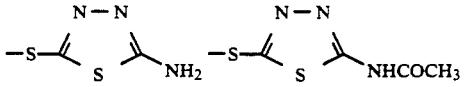
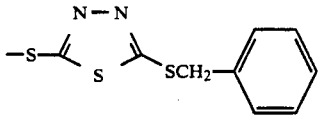
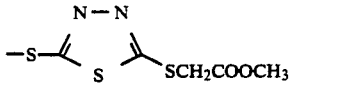
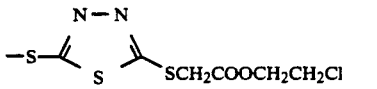
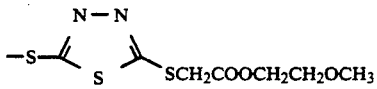
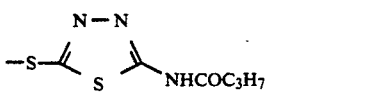
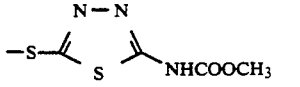

-continued
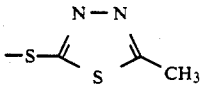
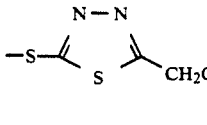
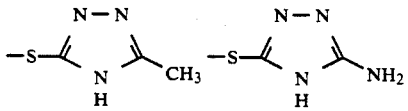
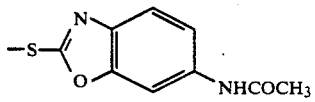
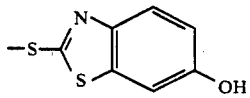
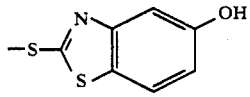
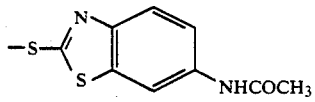
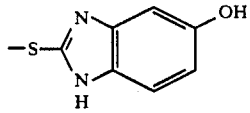
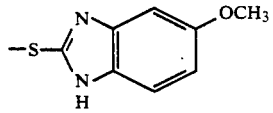
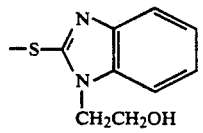
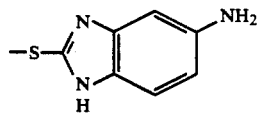
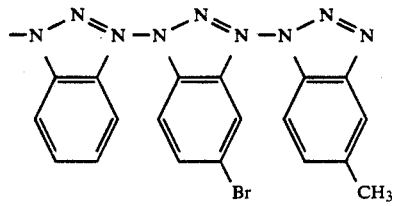
-continued
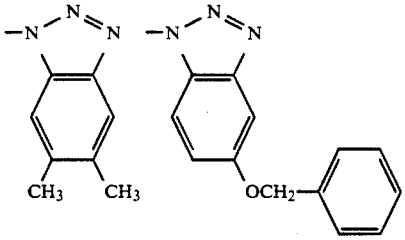
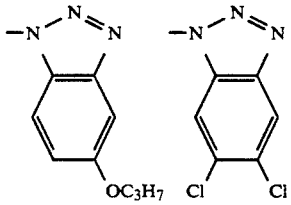
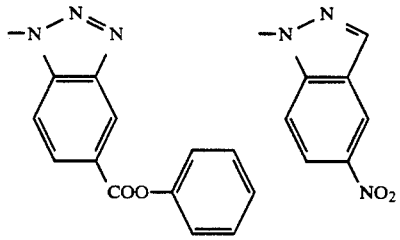
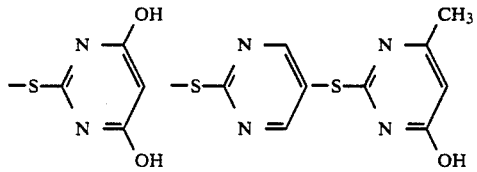
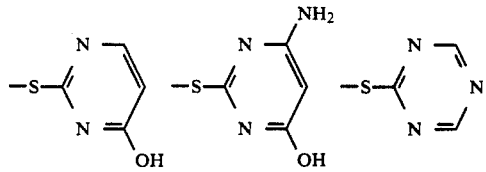
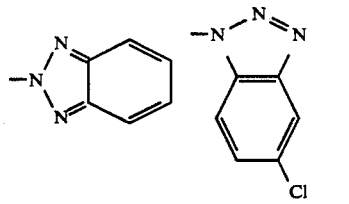
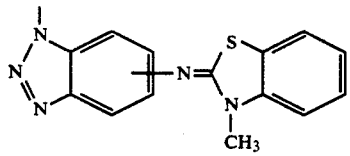
Actual examples of couplers useful in the present invention are indicated below, but the invention is not limited by these examples.

(D-1)
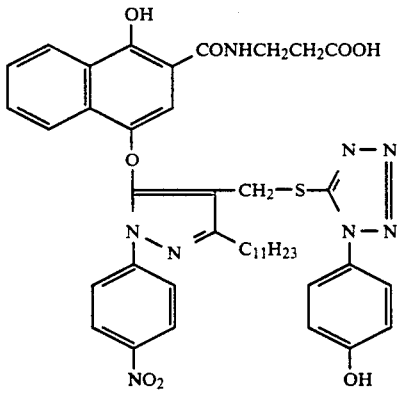
(D-2)
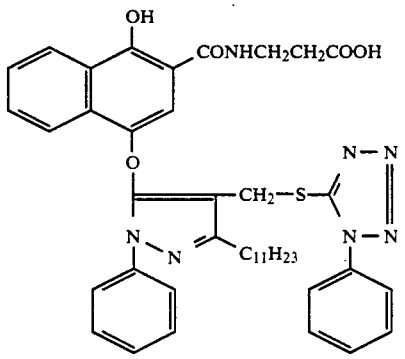
(D-3)
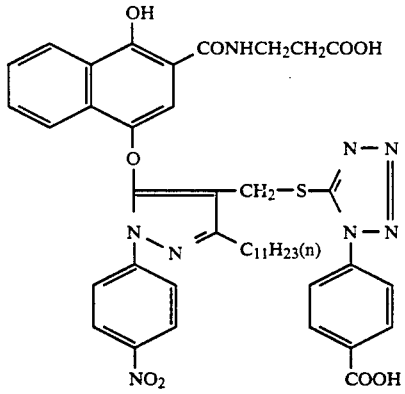
(D-4)
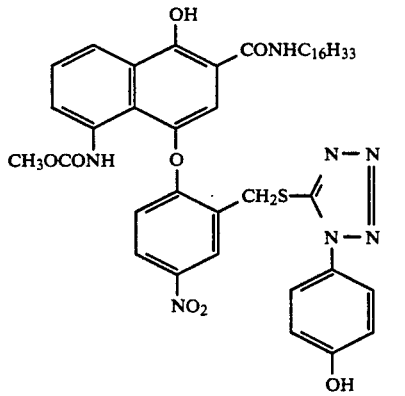

-continued
(D-5)
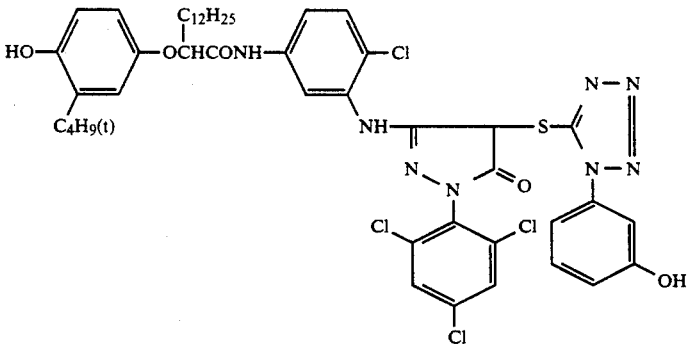
(D-6)
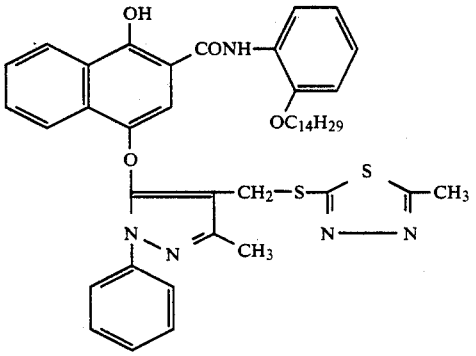
(D-7)
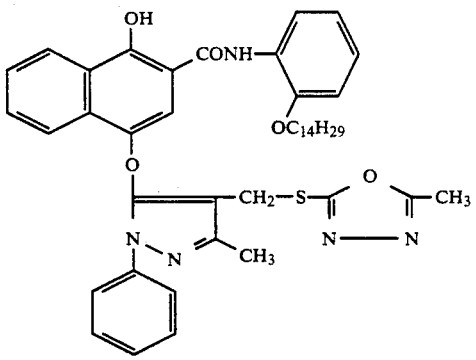
(D-8)
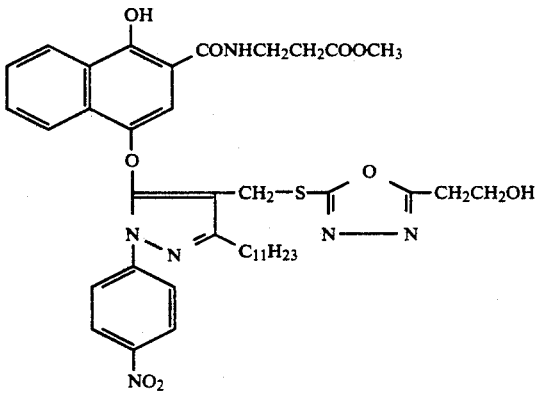

-continued
(D-9)
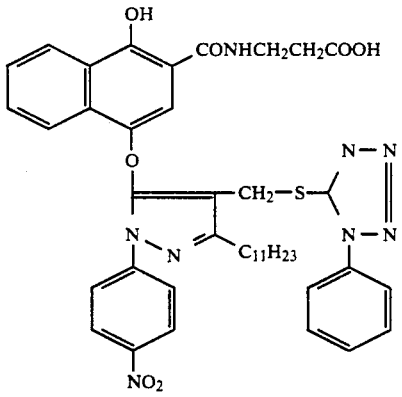
(D-10)
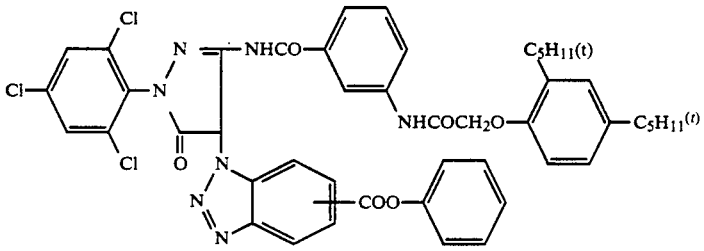
(D-11)
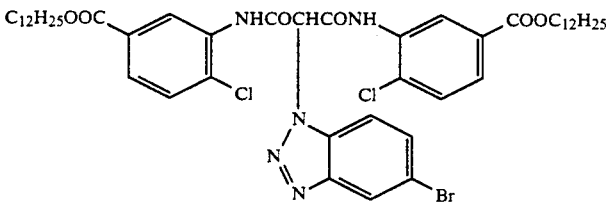
(D-12)
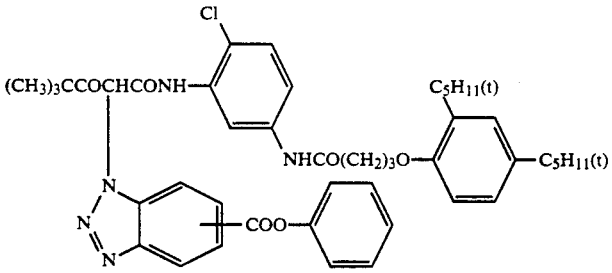
(D-13)
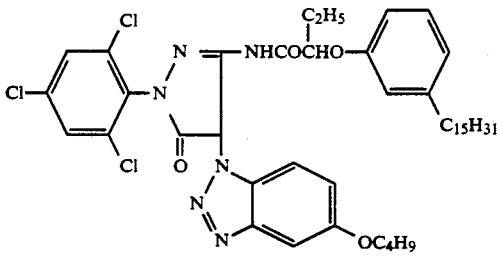
(D-14)
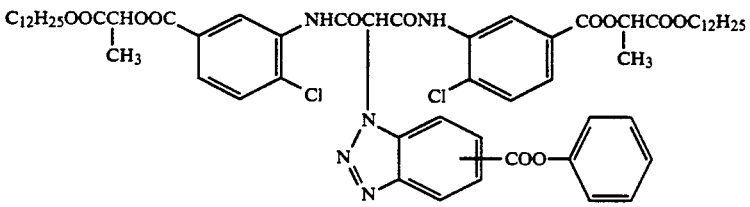

-continued
(D-15)
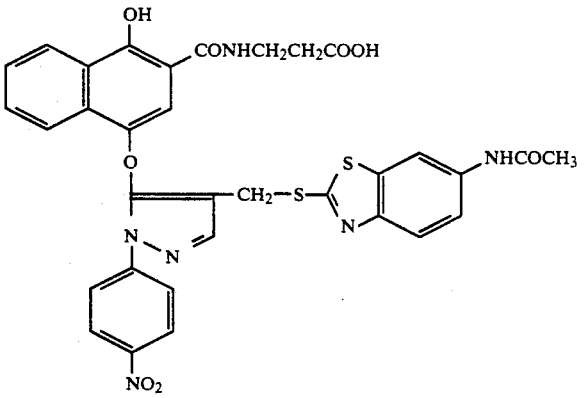
(D-16)
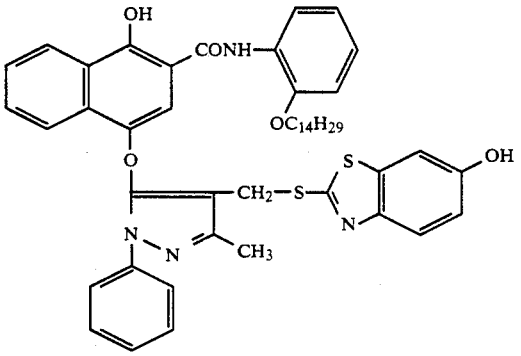
(D-17)
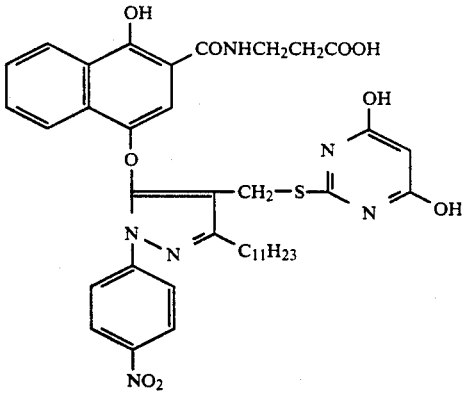
(D-18)
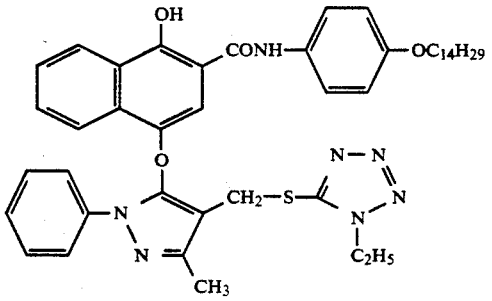

-continued
(D-19)
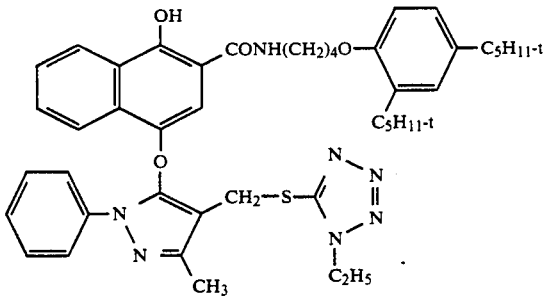
(D-20)
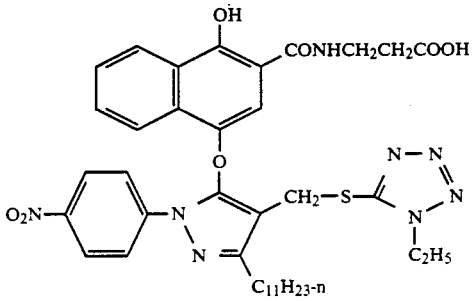
(D-21)
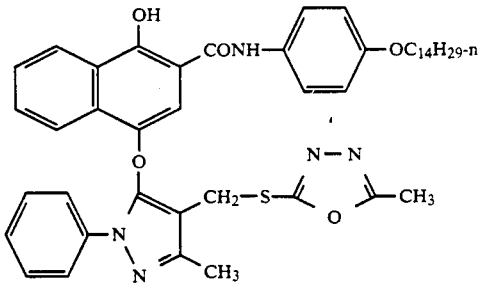
(D-22)
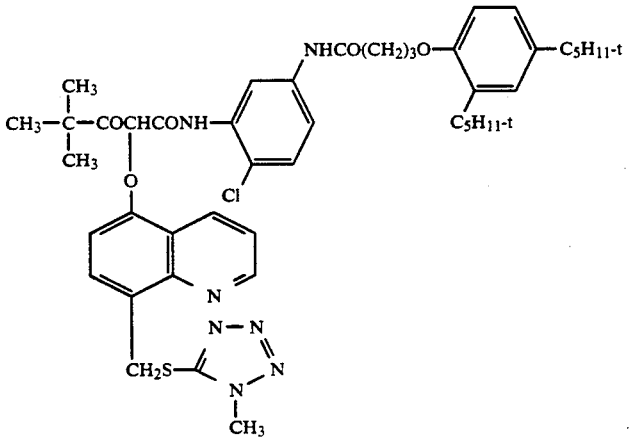

-continued
(D-23)
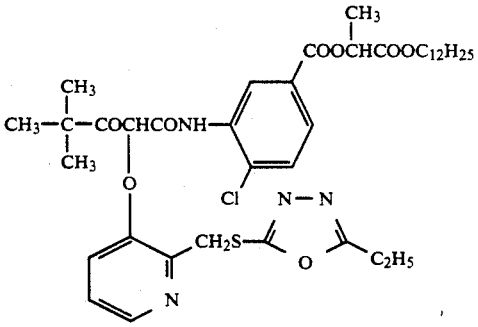
(D-24)
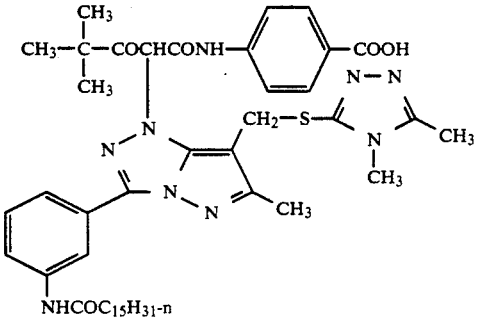
(D-25)
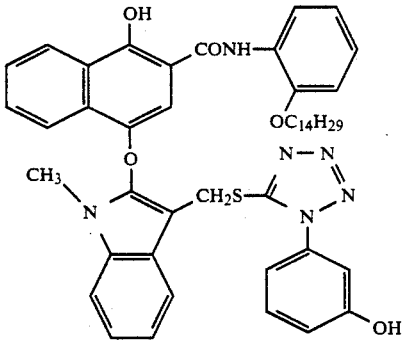
(D-26)
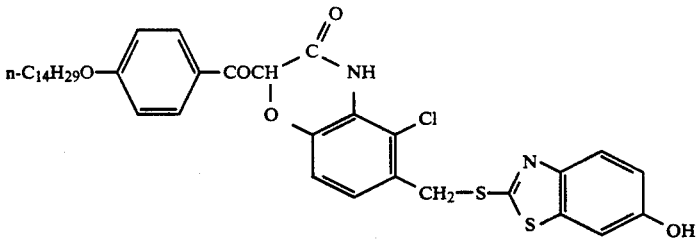
(D-27)
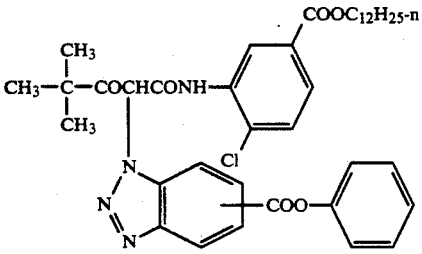

-continued
(D-28)
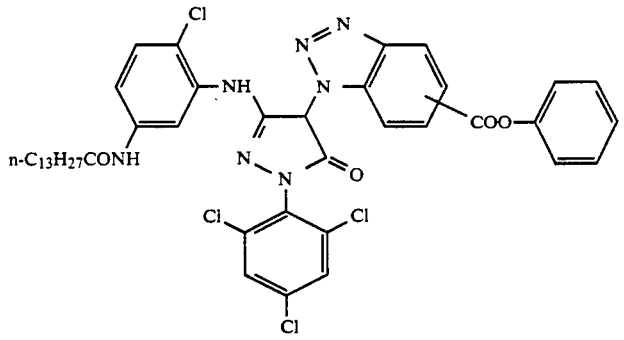
(D-29)
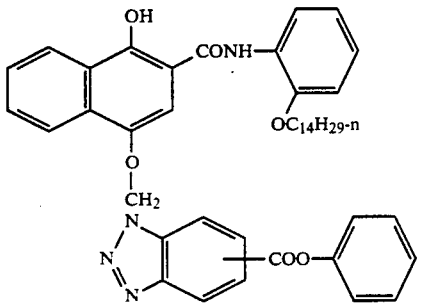
(D-30)
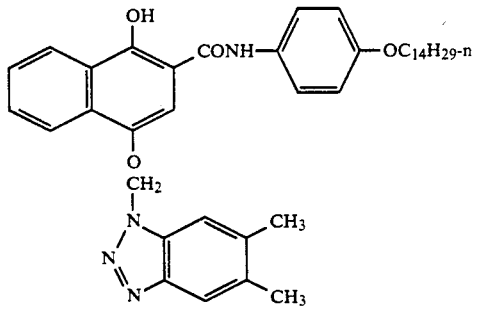
(D-31)
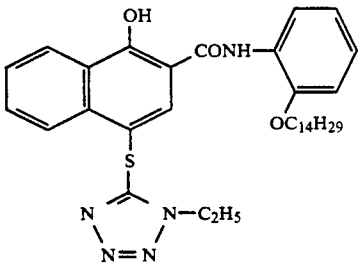
(D-32)
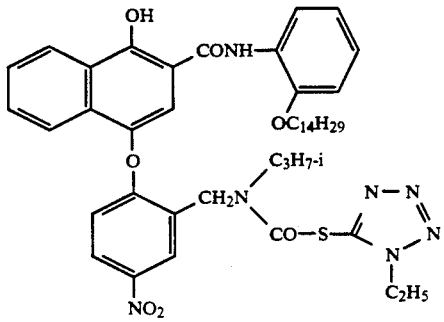

-continued
(D-33)
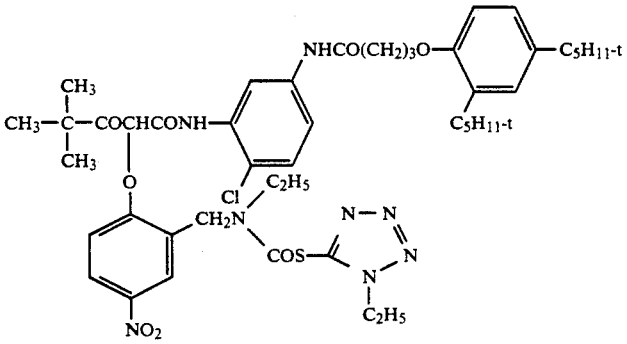
(D-34)
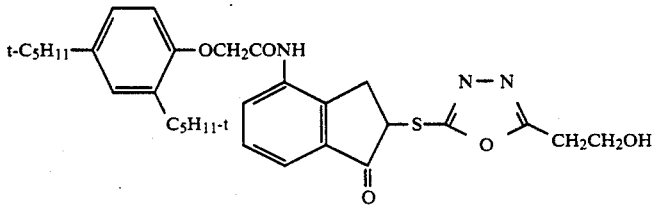
(D-35)
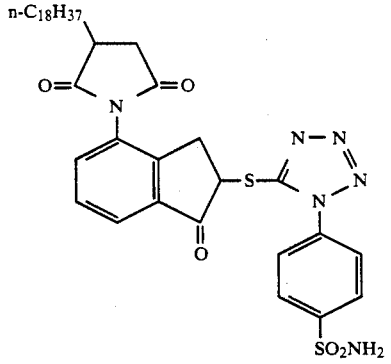
(D-36)
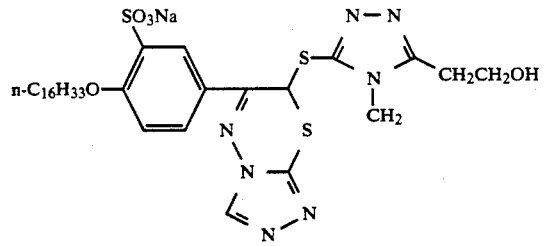
(D-37)
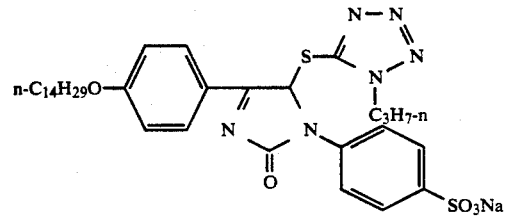

-continued
(D-38)
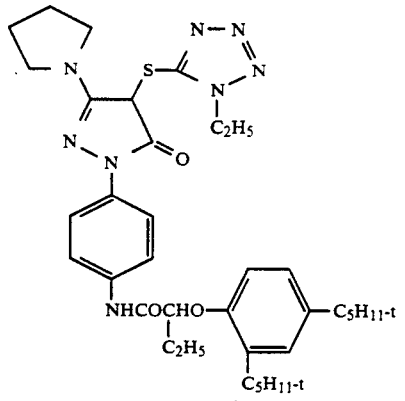
(D-39)
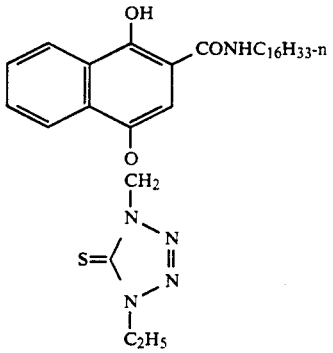
(D-40)
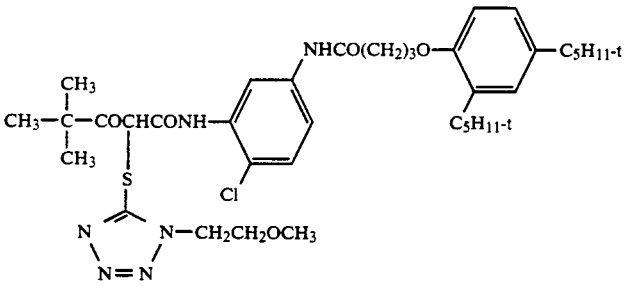
(D-41)
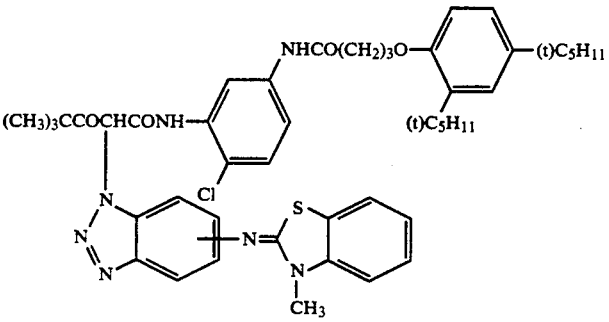

-continued (D-42)

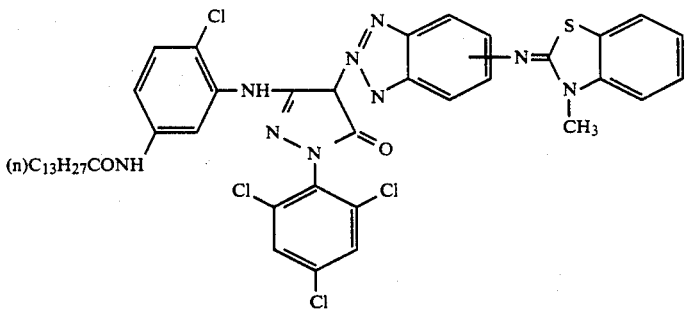

(D-43)

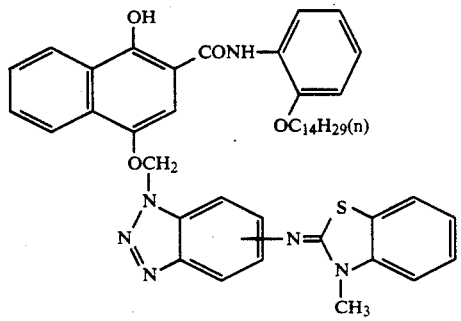

(D-44)

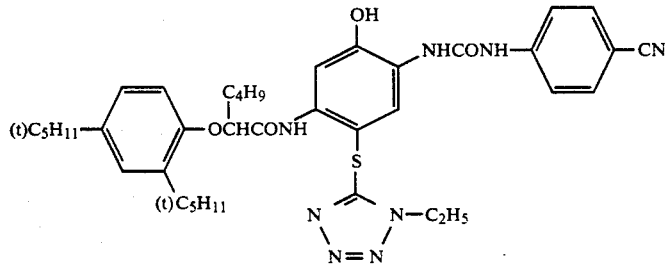

(D-45)

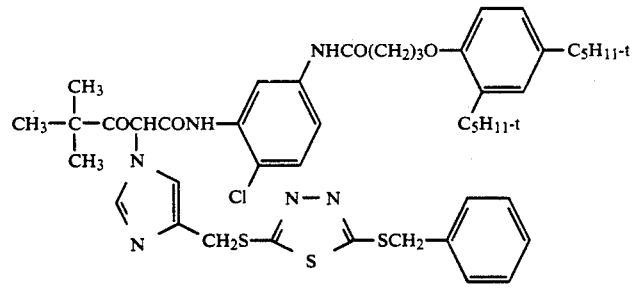

The compounds which can be represented by general formula [I] can be prepared using the methods disclosed in U.S. Pat. Nos. 4,174,966, 4,183,752, 4,421,845 and 4,477,563, JP-A-54-145135, JP-A-57-151944, JP-A-57-154234, JP-A-57-188035, JP-A-58-98728, JP-A-58-162949, JP-A-58-209736, JP-A-58-209737, JP-A-58-209738 and JP-A-58-209740.

The compounds which can be represented by general formula [I] of the present invention are included in at least one silver halide emulsion layer, intermediate layer, filter layer (for example, yellow filter layer or magenta filter layer), under-layer, anti-halation layer or other auxiliary layer in the photosensitive material. They are preferably included in a photosensitive silver halide emulsion layer or in a photosensitive layer adjacent thereto. They are most desirably included in a layer which contains emulsified grains of the present invention or in layer of the same color sensitivity which is adjacent thereto.

The compounds represented by general formula [I] can be added to the photosensitive material using the same methods used for the dispersion of couplers as described hereinafter. The amounts of these compounds are from $10^{-6}$ to $10^{-3}$ mol/m$^2$, preferably from $3\times10^{-6}$ to $5\times10^{-4}$ mol/m$^2$, and most desirably from $5\times10^{-6}$ to $2\times10^{-4}$ mol/m$^2$.

Moreover, in the present invention the inclusion of compounds with which the compounds which have been cleaved after reaction with the oxidation product of the developing agent, are cleaved with the release of a development inhibitor by reaction with another molecule of the oxidation product of the color developing agent, is especially desirable for improving development activity, color reproduction and sharpness.

The compounds with which the compounds which have been cleaved after reaction with the oxidation product of a developing agent are cleaved with the release of a development inhibitor by reaction with another molecule of the oxidation product of the developing agent are described below. The compounds can be represented by the general formula [III] indicated below.

A—P—Z [III]

In the above formula, A represents a coupling component which can react with the oxidation product of a color developing agent and which releases the —P—Z group on reacting with the oxidation product of the color developing agent. Z represents a development inhibitor, and the diffusibility can be selected freely. Z is preferably a development inhibitor of which the development inhibiting capacity is markedly deactivated when it flows out into the development bath. —P—Z represents a group from which a development inhibitor is formed by reaction with the oxidation product of the developing agent after cleavage from A.

The development inhibitors represented by Z include those disclosed in *Research Disclosure* volume 176, No. 17643 (December 1978). They are preferably mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles, mercaptotriazoles, mercaptooxadiazoles, mercaptothiadiazoles and derivatives of these compounds.

The preferred development inhibitors can be represented by the general formulae indicated below.

(Z-1)

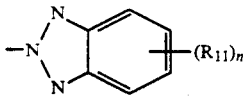

(Z-2)

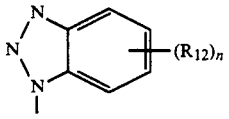

(Z-3)

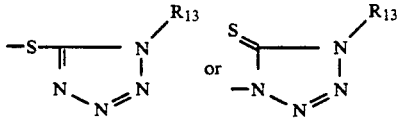

(Z-4)

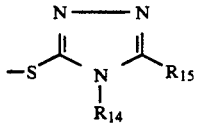

(Z-5)

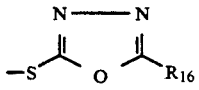

(Z-6)

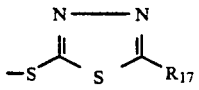

-continued (Z-7)

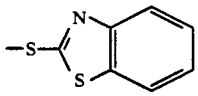

(Z-8)

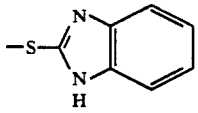

(Z-9)

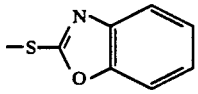

In general formulae [Z-1] and [Z-2], $R_{11}$ and $R_{12}$ represent alkyl groups, alkoxy groups, acylamino groups, halogen atoms, alkoxycarbonyl groups, thiazolylideneamino groups, aryloxycarbonyl groups, acyloxy groups, carbamoyl groups, N-alkylcarbamoyl groups, N,N-dialkylcarbamoyl groups, nitro groups, amino groups, N-arylcarbamoyloxy groups, sulfamoyl groups, sulfonamido groups, N-alkylcarbamoyloxy groups, ureido groups, hydroxyl groups, alkoxycarbonylamino groups, aryloxy groups, alkylthio groups, arylthio groups, anilino groups, aryl groups, imido groups, heterocyclic groups, cyano groups, alkylsulfonyl groups, or aryloxycarbonylamino groups.

Moreover, n represents 1 or 2, and when n is 2 the $R_{11}$, $R_{12}$ groups may be the same or different, and the total number of carbon atoms in the n individual $R_{11}$, $R_{12}$ groups is from 0 to 20.

$R_{13}$, $R_{14}$, $R_{15}$, $R_{16}$ and $R_{17}$ in general formulae [Z-3], [Z-4], [Z 5] and [Z 6] represent alkyl groups, aryl groups or heterocyclic groups.

In those cases where $R_{11}$ to $R_{17}$ represent alkyl groups, they may be substituted or unsubstituted linear chain, branched or cyclic alkyl groups. Substituent groups include halogen atoms, nitro group, cyano group, aryl groups, alkoxy groups, aryloxy groups, alkoxycarbonyl groups, aryloxycarbonyl groups, sulfamoyl groups, carbamoyl groups, hydroxyl group, alkanesulfonyl groups, arylsulfonyl groups, alkylthio groups and arylthio groups.

In those cases where $R_{11}$ to $R_{17}$ represent aryl groups, they may be substituted. Substituent groups include alkyl groups, alkenyl groups, alkoxy groups, alkoxycarbonyl groups, halogen atoms, nitro groups, amino groups, sulfamoyl groups, hydroxyl group, carbamoyl groups, aryloxycarbonylamino groups, alkoxycarbonylamino groups, acylamino groups, cyano groups and ureido groups.

In those cases where $R_{11}$ to $R_{17}$ represent heterocyclic groups, they are five or six membered single ring or condensed ring groups which contain nitrogen, oxygen or sulfur atoms as heteroatoms, and they include pyridyl groups, quinolyl groups, furyl groups, benzothiazolyl groups, oxazolyl groups, imidazolyl groups, thiazolyl groups, triazolyl groups, benzotriazolyl groups, imido groups and oxazine groups. The groups may be substituted with the substituent groups described earlier in connection with the aryl groups.

The number of carbon atoms included in $R_{11}$ and $R_{12}$ in general formulae [Z-1] and [Z-2] is from 1 to 20, and preferably from 7 to 20.

The number of carbon atoms included in $R_{13}$ to $R_{17}$ in general formulae [Z-3], [Z-4], [Z-5] and [Z-6] is from 1 to 20, and preferably from 4 to 20.

These compounds can be prepared easily using the methods disclosed, for example, in JP-A-60-185950, JP-A-1-240240, JP-A-61-249052, JP-A-61 236550, and JP-A-61-236551.

Actual structures of compounds which can be used in the present invention are indicated below, but the structure is not limited to those shown herein.

T-1

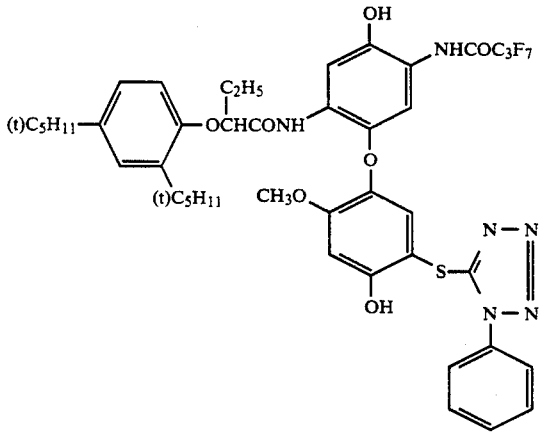

T-2

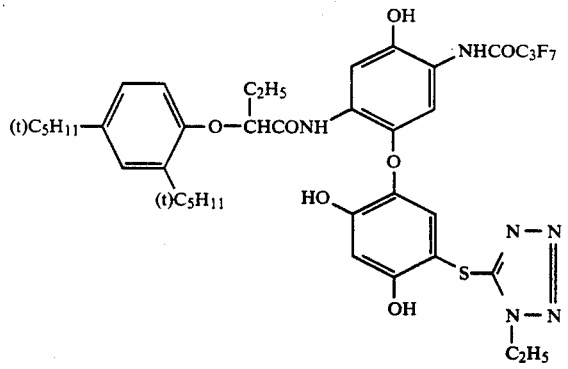

T-3

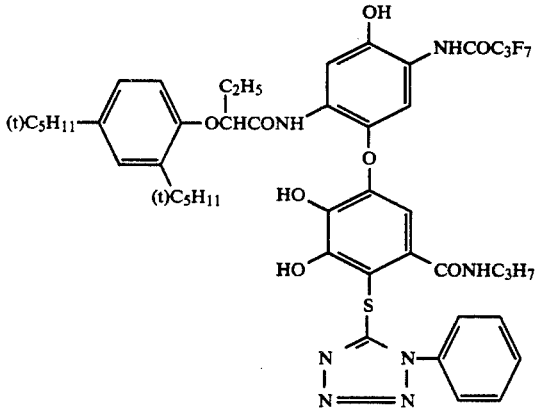

-continued
T-4
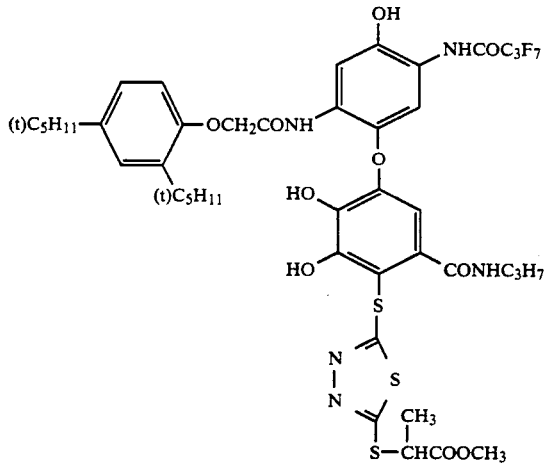
T-5
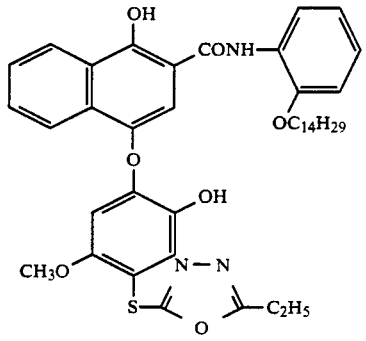
T-6
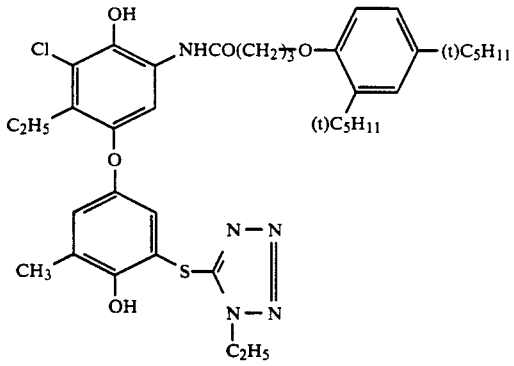
T-7
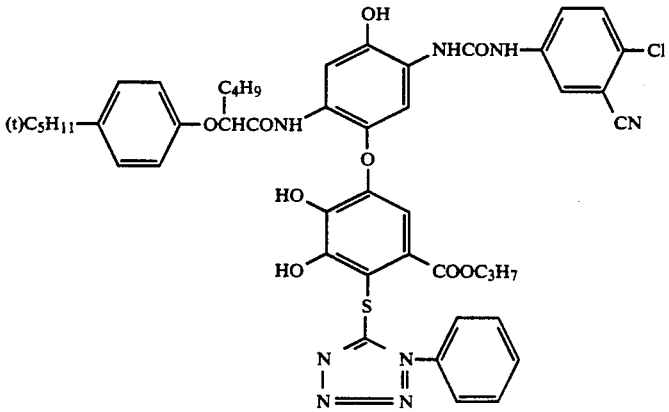

-continued
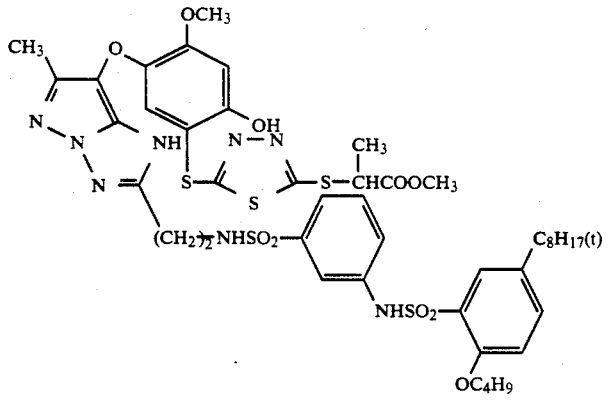
T-8
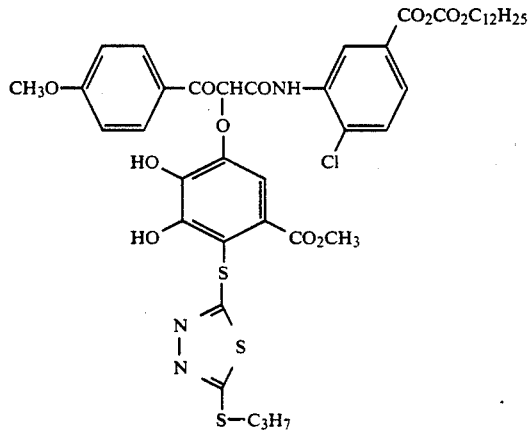
T-9
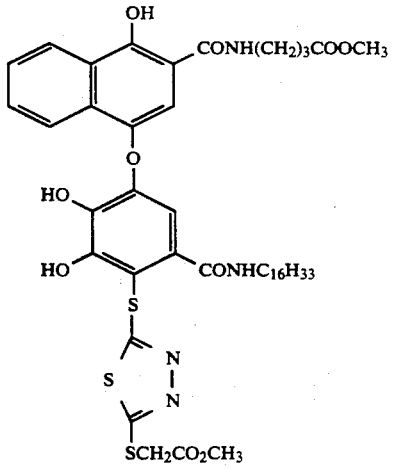
T-10

-continued
T-11
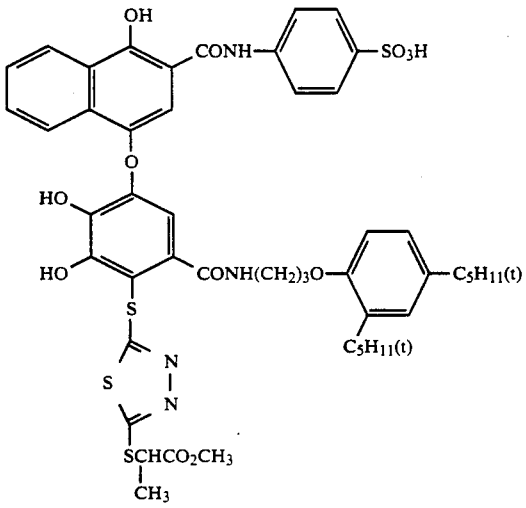
T-12
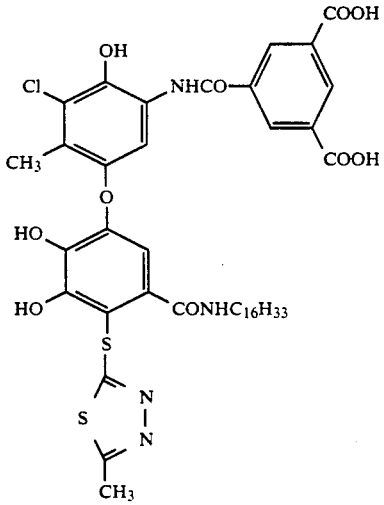
T-13
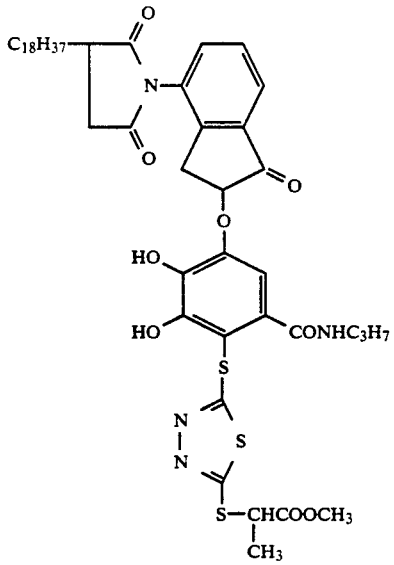

-continued

T-14

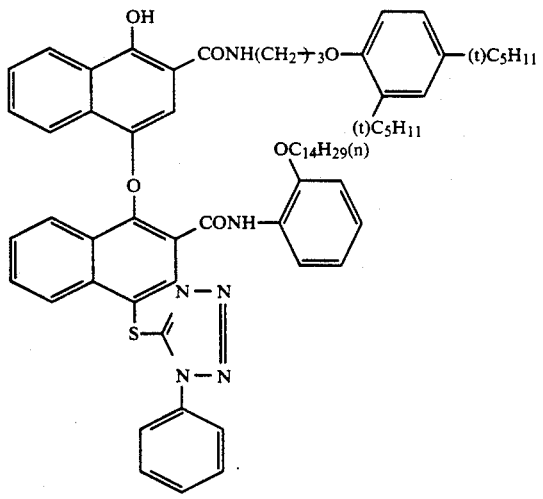

T-15

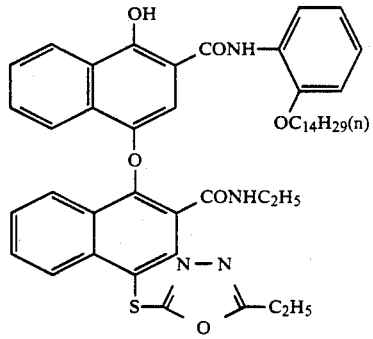

The aforementioned development inhibitor releasing compounds can be added to the silver halide emulsion layers or photo-insensitive intermediate layers in silver halide color photosensitive materials.

The amount of the aforementioned developer inhibitor releasing compounds added is from $10^{-6}$ to $10^{-3}$ mol/m$^2$, and preferably from $5\times10^{-6}$ to $3\times10^{-4}$ mol/m$^2$.

The use of methods such as those indicated below is preferred in those cases in which the improvement of sharpness is a major object.

First, the layer thickness of the photosensitive material film can be reduced. The dry film thickness from the surface of the support to the surface of the protective layer is preferably not more than 23 μm, and most desirably not more than 18 μm.

Second, tabular silver halide grains of an average aspect ratio of at least 5, which have good light transmission properties or monodisperse silver halide grains of a grain size within the range in which there is little light scattering in the visible light region can be used.

Moreover, methods in which sharpness is increased using unsharp mask compounds such as those disclosed in JP-A-62-35355 and JP-A-62-25756 can be used conjointly.

There are also methods in which colored absorbing dyes which are fast to diffusion, such as those disclosed in JP-A-61-295550 and JP-A-61-292636, are added to the photosensitive or photo-insensitive layers.

Furthermore, the addition of compounds which react and fix formaldehyde such as those disclosed in U.S. Pat. Nos. 4,411,987 and 4,435,503, to the photosensitive materials is desirable for preventing any reduction of photographic performance due to formaldehyde gas.

Various color couplers can be used in the present invention. Actual examples thereof are disclosed in the patents cited in the aforementioned *Research Disclosure* (RD) No. 17643, sections VII-C to G.

For example, those disclosed in U.S. Pat. Nos. 3,933,501, 4,022,620, 4,326,024 and 4,401,752, JP-B-58-10739, British Patents 1,425,020 and 1,476,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers. Those disclosed, for example, in U.S. Pat. Nos. 4,310,619 and 4,351,897, European Patent 73,636, U.S. Pat. Nos. 3,061,432 and 3,725,064, *Research Disclosure* No. 2422 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630 are especially desirable.

Phenol based couplers and naphthol based couplers are used as cyan couplers. Those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199, and JP-A-61-42658 are preferred.

The colored couplers for correcting the unwanted absorptions of colored dyes are also desirable. Examples include those disclosed in section VII-G of *Research Disclosure* No. 17643, U.S. Pat. No. 4,163,670, JP-B-57-39413, U.S. Pat. Nos. 4,004,929 and 4,138,258, and British Patent 1,146,368, and are preferred. Furthermore, the use of couplers which correct the unwanted absorption of colored dyes by means of fluorescent dyes which are released on coupling is also desirable, see, for example, U.S. Pat. No. 4,774,181. Further, the use of couplers which have as releasing groups dye precursor groups capable of forming dyes upon reacting with developing agents is also desirable, see, for example, U.S. Pat. No. 4,777,120.

The couplers of which the colored dyes have a suitable degree of diffusibility are desirable. Examples include those disclosed in U.S. Pat. No. 4,366,237, British Patent 2,125,570, European Patent 96,570 and West German Patent Application (OLS) No. 3,234,533.

Typical examples of polymerized dye forming couplers are disclosed, for example, in U.S. Pat. Nos. 3,451,820, 4,080,211, 4,367,282, 4,409,320 and 4,576,910, and British Patent 2,102,173.

The use of couplers which release photographically useful residual groups on coupling is preferred in this invention. In addition to those mentioned earlier which can be represented by the general formula [I], the DIR couplers which release development inhibitors disclosed in the patents cited in section VII-F of the aforementioned *Research Disclosure* 17643, JP-A-60-184248, JP-A-63-37346 and U.S. Pat. No. 4,782,012 are desirable.

The couplers disclosed in British Patents 2,097,140 and 2,131,188, JP-A-59-157638 and JP-A-59-170840 are preferred as couplers which imagewise release nucleating agents or development accelerators during development.

The couplers which release dyes of which the color is restored after elimination disclosed in European Patent 173,302A; the bleach accelerator releasing couplers disclosed, for example, in *Research Disclosure* 11449, ibid., 24241, and JP-A-61-201247; the ligand releasing couplers disclosed, for example, in U.S. Pat. No. 4,553,477; the leuco dye releasing couplers disclosed in JP-A-63-75747; and the couplers which release fluorescent dyes disclosed in U.S. Pat. No. 4,774,181, can also be used in the photosensitive materials of the present invention.

The couplers used in the present invention can be introduced into the photosensitive material using various known methods of dispersion.

Examples of high boiling point solvents which can be used in the oil in water dispersion method have been disclosed, for example, in U.S. Pat. No. 2,322,027.

Actual examples of high boiling point organic solvents which have a boiling point of at least 175° C. at normal pressure, which can be used in the oil in water dispersion method, include phthalate esters such as dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate; phosphate or phosphonate esters such as triphenyl phosphate, tricresyl phosphate, 2-ethylhexyl diphenyl phosphate, tricyclohexyl phosphate, tri 2-ethylhexyl phosphate, tridodecyl phosphate, tri-butoxyethyl phosphate, trichloropropyl phosphate and di-2-ethylhexyl phenyl phosphate; benzoate esters such as 2-ethylhexyl benzoate, dodecyl benzoate, and 2-ethylhexyl p-hydroxybenzoate; amides such as N,N-diethyldodecanamide, N,N-diethyllaurylamide and N-tetradecylpyrrolidone; alcohols or phenols such as iso-stearyl alcohol and 2,4-di-tert-amylphenol; aliphatic carboxylic acid esters such as bis(2-ethylhexyl)sebacate, dioctyl azelate, glycerol tributyrate, isostearyl lactate and trioctyl citrate; aniline derivatives such as N,N-dibutyl-2-butoxy-5-tert-octylaniline; and hydrocarbons such as paraffins, dodecylbenzene and di-isopropylnaphthalene. Furthermore, organic solvents which have a boiling point above about 30° C., and preferably of at least 50° C., but below about 160° C. can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

Actual examples of the processes and effects of the latex dispersion method and of latexes for loading purposes are disclosed, for example, in U.S. Pat. No. 4,199,363, and West German Patent Application (OLS) Nos. 2,541,274 and 2,541,230.

The present invention can be applied to various types of color photosensitive materials. Typical examples include color negative films for general or cinematographic purposes and color reversal films for slides or video purposes.

Suitable supports which can be used in the present invention are disclosed, for example, on page 28 of the aforementioned *Research Disclosure* No. 17643, and in the text from the right hand column of page 647 to the left hand column of page 648 of *Research Disclosure* No. 18716.

The photosensitive materials of the present invention are preferably such that the total film thickness of all the hydrophilic colloid layers on the side where the emulsion layers are located is not more than 28 μm and the film swelling rate $T_{\frac{1}{2}}$ is not more than 30 seconds. The film thickness signifies the film thickness measured after equilibration (2 days) at 25° C., 55% relative humidity. The film swelling rate $T_{\frac{1}{2}}$ can be measured using methods well known to those in the industry. For example, measurements can be made using a swellometer of the type described by A. Green in *Photogr. Sci. Eng.*, Volume 19, Number 2. pages 124 to 129, and $T_{\frac{1}{2}}$ is defined as the time taken for the film thickness to reach half the amount of the saturated film thickness taking 90% of the maximum swelled film thickness reached on processing the material for 3 minutes 15 seconds in a color development bath at 30° C. as the saturated film thickness.

The film swelling rate $T_{\frac{1}{2}}$ can be adjusted by adding film hardening agents to the gelatin as a binder, or by changing the ageing conditions after coating. Furthermore, the swelling factor is preferably from 150% to 400%. The swelling factor can be calculated from the maximum swelled film thickness obtained under the conditions described above using the expression (maximum swelled film thickness-film thickness)/film thickness.

Color photographic photosensitive materials in accordance with the present invention can be developed and processed in the usual way as disclosed on pages 28 to 29 of the aforementioned *Research Disclosure* No. 17643, and in the text from the left hand column to the right hand column of page 615 of the aforementioned *Research Disclosure* No. 18716.

The color development baths used to develop and process the photosensitive materials of the present invention are preferably aqueous alkaline solutions which contain an aromatic primary amine based color developing agent as the principal component. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethyl-aniline, 3-methyl-4-amino-N-ethyl-β-methoxyethylaniline, and the sulfate, hydrochloride and p-toluenesulfonate salts of these compounds. Two or more of these compounds can be used in combination depending on the intended purpose.

Color development baths generally contain pH buffers such as alkali metal carbonates, borates or phosphates, and development inhibitors or anti-foggants such as bromides, iodides, benzimidazoles, benzothiazoles or mercapto compounds. They may also contain, as required, various preservatives such as hydroxylamine, diethylhydroxylamine, sulfites, hydrazines, phenylsemicarbazides, triethanolamines, catecholsulfonic acids and triethylenediamine(1,4-diazabicyclo[2,2,2]octanes, organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, tackifier, various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene 1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Color development is carried out after a normal black-and-white development in cases where reversal processing is used. The known black-and-white developing agents, for example dihydroxybenzenes such as hydroquinone, 3-pyrazolidones such as 1-phenyl-3-pyrazolidone or aminophenols such as N-methyl-p-aminophenol aminophenol can be used individually, or in combination, in the black-and-white development baths.

The pH value of these color development baths and black-and-white development baths is generally within the range from 9 to 12. The replenishment rate of these development baths depends on the color photographic material which is being processed, but it is generally not more than 3 liters per square meter of photosensitive material, and replenishment rates of not more than 500 ml per square meter of photosensitive material can be achieved by reducing the bromide ion concentration in the replenisher. The prevention of evaporation or aerial oxidation of the liquid by minimizing the area of contact between the processing bath and the atmosphere is desirable in those cases where the rate of replenishment is low. Furthermore, the replenishment rate can be reduced by using some means of suppressing the accumulation of bromide ion in the development bath.

Color development processing time is normally set within the range from 2 to 5 minutes, but it is possible to arrange shorter processing times by using high temperatures and high pH levels, and by increasing the concentration of the color developing agent.

The photographic emulsion layer is subjected to a normal bleaching process after color development. The bleaching process may be carried out at the same time as a fixing process (in a bleach-fix process) or it may be carried out as a separate process. Moreover, a bleach-fix process can be carried out after a bleaching process in order to speed up processing. Moreover, a bleach-fixing process can be carried out in two connected bleach-fix baths, a fixing process can be carried out before a bleach-fixing process, or a bleaching process can be carried out after a bleach-fix process, depending on the intended purpose. Compounds of multi-valent metals, such as iron(III), cobalt(III), chromium(IV), and copper(II), peracids, quinones and nitro compounds, for example, can be used as bleaching agents. Typical bleaching agents include ferricyanides; dichromates; organic complex salts of iron(III) or cobalt(III), for example complex salts with aminopolycarboxylic acids such as ethylenediamine tetra-acetic acid, diethylenetriamine pentaacetic acid, cyclohexanediamine tetra-acetic acid, methylimino diacetic acid, 1,3-diaminopropane tetra-acetic acid and glycol ether diamine tetra acetic acid, or citric acid, tartaric acid or malic acid; persulfates; bromates; permanganates; and nitrobenzenes. The use of the polyaminocarboxylic acid iron(III) complex salts, principally ethylenediamine tetra-acetic acid iron(III) complex salts, and persulfates, from among these compounds is preferred to provide rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is normally from 5.5 to 8, but lower pH values can be used in order to speed up processing.

Bleaching accelerators can be used, as required, in the bleach baths, bleach-fix baths or bleach or bleach-fix pre-baths. Actual examples of useful bleach accelerators have been disclosed in the following specifications: The compounds which have a mercapto group or a disulfide group such as those disclosed in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-04232, JP-A-53-124424, JP-A-53-141623, JP-A-53-28426, and in *Research Disclosure* No. 17129 (June, 1978); the thiazolidine derivatives disclosed in JP-A 50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect. The compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleach accelerators may also be added to the sensitive materials. These bleach accelerators are especially effective when bleach-fixing color photosensitive materials used for taking photographs.

Thiosulfates, thiocyanates, thioether based compounds, thioureas and large amounts of iodide can be used as fixing agents. But, thiosulfates are normally used, and ammonium thiosulfate can be used in the widest range of applications. Sulfites, bisulfites or carbonyl/bisulfite addition compounds are preferred as preservatives for bleach-fix baths.

The silver halide color photographic materials of the present invention are usually subjected to a water washing process and/or stabilization process after the desilvering process. The amount of wash water used in a washing process can be fixed within a wide range, depending on the application and the nature (for example the materials such as couplers which have been used) of the photosensitive material, the wash water temperature, the number of water washing tanks (the number of water washing stages) and the replenishment system, i.e., whether a countercurrent or a concurrent system is used, and various other conditions. The relationship between the amount of water used and the number of washing tanks in a multi-stage countercurrent system can be obtained using the method outlined on pages 248 to 253 of the *Journal of the Society of Motion Picture and Television Engineers,* Volume 64 (May, 1955).

The amount of wash water can be greatly reduced by using the multi-stage countercurrent system described in the aforementioned literature, but bacteria proliferate due to the increased residence time of the water in the tanks, and problems arise with the suspended matter which is produced becoming attached to the photosensitive material. The method in which the calcium ion and magnesium ion concentrations are reduced disclosed in JP-A-62-288838 is very effective as a means of overcoming this problem when processing color photosensitive materials of the present invention. Furthermore, the isothiazolone compounds and thiabendazoles disclosed in JP-A-57-8542, chlorine based disinfectants such as chlorinated sodium isocyanurate, and benzotriazole, and the disinfectants disclosed in "*The Chemistry of Biocides and Fungicides*" by Horiguchi, in "*Killing Microorganisms, Biocidal and Fungicidal Techniques*" published by the Health and Hygiene Technical Society, and in "*A Dictionary of Biocides and Fungicides*" published by the Japanese Biocide and Fungicide Society, can also be used.

The pH value of the wash water when processing photosensitive materials of the present invention is from 4 to 9, and preferably from 5 to 8. The wash water temperature and the washing time can vary in accordance with the nature and application of the photosensitive material. But, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of the invention can be processed directly in a stabilizing bath instead of being subjected to a water wash as described above. The known methods disclosed in JP-A-57-8543, JP-A-58-14834 and JP-A-60-220345 can be used for this purpose of stabilization process.

Furthermore, in some cases a stabilization process is carried out following the aforementioned water washing process. The stabilizing baths which contain formalin and surfactant which are used as final baths with color photosensitive materials used for taking photographs are an example of such a process. Various chelating agents and fungicides can also be added to these stabilizing baths.

The overflow which accompanies replenishment of the above mentioned water washing and/or stabilizing baths can be reused in other processes such as the desilvering process.

Color developing agents can be incorporated into a silver halide color photosensitive material of the present invention to simplifying and speed-up processing. The use of various color developing agent precursors for incorporation is preferred. For example, the indoaniline based compounds disclosed in U.S. Pat. No. 3,342,597, the Shiff's base type compounds disclosed in U.S. Pat. No. 3,342,599 and *Research Disclosure* No. 14850 and ibid., No. 15159, the aldol compounds disclosed in *Research Disclosure* No. 13924, the metal complex salts disclosed in U.S. Pat. No. 3,719,492 and the urethane based compounds disclosed in JP-A-53-135628, can be used for this purpose.

Various 1-phenyl-3-pyrazolidones can be incorporated, as required, into the silver halide color photosensitive materials of the invention to accelerate color development. Typical compounds of this type have been disclosed, for example, in JP-A-56-64339, JP-A-57-144547 and JP-A-58-115438.

The various processing baths in this invention are used at a temperature of from 10° to 50° C. The standard temperature is normally from 33° to 38° C., but accelerated processing and shorter processing times can be realized at higher temperatures while, on the other hand, increased picture quality and better processing bath stability can be achieved at lower temperatures. Furthermore, processes using hydrogen peroxide intensification or cobalt intensification such as those disclosed in West German Patent 2,226,770 or U.S. Pat. No. 3,674,499 can be used in order to economize on silver in the photosensitive material.

The silver halide photosensitive materials of the present invention can also be used as heat-developable photosensitive materials such as those disclosed in U.S. Pat. No. 4,500,626, JP-A-60-133449, JP-A-59-218443, JP-A-61-238056 and European Patent 210,660A2.

The invention will now be described in more detail below by means of illustrative examples. The invention, however, should not be construed to be limited by the examples in any way.

EXAMPLE 1

Sample 101, a comparative sensitive material having spectral sensitivity distribution analogous to that disclosed in U.S. Pat. No. 3,672,898 and with little interlayer effect, was prepared. This sample was a multilayer color photosensitive material comprised of layers having the composition indicated below, on an undercoated cellulose triacetate film support.

Composition of the Photosensitive Layer

The coated weights are shown as the weight in units of g.Ag/m$^2$ in the case of silver halides and colloidal silver, as the weight in units of g/m$^2$ in the case of couplers, additives and gelatin, and as the number of mols per mol of silver halide in the same layer in the case of the sensitizing dyes.

First Layer (Anti-halation Layer)

-continued

| | |
|---|---|
| Black colloidal silver | 0.2 |
| Gelatin | 1.3 |
| Colored coupler C-1 | 0.06 |
| Ultraviolet absorber UV-1 | 0.1 |
| Ultraviolet absorber UV-2 | 0.2 |
| Dispersing oil Oil-1 | 0.01 |
| Dispersing oil Oil-2 | 0.01 |
| Second Layer (Intermediate Layer) | |
| Fine grained silver bromide (average grain size 0.07 μm) | 0.15 |
| Gelatin | 1.0 |
| Colored coupler C-2 | 0.02 |
| Dispersing oil Oil-1 | 0.1 |
| Third Layer (First Red-Sensitive Emulsion Layer) | |
| Silver iodobromide emulsion (2 mol % silver iodide, average grain size 0.3 μm) | as silver 0.3 |
| Gelatin | 0.6 |
| Sensitizing dye I | $3.0 \times 10^{-4}$ |
| Sensitizing dye II | $1.0 \times 10^{-4}$ |
| Coupler C-3 | 0.06 |
| Coupler C-4 | 0.06 |
| Coupler C-5 | 0.01 |
| Coupler C-8 | 0.04 |
| Coupler C-2 | 0.03 |
| Dispersing oil Oil-1 | 0.03 |
| Dispersing oil Oil-3 | 0.012 |
| Fourth Layer (Second Red-Sensitive Emulsion Layer) | |
| Silver iodobromide emulsion (5 mol % silver iodide, average grain size 0.5 μm) | 0.5 |
| Sensitizing dye I | $2 \times 10^{-4}$ |
| Sensitizing dye II | $0.6 \times 10^{-4}$ |
| Coupler C-3 | 0.24 |
| Coupler C-5 | 0.02 |
| Coupler C-4 | 0.24 |
| Coupler C-8 | 0.04 |
| Coupler C-2 | 0.04 |
| Dispersing oil Oil-1 | 0.15 |
| Dispersing oil Oil-3 | 0.02 |
| Fifth Layer (Third Red-Sensitive Emulsion Layer) | |
| Silver iodobromide emulsion (10 mol % silver iodide, average grain size 0.7 μm) | as silver 1.0 |
| Gelatin | 1.0 |
| Sensitizing dye I | $1.5 \times 10^{-4}$ |
| Sensitizing dye II | $0.5 \times 10^{-4}$ |
| Coupler C-6 | 0.05 |
| Coupler C-7 | 0.1 |
| Dispersing oil Oil-1 | 0.01 |
| Dispersing oil Oil-2 | 0.05 |
| Sixth Layer (Intermediate Layer) | |
| Gelatin | 1.0 |
| Compound Cpd-A | 0.03 |
| Dispersing oil Oil-1 | 0.05 |
| Seventh Layer (First Green-Sensitive Emulsion Layer) | |
| Silver iodobromide emulsion (4 mol % silver iodide, average grain size 0.03 μm) | 0.15 |
| Sensitizing dye III | $3 \times 10^{-4}$ |
| Sensitizing dye IV | $3 \times 10^{-4}$ |
| Sensitizing dye V | $1 \times 10^{-4}$ |
| Gelatin | 1.0 |
| Coupler C-9 | 0.2 |
| Coupler C-1 | 0.03 |
| Dispersing oil Oil-1 | 0.5 |
| Eighth Layer (Second Green-Sensitive Emulsion Layer) | |
| Silver iodobromide emulsion (5 mol % silver iodide, | 0.15 |

-continued

| | |
|---|---|
| average grain size 0.5 μm) | |
| Sensitizing dye III | $2 \times 10^{-4}$ |
| Sensitizing dye IV | $2 \times 10^{-4}$ |
| Sensitizing dye V | $0.6 \times 10^{-4}$ |
| Coupler C-9 | 0.25 |
| Coupler C-1 | 0.03 |
| Coupler C-10 | 0.015 |
| Dispersing oil Oil-1 | 0.2 |
| Ninth Layer (Third Green-Sensitive Emulsion Layer) | |
| Silver iodobromide emulsion (6 mol % silver iodide, average grain size 0.7 μm) | as silver 0.3 |
| Gelatin | 1.0 |
| Sensitizing dye III | $1.5 \times 10^{-4}$ |
| Sensitizing dye IV | $1.5 \times 10^{-4}$ |
| Sensitizing dye V | $0.5 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersing oil Oil-1 | 0.20 |
| Dispersing oil Oil-2 | 0.05 |
| Tenth Layer (Yellow Filter Layer) | |
| Gelatin | 1.2 |
| Yellow colloidal silver | 0.04 |
| Compound Cpd-B | 0.1 |
| Dispersing oil Oil-1 | 0.3 |
| Eleventh Layer (First Blue-Sensitive Emulsion Layer) | |
| Monodisperse silver iodobromide emulsion (4 mol % silver iodide, average grain size 0.3 μm) | as silver 0.3 |
| Gelatin | 1.0 |
| Sensitizing dye VI | $2 \times 10^{-4}$ |
| Coupler C-3 | 0.01 |
| Coupler C-14 | 0.9 |
| Coupler C-5 | 0.02 |
| Dispersing oil Oil-1 | 0.2 |
| Twelfth Layer (Second Blue-Sensitive Emulsion Layer) | |
| Silver iodobromide emulsion (10 mol % silver iodide, average grain size 1.5 μm) | as silver 0.5 |
| Gelatin | 0.6 |
| Sensitizing dye VI | $1 \times 10^{-4}$ |
| Coupler C-14 | 0.25 |
| Dispersing oil Oil-1 | 0.07 |
| Thirteenth Layer (First Protective Layer) | |
| Gelatin | 0.8 |
| Ultraviolet absorber UV-1 | 0.1 |
| Ultraviolet absorber UV-2 | 0.2 |
| Dispersing oil Oil-1 | 0.01 |
| Dispersing oil Oil-2 | 0.01 |
| Fourteenth Layer (Second Protective Layer) | |
| Fine grained silver bromide (average grain size 0.07 μm) | 0.5 |
| Gelatin | 0.45 |
| Poly(methyl methacrylate) particles (average diameter 1.5 μm) | 0.2 |
| Hardening agent (H-1) | 0.4 |
| Formaldehyde scavenger S-1 | 0.5 |
| Formaldehyde scavenger S-2 | 0.5 |

Surfactants were added to each layer as coating aids in addition to the components indicated above. The sample prepared in this way was Sample 101.

The structural formula or chemical name of each of the compounds used in the preparation of this sample is indicated below.

UV-1
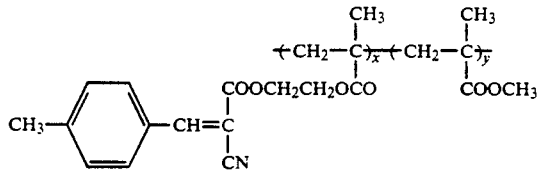
x/y = 7/3 (by weight)
UV-2
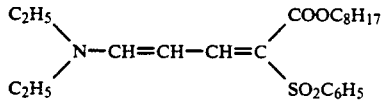
Tricresyl phosphate — Oil-1
Dibutyl phthalate — Oil-2
Bis(2-ethylhexyl)phthalate — Oil-3
C-1
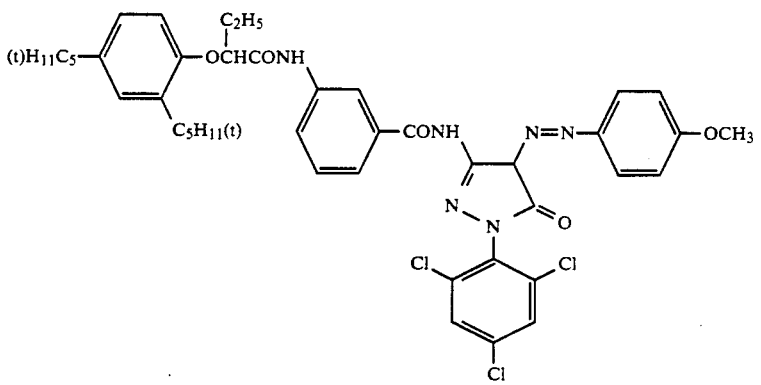
C-2
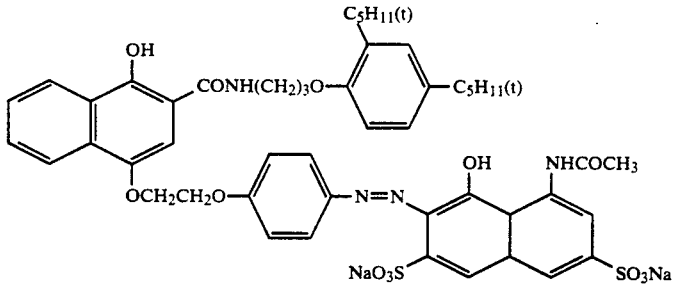
C-3
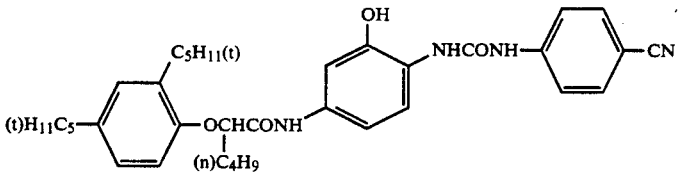
C-4
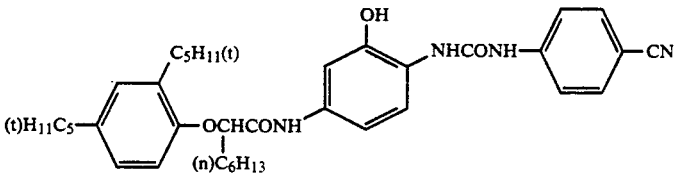

-continued
C-5
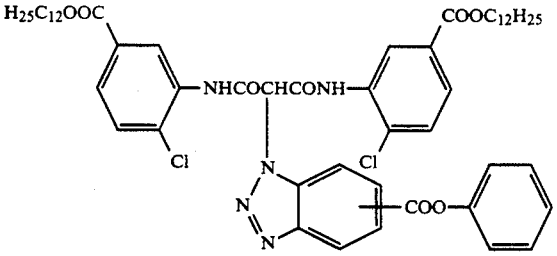
C-6
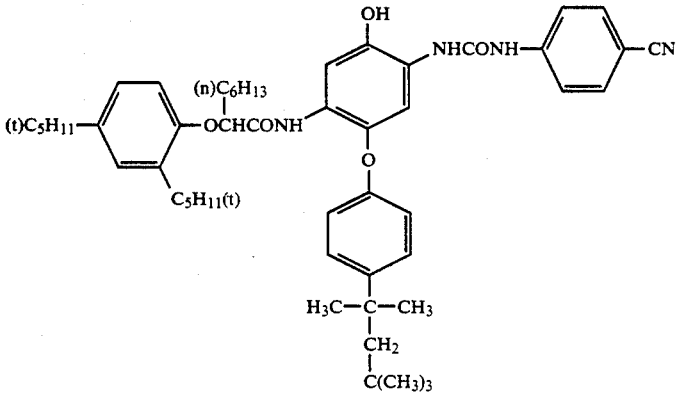
C-7
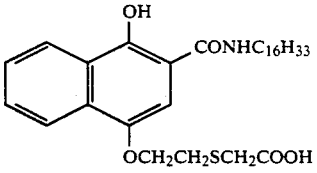
C-8
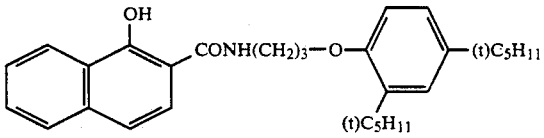
C-9
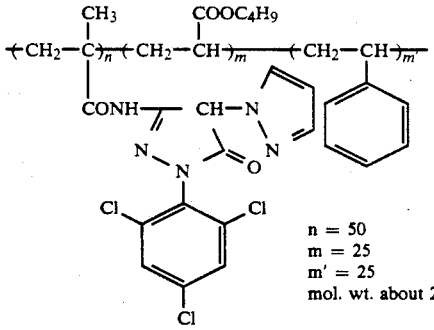
n = 50
m = 25
m' = 25
mol. wt. about 20,000
C-10
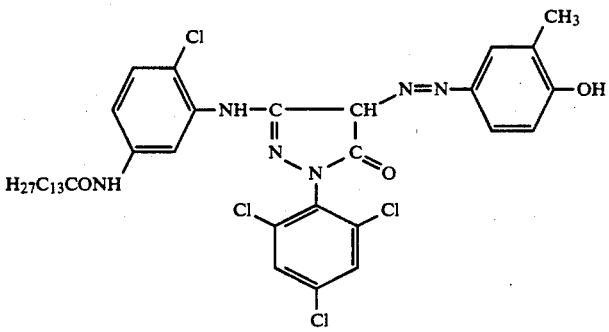

-continued
C-11
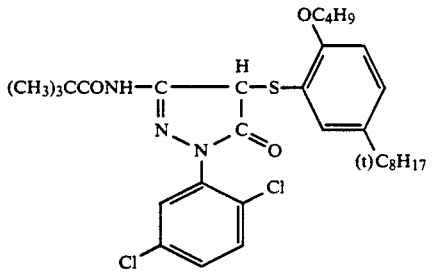
C-12
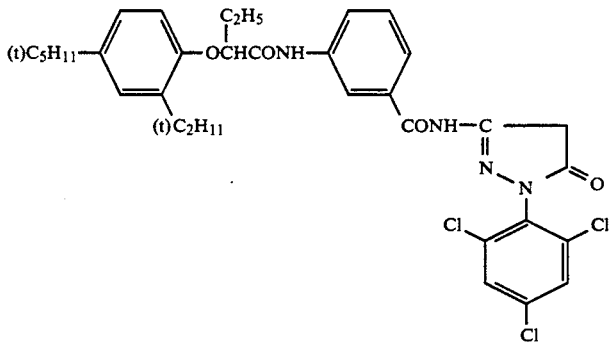
C-13
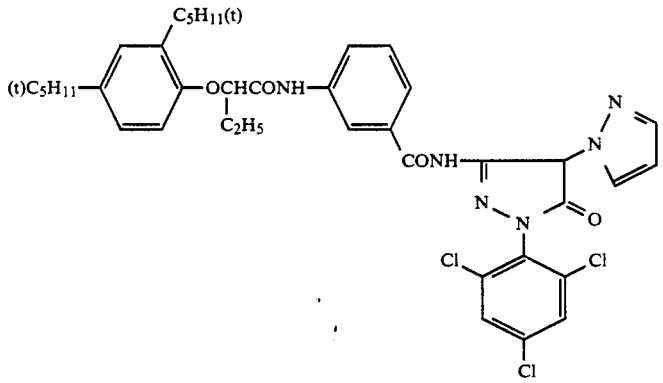
C-14
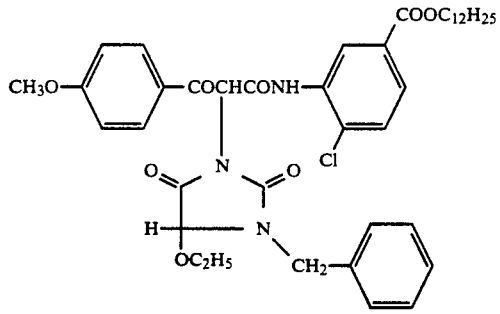
C-15
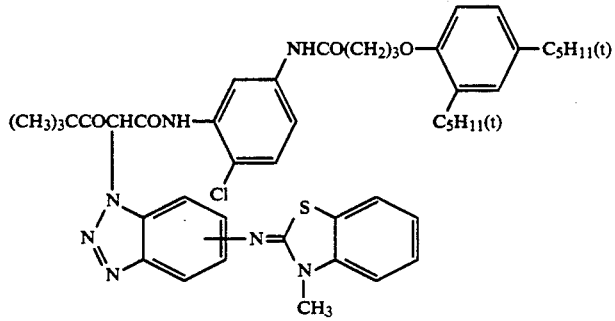

-continued
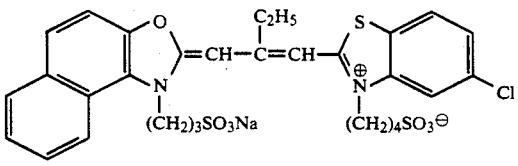
Sensitizing Dye I
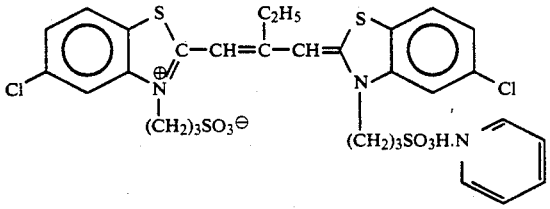
Sensitizing Dye II
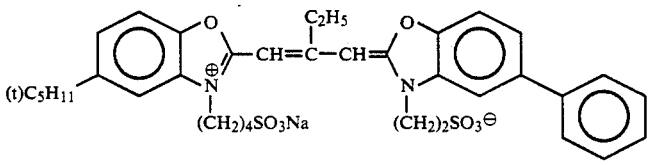
Sensitizing Dye III
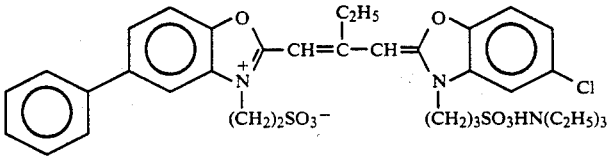
Sensitizing Dye IV
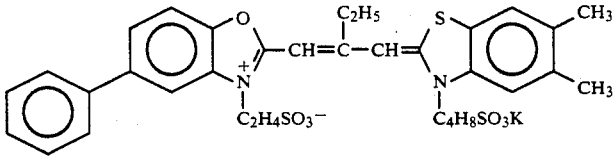
Sensitizing Dye V
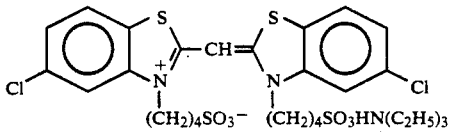
Sensitizing Dye VI
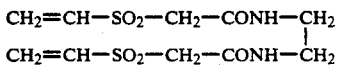
H-1
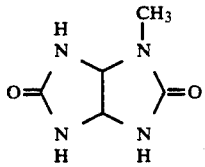
S-1
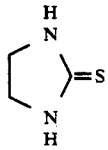
S-2

-continued

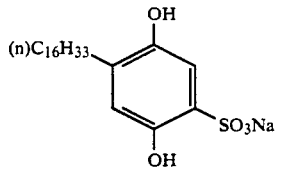

Cpd-A

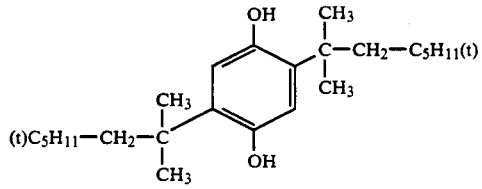

Cpd-B

Another comparative sample, Sample 102, in which a DIR coupler was used in the green-sensitive layer for increasing the saturation of the reproduced color, was prepared. The sample was obtained by modifying Sample 101 in the ways indicated below.

Modifications (1) The DIR coupler C-5 was added at a rate of 0.03 g/m/2 to the seventh layer and the whole of the seventh layer was increased 50%.

(2) The DIR coupler C-5 was added at a rate of 0.01 $g/m^2$ to the eighth layer and the whole of the eighth layer was increased 30%.

(3) The whole of the third and fourth layers was increased 30%.

(4) The whole of the eleventh layer was increased 10%.

Even another comparative sample, Sample 103 was prepared using the technique disclosed in JP-A-62-160448.

(1) The layer unit indicated below was inserted between the sixth and seventh layers of Sample 101.

| Fifteenth Layer | |
|---|---|
| Silver iodobromide emulsion (4 mol % silver iodide, average grain size 1.5 μm) | as silver 1.0 $g/m^2$ |
| Silver iodobromide emulsions (2 mol % silver iodide, average grain size 1.0 μm) | as silver 0.3 $g/m^2$ |
| Gelatin | 1.0 $g/m^2$ |
| Sensitizing dye III | $1.6 \times 10^{-4}$ mol |
| Sensitizing dye IV | $0.4 \times 10^{-4}$ mol |
| Coupler C-13 | 0.2 $g/m^2$ |
| Coupler C-5 | 0.04 $g/m^2$ |
| Dispersing oil Oil-1 | 0.1 $g/m^2$ |
| Dispersing oil Oil-2 | 0.05 $g/m^2$ |

Sixteenth Layer

Same as the sixth layer.

(2) Moreover, the whole of the third and fourth layers was increased 30%.

A further comparative sample, Samples 104 was prepared. Sample 104 was prepared by modifying Sample 102 in the way indicated below.

| | |
|---|---|
| (1) The sensitizing dyes in the seventh layer were modified in the way indicated below: | |
| Sensitizing dye III | $4.5 \times 10^{-4}$ |
| Sensitizing dye IV | $2.0 \times 10^{-4}$ |
| Sensitizing dye V | $0.5 \times 10^{-4}$ |

-continued

| | |
|---|---|
| (2) The sensitizing dyes in the eighth layer were modified in the way indicated below: | |
| Sensitizing dye III | $3.0 \times 10^{-4}$ |
| Sensitizing dye IV | $1.3 \times 10^{-4}$ |
| Sensitizing dye V | $0.3 \times 10^{-4}$ |
| (3) The sensitizing dyes in the ninth layer were modified in the way indicated below: | |
| Sensitizing dye III | $2.2 \times 10^{-4}$ |
| Sensitizing dye IV | $1.0 \times 10^{-4}$ |
| Sensitizing dye V | $0.3 \times 10^{-4}$ |
| (4) The coated silver weight of yellow colloidal silver in the tenth layer was reduced to 0.03. | |

A sample representing the invention, Sample 105 was then obtained by modifying Sample 104 in the way described below.

| | |
|---|---|
| (1) The sensitizing dyes in the third layer were modified in the way indicated below: | |
| Sensitizing dye I | $1.5 \times 10^{-4}$ |
| Sensitizing dye II | $0.5 \times 10^{-4}$ |
| Sensitizing dye V | $2.0 \times 10^{-4}$ |
| (2) The sensitizing dyes in the fourth layer were modified in the way indicated below: | |
| Sensitizing dye I | $1.0 \times 10^{-4}$ |
| Sensitizing dye II | $0.3 \times 10^{-4}$ |
| Sensitizing dye V | $1.3 \times 10^{-4}$ |
| (3) The sensitizing dyes in the fifth layer were modified in the way indicated below: | |
| Sensitizing dye I | $0.8 \times 10^{-4}$ |
| Sensitizing dye II | $0.3 \times 10^{-4}$ |
| Sensitizing dye V | $0.9 \times 10^{-4}$ |

Another sample representing the invention, Sample 106, was obtained by modifying Sample 104 in the way described below.

| | |
|---|---|
| (1) The sensitizing dyes in the third layer were modified in the way indicated below: | |
| Sensitizing dye I | $1.5 \times 10^{-4}$ |
| Sensitizing dye II | $0.5 \times 10^{-4}$ |
| Sensitizing dye V | $1.0 \times 10^{-4}$ |
| Sensitizing dye VII | $1.0 \times 10^{-4}$ |
| (2) The sensitizing dyes in the fourth layer were modified in the way indicated below: | |
| Sensitizing dye I | $1.0 \times 10^{-4}$ |
| Sensitizing dye II | $0.3 \times 10^{-4}$ |
| Sensitizing dye V | $0.7 \times 10^{-4}$ |
| Sensitizing dye VII | $0.6 \times 10^{-4}$ |
| (3) The sensitizing dyes in the fifth layer were modified in the way indicated below: | |
| Sensitizing dye I | $0.8 \times 10^{-4}$ |
| Sensitizing dye II | $0.3 \times 10^{-4}$ |
| Sensitizing dye V | $0.5 \times 10^{-4}$ |

-continued

| | |
|---|---|
| Sensitizing dye VII | $0.4 \times 10^{-4}$ |
| (4) The whole of the fourth and fifth layers were increased 10%. | |

Sensitizing Dye VII

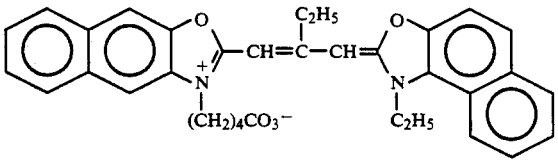

Even another sample representing the invention, Sample 107 was then prepared by modifying Sample 105 in the way indicated below.

| | |
|---|---|
| (1) The sensitizing dyes in the seventh layer were modified in the way indicated below: | |
| Sensitizing dye III | $4.8 \times 10^{-4}$ |
| Sensitizing dye IV | $2 \times 10^{-4}$ |
| Sensitizing dye V | $0.2 \times 10^{-4}$ |
| (2) The sensitizing dyes in the eighth layer were modified in the way indicated below: | |
| Sensitizing dye III | $3.2 \times 10^{-4}$ |
| Sensitizing dye IV | $1.3 \times 10^{-4}$ |
| Sensitizing dye V | $0.15 \times 10^{-4}$ |
| (3) The sensitizing dyes in the ninth layer were modified in the way indicated below: | |
| Sensitizing dye III | $2.4 \times 10^{-4}$ |
| Sensitizing dye IV | $1.0 \times 10^{-4}$ |
| Sensitizing dye V | $0.1 \times 10^{-4}$ |

A still further comparative sample, Sample 108 was then obtained by modifying Sample 106 in the way described below.

| | |
|---|---|
| (1) The sensitizing dyes in the seventh layer were modified in the way indicated below: | |
| Sensitizing dye III | $5.0 \times 10^{-4}$ |
| Sensitizing dye IV | $2.0 \times 10^{-4}$ |
| (2) The sensitizing dyes in the eighth layer were modified in the way indicated below: | |
| Sensitizing dye III | $3.3 \times 10^{-4}$ |
| Sensitizing dye IV | $1.3 \times 10^{-4}$ |
| (3) The sensitizing dyes in the ninth layer were modified in the way indicated below: | |
| Sensitizing dye III | $2.5 \times 10^{-4}$ |
| Sensitizing dye IV | $1.0 \times 10^{-4}$ |

The ISO speeds S and the values of $S_G^{560}-S_R^{560}$ after uniform exposure for Samples 101 to 108 were obtained using the methods described above.

A Line Double Filter DEPIL 0.5 interference filter made by the SHOTT GLASWERKE Co. was used to obtain the monochromatic light of wavelength 560 nm. The half value width was 10 nm. Development processing was carried out using the operations indicated below at 38° C.

| Process | Processing Time | Temperature |
|---|---|---|
| Color development | 3 min. 15 sec. | 38° C. |

-continued

| Process | Processing Time | Temperature |
|---|---|---|
| Bleaching | 6 min. 30 sec. | 38° C. |
| Water Wash | 2 min. 10 sec. | 24° C. |
| Fixing | 4 min. 20 sec. | 38° C. |
| Water Wash (1) | 1 min. 5 sec. | 24° C. |
| Water Wash (2) | 2 min. 10 sec. | 24° C. |
| Stabilization | 1 min. 5 sec. | 38° C. |
| Drying | 4 min. 20 sec. | 55° C. |

The compositions of the processing baths are indicated below:

| | (Units: g) |
|---|---|
| Color Development Bath | |
| Diethylenetriamine penta-acetic acid | 1.0 |
| 1-Hydroxyethylidene-1,1-disulfonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfite | 2.4 |
| 4-(N-Ethyl-N-β-hydroxyethyl-amino)-2-methylaniline sulfate | 4.5 |
| Water | to make up to 1.0 l |
| pH | 10.05 |
| Bleach Bath | |
| Sodium ethylenediaminetetraacetato ferrate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water | to make up to 1.0 l |
| pH | 6.0 |
| Fixer Bath | |
| Disodium ethylenediaminetetraacetate | 0.5 |
| Sodium sulfite | 7.0 |
| Sodium bisulfite | 5.0 |
| Aqueous ammonium thiosulfate solution (70%) | 170.0 ml |
| Water | to make up to 1.0 l |
| pH | 6.7 |
| Stabilizer Bath | |
| Formalin (37%) | 2.0 ml |
| Polyoxyethylene p-mono-nonylphenyl ether (average degree of polymerization 10) | 0.3 |
| Disodium ethylenediaminetetraacetate | 0.05 |
| Water | to make up to 1.0 l |
| pH | 5.0 to 8.0 |

The results obtained are shown in Table 1.

Next, Samples 101 to 108 were finished to camera "Leica" size and a Macbeth Color Rendition Chart was photographed using daylight (color temperature 5850° K.) or using a fluorescent lamp (F6) of the ordinary type specified by the JIS (Japanese Industrial Standard) for illumination, the exposures being made at the same time, and prints were made on color paper (Fujicolor Paper AGL #653-258) in such a way that a gray card of optical density 0.7 in daylight was reproduced in terms of brightness and hue.

The results obtained on evaluating visually the color of the gray card of optical density 0.7 photographed under fluorescent light, the red saturation photographed in daylight and the bluish-green fidelity are also shown in Table 1. The values a* and b* for the gray card color are also shown in Table 1.

TABLE 1

| Sample No. | Type | ISO speed | $S_G^{560} - S_R^{560}$ | Color of gray card photographed under Fluorescent light | a* | b* | Red saturation | Bluish Green fidelity |
|---|---|---|---|---|---|---|---|---|
| 101 | Comparative example | 80 | 1.1 | yellow green, unnatural | −3.5 | 8.0 | very low | rather poor |
| 102 | Comparative example | 82 | 1.6 | green, very unnatural | −14.0 | 8.5 | high | poor |
| 103 | Comparative example | 85 | 1.2 | yellow green, unnatural | −7.0 | 10.5 | high | good |
| 104 | Comparative example | 90 | 1.1 | yellow green, unnatural | −4.0 | 11.5 | very high | good |
| 105 | This invention | 85 | 0.9 | slightly yellow, natural | 1.0 | 13.0 | very high | good |
| 106 | This invention | 90 | 0.75 | slightly yellow, natural | 3.0 | 11.0 | high | good |
| 107 | This invention | 81 | 0.35 | slightly yellow, natural | 4.0 | 14.0 | high | good |
| 108 | Comparative example | 75 | −0.4 | red, very unnatural | 9.0 | 20.0 | high | rather poor |

Details of a* and b* have been disclosed in the JIS-Z-8729, L* a* b* color display system and the representation of colored objects with the L* u* v* color display system.

It is clear from Table 1 that comparative Sample 101 was quite good when compared with Sample 102 with respect to the bluish green fidelity and the change in color under fluorescent light, but was still inadequate, and the red saturation was very poor. Furthermore, Sample 102 exhibited a pronounced shift in color when photographs were taken under fluorescent lighting, and the bluish green fidelity was poor. Comparative Sample 103 was satisfactory in terms of fidelity and saturation levels, but there was a pronounced shift in color when photographs were taken under fluorescent light. Comparative Sample 108 exhibited a pronounced shift in color when photographs were taken under fluorescent lighting, and the bluish green fidelity was somewhat poor. On the other hand, Samples 105, 106 and 107 representing the present invention were excellent in terms of all three of the features evaluated.

EXAMPLE 2

The effectiveness of $S_G^{560}-S_R^{560}$ after the uniform exposure defined in the present invention is illustrated by this example. For comparison with the specified value, photographic speeds were obtained for monochromatic light of wavelength 560 nm obtained in the same way as before except that the uniform exposure of just $2\times 1/S$ lux.sec was omitted and $s_G^{560}-S_R^{560}$ was obtained.

Samples 201 to 203 described below were prepared.

Sample 201, representing the invention, was prepared by modifying Sample 106 in the way described below.

(1) The whole of the fourth layer was decreased 10%.
(2) The whole of the fifth layer was increased 20%.
(3) The whole of the eighth layer was decreased 10%.
(4) The whole of the ninth layer was increased 20%.

Comparative Sample 202 was obtained by modifying Sample 201 in the way described below.

| | |
|---|---|
| (1) The sensitizing dyes in the third layer were changed as indicated below. | |
| Sensitizing dye I | $3.0 \times 10^{-4}$ |
| Sensitizing dye II | $1.0 \times 10^{-4}$ |
| (2) The sensitizing dyes in the fourth layer were changed as indicated below. | |
| Sensitizing dye I | $2.0 \times 10^{-4}$ |
| Sensitizing dye II | $0.6 \times 10^{-4}$ |
| (3) The sensitizing dyes in the seventh layer were changed as indicated below. | |
| Sensitizing dye III | $3.0 \times 10^{-4}$ |
| Sensitizing dye IV | $3.0 \times 10^{-4}$ |
| Sensitizing dye V | $1.0 \times 10^{-4}$ |
| (4) The sensitizing dyes in the eighth layer were changed as indicated below. | |
| Sensitizing dye III | $2.0 \times 10^{-4}$ |
| Sensitizing dye IV | $2.0 \times 10^{-4}$ |
| Sensitizing dye V | $0.6 \times 10^{-4}$ |

Sample 203 representing the invention was obtained by modifying Sample 201 in the way described below.

| | |
|---|---|
| (1) The sensitizing dyes in the fifth layer were changed as indicated below. | |
| Sensitizing dye I | $1.5 \times 10^{-4}$ |
| Sensitizing dye II | $0.5 \times 10^{-4}$ |
| (2) The sensitizing dyes in the ninth layer were changed as indicated below. | |
| Sensitizing dye III | $1.5 \times 10^{-4}$ |
| Sensitizing dye IV | $1.5 \times 10^{-4}$ |
| Sensitizing dye V | $0.5 \times 10^{-4}$ |

The ISO speeds, $S_G^{560}-S_R^{560}$, $s_G^{560}-s_R^{560}$, and the shift in color of the gray card when photographed under fluorescent lighting, were evaluated. The results obtained were as shown in Table 2.

TABLE 2

| Sample No. | Type | ISO speed | $S_G^{560} - S_R^{560}$ | $S_G^{560} - S_R^{560}$ | Color of gray card photographed under Fluorescent light |
|---|---|---|---|---|---|
| 201 | This Invention | 100 | 0.73 | 0.85 | Slightly yellow, natural |
| 202 | Comparative Example | 105 | 1.50 | 1.01 | Green, unnatural |
| 203 | This Invention | 115 | 0.80 | 1.30 | Slightly yellow green, natural |

It is clear from Table 2, evaluation by means of $S_G^{560}-S_r^{560}$ after uniform exposure is effective.

EXAMPLE 3

Sample 301 was prepared by modifying Sample 106 in the way described below. The ISO speeds, $S_G^{560}-S_R^{560}$, $\bar{\lambda}_R$ and $\bar{\lambda}_{-G}-\bar{\lambda}_R$ values for Samples 106 and 301 are shown in Table 3.

(1) The layer unit indicated below was inserted between the sixth and seventh layers of Sample 106.

| Seventeenth Layer | |
|---|---|
| Silver iodobromide emulsion (4 mol % silver iodide, average grain size 1.2 μm) | as silver 1.0 g/m² |
| Silver iodobromide emulsion (2 mol % silver iodide, average grain size 0.6 μm) | as silver 0.3 g/m² |
| Gelatin | 1.0 g/m² |
| Sensitizing dye II | $1.8 \times 10^{-4}$ mol |
| Sensitizing dye VII | $0.2 \times 10^{-4}$ mol |
| Coupler C-6 | 0.3 g/m² |
| Coupler C-5 | 0.04 g/m² |
| Dispersing oil Oil-1 | 0.3 g/m² |
| Dispersing oil Oil-2 | 0.1 g/m |

Eighteenth Layer

Same as the sixth layer.

(2) Moreover, the whole of the seventh and eighth layers was increased 20%.

Sensitizing Dye VII

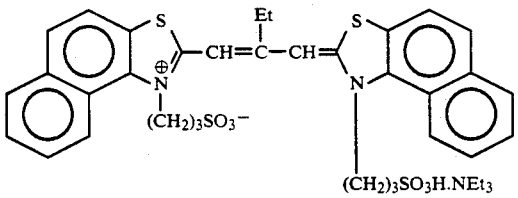

TABLE 3

| Sample No. | ISO Speed | $S_G^{560}-S_R^{560}$ | $\bar{\lambda}_R$ | $\bar{\lambda}_{-G}-\bar{\lambda}_R$ |
|---|---|---|---|---|
| 106 | 90 | 0.75 | 605 | 1 |
| 301 | 85 | 0.80 | 610 | 15 |

Sample 301 exhibited excellent color reproduction characteristics with which it was possible to discriminate between scarlet and crimson roses in a photograph of fresh flowers.

EXAMPLE 4

Samples 401 and 402 were prepared by modifying Samples 106 and 301 in the way described below, respectively. The ISO speeds, $S_G^{560}-S_R^{560}$, $\bar{\lambda}_{-G}$ and $\bar{\lambda}_{-B}-\bar{\lambda}_{-G}$ values for Samples 106, 301, 401 and 402 are shown in Table 4.

Samples 401 and 402

(1) The layer unit indicated below was inserted between the ninth and tenth layers of Samples 106 and 301 respectively.

| Nineteenth Layer | |
|---|---|
| Silver iodobromide emulsion (6 mol % silver iodide, average grain size 0.6 μm) | as silver 0.2 g/m² |
| Silver iodobromide emulsions (4 mol % silver iodide, average grain size 0.3 μm) | as silver 0.05 g/m² |
| Gelatin | 1.0 g/m² |
| Sensitizing dye IV | $3.0 \times 10^{-4}$ mol |
| Sensitizing dye V | $1.0 \times 10^{-4}$ mol |
| Coupler C-13 | 0.20 g/m² |
| Coupler C-5 | 0.04 g/m² |
| Dispersing oil Oil-1 | 0.20 g/m² |
| Dispersing oil Oil-2 | 0.05 g/m² |

Twentieth Layer

Same as the sixth layer.

(2) The emulsified grain size of the seventh, eighth and ninth layers were each multiplied by 1.2, and the coated weights were increased by 1.2 times.

(3) Moreover, the whole of the eleventh layer was increased 20%.

TABLE 4

| Sample No. | ISO Speed | $S_G^{560}-S_R^{560}$ | $\bar{\lambda}_G$ | $\bar{\lambda}_{-B}-\bar{\lambda}_G$ |
|---|---|---|---|---|
| 106 | 90 | 0.75 | 535 | 2 |
| 301 | 85 | 0.80 | 540 | 4 |
| 401 | 88 | 0.78 | 537 | 16 |
| 402 | 81 | 0.82 | 541 | 18 |

Samples 401 and 402 exhibited true color reproduction characteristics with which it was possible to discriminate between red and orange.

EXAMPLE 5

Samples 501 to 506 were prepared by modifying the sensitizing dyes in Sample 105 in the ways described below.

Sample 501

The sensitizing dye III in Sample 105 was replaced by an equimolar amount of the sensitizing dye indicated below.

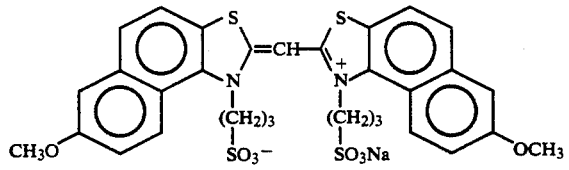

Sample 502

Replacement by the sensitizing dye indicated below in the same way as in Sample 501.

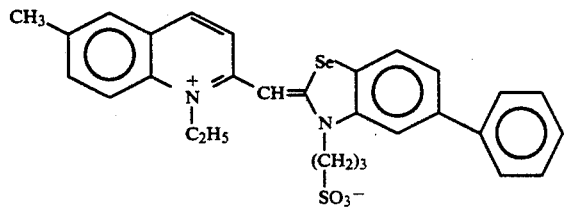

Sample 503

Replacement by the sensitizing dye indicated below in the same way as in Samples 501 and 502.

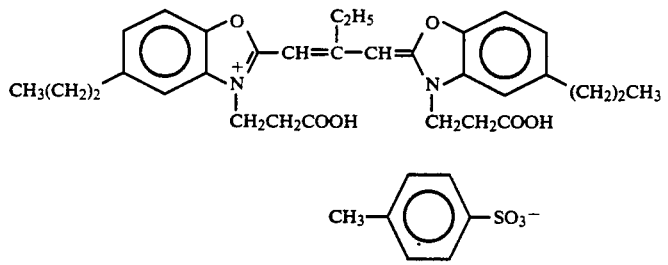

Sample 504

The sensitizing dye I in Sample 105 was replaced by an equimolar amount of the sensitizing dye indicated below.

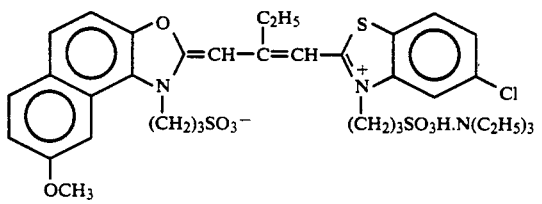

Sample 505

Replacement by the sensitizing dye indicated below in the same way as in Sample 504.

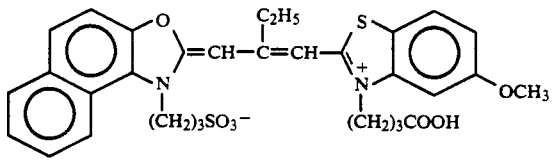

Sample 506

Replacement by the sensitizing dye indicated below in the same way as in Samples 504 and 505.

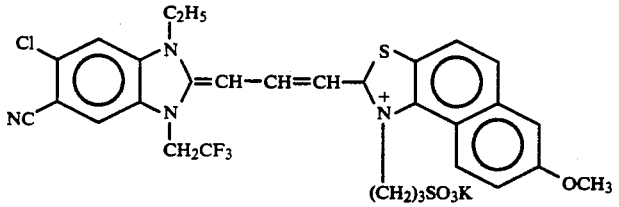

Tests were carried out in the same way as in Example 1 using Samples 501 to 506 and good results, similar to those obtained with Samples 105 and 106, were obtained.

While the invention has been described in detail and with reference to specific embodiments thereof, it will be apparent to one skilled in the art that various changes and modifications can be made therein without departing from the spirit and scope thereof.

What is claimed is:

1. Silver halide color photographic photosensitive material comprising, on a support, at least one red-sensitive silver halide emulsion layer, at least one green-sensitive silver halide emulsion layer and at least one blue-sensitive silver halide emulsion layer, said photosensitive material having an ISO speed of S, wherein the difference ($S_G^{560}-S_R^{560}$) is in the range of from −0.2 to 1.0, where $S_G^{560}$ and $S_R^{560}$ are measured after subjecting the photosensitive material to a uniform exposure of 2/S lux sec with white light.

2. A silver halide color photographic photosensitive material according to claim 1, wherein the difference ($S_G^{560}-S_R^{560}$) is in the range of from 0.1 to 1.0.

3. A silver halide color photographic photosensitive material according to claim 1, wherein the difference ($S_G^{560}-S_R^{560}$) is in the range of from 0.2 to 0.9.

4. A silver halide color photographic photosensitive material according to claim 1, wherein the weight-average wavelength ($\bar{\lambda}_R$) of the spectral sensitivity distribution of the red-sensitive layer is in the range of from 590 nm to 660 nm, the weight-averaged wavelength ($\bar{\lambda}_{-G}$) of the wavelength distribution of the interlayer effect received by the green-sensitive silver halide emulsion layer due to the other layers in the range from 570 nm to 680 nm is in the range of from 600 nm to 680 nm, and the difference ($\bar{\lambda}_{-G}-\bar{\lambda}_R$) is in the range of 5 nm or more.

5. A silver halide color photographic photosensitive material according to claim 4, wherein the difference ($\bar{\lambda}_{-G}-\bar{\lambda}_R$) is in the range of 10 nm or more.

6. A Silver halide color photographic photosensitive material according to claim 1, wherein the weight-averaged wavelength ($\bar{\lambda}_G$) of the spectral sensitivity distribution of the green-sensitive layer is in the range of from 520 nm to 580 nm, the weight-averaged wavelength ($\bar{\lambda}_{-B}$) of the wavelength distribution of the interlayer effect received by the blue-sensitive silver halide emulsion layer due to the other layers in the range from 500 nm to 600 nm is in the range of from 530 nm to 600 nm, and the difference ($\bar{\lambda}_{-B}-\bar{\lambda}_R$) is in the range of 5 nm or more.

7. A silver halide color photographic photosensitive material according to claim 6, wherein the difference ($\bar{\lambda}_{-B}-\bar{\lambda}_G$) is in the range of 10 nm or more.

8. A silver halide color photographic photosensitive material according to claim 1, wherein the photosensitive material comprises the compounds represented by the general formula [I]:

$$A-(LINK)_n-B \qquad [I]$$

wherein A represents a coupler residual group from which $(LINK)_n$—B is eliminated by means of a coupling reaction with the oxidation product of a primary aromatic amine developing agent; LINK represents a group which is bound to the coupling active position of A and which can eliminate B after elimination from A by the coupling reaction; B represents a group represented by general formula [IIa], [IIb], [IIc], [IId], [IIe], [IIf], [IIg], [IIh], [IIi], [IIj], [IIk], [IIl], [IIm], [IIn], [IIo] or [IIp] indicated below; n is 0 or an integer of value 1; and B is bonded directly to A when n is 0,

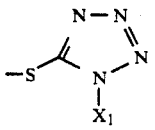

Formula (IIa)

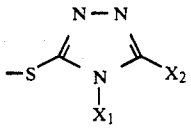

Formula (IIb)

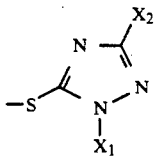

Formula (IIc)

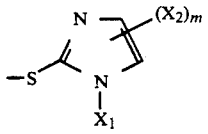

Formula (IId)

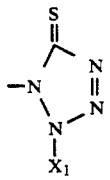

Formula (IIe)

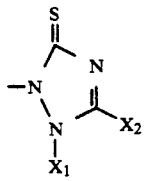

Formula (IIf)

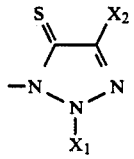

Formula (IIg)

-continued

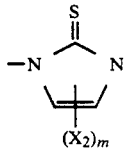

Formula (IIh)

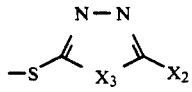

Formula (IIi)

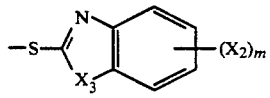

Formula (IIj)

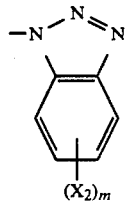

Formula (IIk)

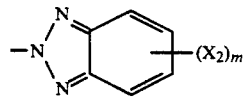

Formula (IIl)

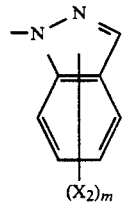

Formula (IIm)

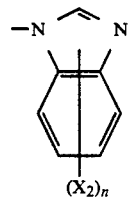

Formula (IIn)

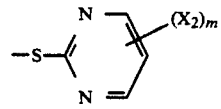

Formula (IIo)

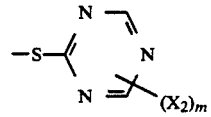

Formula (IIp)

wherein $X_1$ represents a substituted or unsubstituted aliphatic group which has from 1 to 4 carbon atoms, or a substituted phenyl groups; $X_2$ represents a hydrogen atom, an aliphatic group, a halogen atom, a hydroxyl group, an alkoxy group, an alkylthio group, an alkoxycarbonyl group, an acylamino group, a carbamoyl group, a sulfonyl group, a sulfonamido group, a sulfamoyl group, an acyloxy group, a ureido group, a cyano group, a nitro group, an amino group, an alkoxycarbonylamino group, an aryloxycarbonyl group or an acyl group; $X_3$ represents an oxygen atom, a sulfur atom or an imino group which has not more than 4 carbon atoms; m represents an integer of value 1 or 2; the total number of carbon atoms included in the m individual $X_2$ groups is not more than 8; and when m is 2, the two $X_2$ groups may be the same or different.

9. A silver halide color photographic photosensitive material according to claim 1, wherein the photosensitive material comprises the compounds represented by the general formula [III]:

A—P—Z [III]

wherein A represents a coupling component which can react with the oxidation product of a color developing agent and which releases the —P—Z group on reacting with the oxidation product of the color developing agent; Z represents a development inhibitor; and —P—Z represents a group from which a development inhibitor is formed by reaction with the oxidation product of the developing agent after cleavage from A.

* * * * *